US012286806B2

(12) United States Patent
Rashid et al.

(10) Patent No.: US 12,286,806 B2
(45) Date of Patent: Apr. 29, 2025

(54) LIGHTWEIGHT COMPOSITE ROOFING SUPPORT SYSTEM

(71) Applicant: Phil Squared Roof Jack Systems LLC, Milford, MI (US)

(72) Inventors: Philip F Rashid, Milford, MI (US); Phillip A Tesolin, Hartland, MI (US)

(73) Assignee: Phil Squared Roof Jack Systems LLC, Highland, MI (US)

( * ) Notice: Subject to any disclaimer, the term of this patent is extended or adjusted under 35 U.S.C. 154(b) by 0 days.

(21) Appl. No.: 17/163,200

(22) Filed: Jan. 29, 2021

(65) Prior Publication Data

US 2021/0180342 A1 Jun. 17, 2021

Related U.S. Application Data

(63) Continuation-in-part of application No. 17/101,330, filed on Nov. 23, 2020, and a continuation of
(Continued)

(51) Int. Cl.
*E04G 3/26* (2006.01)
*E04D 13/12* (2006.01)
(Continued)

(52) U.S. Cl.
CPC ..... *E04G 3/26* (2013.01); *E04D 13/12* (2013.01); *E04D 15/02* (2013.01); *E04G 3/265* (2013.01); *E04G 3/34* (2013.01)

(58) Field of Classification Search
CPC .. E04G 3/26; E04G 3/265; E04G 3/34; E04G 3/243; E04G 3/24; E04G 21/3214;
(Continued)

(56) References Cited

U.S. PATENT DOCUMENTS 341,950 A * 5/1886 Crenshaw ..... E04G 3/26 248/237
844,746 A 2/1907 Rice
(Continued)

FOREIGN PATENT DOCUMENTS

CA 203678 S 7/2022
CA 203679 S 7/2022
(Continued)

OTHER PUBLICATIONS

Dura-Blok Rooftop Supports, posted (date unavailable) [online], [retrieved Oct. 5, 2022]. Retrieved from internet, https://www.eaton.com/us/en-us/catalog/support-systems/dura-blok-rooftop-supports.html (Year: 2022).
(Continued)

*Primary Examiner* — Christopher Garft
(74) *Attorney, Agent, or Firm* — Edmund P. Anderson; North Star IP Law PLLC

(57) ABSTRACT

A lightweight composite roofing support system comprises a longitudinally-extending core member comprising a longitudinally-extending first roof contact side comprising a first edge and opposed second edge, a longitudinally-extending second side comprising a second side working surface having a second width and a second length that is greater than the second width, the second side tapering toward the first edge at a first predetermined acute angle, and a longitudinally-extending third side comprising a third side working surface having a third width and a third length that is greater than the third width, the third side tapering toward the second edge at a second predetermined acute angle that is different than the first predetermined acute angle, a first end comprising an integral first recess defining a first handle, and an opposed second end comprising an integral second
(Continued)

recess defining a second handle, the core member comprising a wedge-shaped lateral cross-section.

21 Claims, 38 Drawing Sheets

Related U.S. Application Data application No. 29/741,731, filed on Jul. 15, 2020, said application No. 17/101,330 is a continuation of application No. 15/981,491, filed on May 16, 2018, now Pat. No. 10,844,616.

(60) Provisional application No. 62/506,835, filed on May 16, 2017.

(51) Int. Cl.
*E04D 15/02* (2006.01)
*E04G 3/34* (2006.01)

(58) Field of Classification Search
CPC ..... E04G 3/22; E04D 13/12; E04D 15/02; E04D 15/00; H02S 20/23
See application file for complete search history.

(56) References Cited

U.S. PATENT DOCUMENTS 1,586,038 A * 5/1926 Hall ..... E04G 3/26 248/237
D229,330 S 11/1973 Miles
4,132,287 A 1/1979 Parolini
4,135,335 A 1/1979 Jensen
4,519,565 A 5/1985 Whitmore
4,830,320 A 5/1989 Bellows
5,232,187 A * 8/1993 O'Farrell ..... B44D 3/14 248/237
5,263,551 A * 11/1993 Andersen ..... E04D 15/00 182/129
5,715,910 A 2/1998 Koch et al.
5,842,746 A 12/1998 Rogers
5,887,406 A * 3/1999 Bond ..... E04D 15/00 52/126.1
5,943,839 A * 8/1999 Miller ..... E04D 15/02 52/DIG. 1
D425,440 S 5/2000 Franklin
6,170,222 B1 * 1/2001 Miller ..... E04D 13/12 52/DIG. 1
D440,672 S 4/2001 Alexander
D461,138 S 8/2002 Spiller
D461,564 S 8/2002 Neuleib
6,513,625 B1 2/2003 Gaskins
6,622,960 B2 9/2003 Hyde
D486,243 S 2/2004 Yamaoka
D596,317 S 7/2009 Favell
D596,812 S 7/2009 Sicken et al.
8,104,575 B1 * 1/2012 Bancroft ..... E01C 9/086 52/749.12
8,448,746 B2 * 5/2013 Davis, Jr. ..... E04D 15/00 182/45
D704,858 S 5/2014 Green
D738,711 S 9/2015 Tally
9,145,687 B1 * 9/2015 Bancroft ..... E04D 15/00
D743,628 S 11/2015 Millington
D762,306 S 7/2016 Torres et al.
D767,796 S 9/2016 Kinsman
9,458,639 B1 10/2016 Coleman
9,834,937 B2 12/2017 Warner
D809,799 S 2/2018 Pietruszewski et al.
D810,008 S 2/2018 Mollison et al.
D810,010 S 2/2018 Rook et al.
9,945,128 B1 4/2018 Baird
D821,959 S 7/2018 Baker
D824,749 S 8/2018 Wright et al.
10,206,511 B2 2/2019 Peters
10,273,694 B2 4/2019 Wright et al.
10,550,588 B2 2/2020 Smith et al.
D883,775 S 5/2020 Wojcik et al.
10,662,707 B2 5/2020 Koeman
D892,193 S 8/2020 Masuda et al.
10,844,616 B2 11/2020 Rashid et al.
D920,881 S 6/2021 Sheehan
D942,051 S 1/2022 Andreu
D948,753 S 4/2022 Rashid
D948,754 S 4/2022 Rashid
D970,051 S 4/2022 Rashid
D970,052 S 4/2022 Rashid
D960,396 S 8/2022 Rashid
D968,550 S 11/2022 Reina
D977,683 S 2/2023 Rashid
D983,411 S 4/2023 Rashid et al.
D983,412 S 4/2023 Rashid et al.
D984,680 S 4/2023 Rashid et al.
D1,007,007 S 12/2023 Rashid et al.
2003/0037990 A1 2/2003 Testa
2004/0144815 A1 7/2004 Reid
2004/0221524 A1 * 11/2004 Poddany ..... F24S 25/60 52/204.5
2004/0262467 A1 12/2004 Burr
2005/0097836 A1 5/2005 Krovats
2006/0000180 A1 * 1/2006 Blais ..... E04G 3/265 52/651.1
2007/0022676 A1 2/2007 Krovats
2007/0069088 A1 3/2007 Bidiville et al.
2008/0042025 A1 * 2/2008 Brouard ..... A47B 91/06 248/188.9
2009/0151039 A1 * 6/2009 Kielland ..... A41D 13/065 2/24
2009/0249740 A1 * 10/2009 Crookston ..... E04D 15/02 52/749.12
2010/0127002 A1 * 5/2010 Bel ..... E04D 15/00 220/629
2011/0154771 A1 6/2011 Krovats
2012/0080264 A1 * 4/2012 Lord ..... E04G 3/26 182/45
2012/0085590 A1 * 4/2012 Davis, Jr. ..... E04D 15/00 182/45
2014/0116804 A1 * 5/2014 Bancroft ..... E06C 1/345 182/45
2015/0021452 A1 * 1/2015 Bourbonnais ..... B65D 19/0095 248/544
2018/0334814 A1 11/2018 Rashid et al.
2019/0218799 A1 * 7/2019 Smith ..... E04G 3/26
2020/0370315 A1 * 11/2020 Pollock ..... A41D 13/065
2021/0087836 A1 3/2021 Rashid et al.
2021/0178398 A1 * 6/2021 Chiu ..... B01L 9/06
2021/0180342 A1 6/2021 Rashid et al.
2021/0388619 A1 * 12/2021 Pollock ..... E04D 13/12
2022/0282502 A1 9/2022 Rashid et al.

FOREIGN PATENT DOCUMENTS

CA 203680 S 7/2022
CA 203681 S 7/2022
CA 203682 S 7/2022
EP 0710457 A2 5/1996
FR 2964985 A1 3/2012
WO PCTUS2211735 1/2022
WO PCTUS2211736 1/2022
WO 2022164619 A1 8/2022
WO 2022186900 A1 9/2022

OTHER PUBLICATIONS

Highcraft STC-10T Rooftop Pipe Support Block . . . , posted Mar. 11, 2020 [online], [retrieved Oct. 5, 2022]. Retrieved from Internet,

(56) References Cited

OTHER PUBLICATIONS https://www.amazon.com/Highcraft-STC-10T-Galvanized-Replacement-lb-capacity/dp/B085SVFVH 6/ref=sr_1_3? (Year: 2020).

* cited by examiner

| PHYSICAL PROPERTY | TEST METHOD | UNITS | TEST RESULTS | | | | | | |
|---|---|---|---|---|---|---|---|---|---|
| Density | ASTM-D3575 | grams/liter | 20 | 30 | 45 | 60 | 67 | 82 | 90 |
| Compressive Strength | ASTM-D3575 | MPa | | | | | | | |
| @25% Strain | | | 0.10 | 0.16 | 0.28 | 0.39 | 0.44 | 0.60 | 0.69 |
| @50% Strain | | | 0.16 | 0.23 | 0.37 | 0.53 | 0.58 | 0.80 | 0.93 |
| @75% Strain | | | 0.31 | 0.44 | 0.77 | 1.07 | 1.26 | 1.80 | 2.08 |
| Compression Set | ASTM-D3575 | % | 14 | 12 | 12 | 11 | 11 | 10 | 10 |
| Tensile Strength | ASTM-D3575 | MPa | 0.26 | 0.38 | 0.46 | 0.62 | 0.71 | 0.87 | 0.97 |
| Tensile Elongation | ASTM-D3575 | % | 15 | 15 | 14 | 14 | 13 | 13 | 12 |
| Tear Strength | ASTM-D3575 | KN/m | 1.74 | 2.13 | 2.73 | 3.25 | 3.51 | 4.07 | 4.35 |
| Flexural Strength | ASTM-D790 | MPa | .21 | .38 | .54 | .72 | .86 | 1.08 | 1.16 |
| Flexural Modulus | | MPa | 9.8 | 11.6 | 14.5 | 19.0 | 22.2 | 28.9 | 31.1 |
| Coefficient of Linear Thermal Expansion | ASTM-D696 | mm/mm/°C x $10^{-5}$ | | | | | | | |
| 20°C to -40°C | | | 6.8 | 5.9 | 5.5 | 4.3 | 4.1 | 3.9 | 3.7 |
| 20°C to 80°C | | | 10.8 | 10.2 | 9.8 | 8.7 | 7.9 | 7.5 | 6.8 |
| Water Absorption | ASTM-C272 | gms/cc x $10^{-3}$ | 10.4 | 8.1 | 6.2 | 5.1 | 4.5 | 4.2 | 3.5 |
| Flammability | FMVSS 302 | < 100 mm/min. | Pass | Pass | Pass | Pass | Pass | Pass | Pass |
| Chemical Resistance (Auto fuels, fluids, solvents) | Various | 1 hr exposure | Pass | Pass | Pass | Pass | Pass | Pass | Pass |

FIG. 52

| EMR1 POLYETHER POLYURETHANE FOAM | | | | |
|---|---|---|---|---|
| PHYSICAL PROPERTIES* | TEST VALUES* | | | |
| | U.S. STANDARD | | METRIC | |
| | MINIMUM | AVERAGE | MINIMUM | AVERAGE |
| Density | 1.50 ± 10% lbs./ft.$^3$ | | 24.0 ± 10% kg/M$^3$ | |
| Tensile Strength | 15.0 psi | 20.0 psi | 103 kPa | 138 kPa |
| Elongation | 150% | 250% | 150% | 250% |
| Tear Resistance | 1.30pli | 2.00pli | 228 N/M | 350 N/M |
| Indentation Force Deflection | | | | |
| 25% Deflection | 35 lbs./50 in.$^2$ | 45 lbs./50 in.$^2$ | 156 N/323 cm$^2$ | 200 N/323 cm$^2$ |
| 65% Deflection | 70 lbs./50 in.$^2$ | 90 lbs./50 in.$^2$ | 311 N/323 cm$^2$ | 400 N/323 cm$^2$ |
| Retention of Tensile Strength after 5 hours, 120°C, steam autoclave | Min. 70% | | | |

Flammability Characteristics:

- Meets the requirements of S4.3 of Federal Motor Vehicle Safety Standard No. 302 ‡

Features:

- This product contains additives to retard microbial growth and degradation.
- Restriction of Hazardous Substances European Union Directive [ROHS3] - (2015/863/EU) Meets the Requirements of SVHC through today's date.
- Compliant with European union REACH (Registration, Evaluation and Authorization of Chemical Substances - EC1907/2006
- Minimum IFD at 20mm (0.79 in) thickness 23 lbs./50 sq. in.

* Test Methods: ASTM-D3574-[latest version]. Standard Methods of Testing Flexible Cellular Materials - Slab, Bonded, and Molded Urethane Foam.

FIG. 53

LIGHTWEIGHT COMPOSITE ROOFING SUPPORT SYSTEM

CROSS REFERENCE TO RELATED APPLICATIONS

This application is a continuation-in-part of and claims priority to U.S. Non-Provisional Utility patent application Ser. No. 17/101,330 filed on Nov. 23, 2020, which is a continuation of and claims priority to U.S. Non-Provisional Utility patent application Ser. No. 15/981,491 filed on May 16, 2018, which claims priority to U.S. Provisional Patent Application No. 62/506,835 filed on May 16, 2017 and is a continuation of and claims priority to U.S. Non-Provisional Design patent application No. 29/741,731 filed on Jul. 15, 2020, the contents of which are incorporated herein by reference in their entirety.

FIELD OF THE INVENTION

The subject invention relates generally to a lightweight roofing support system. More particularly, it relates to a lightweight composite roofing support system that is configured to provide a level, stable, self-supporting platform for roofing workers, roofing tools, roofing materials, or a combination thereof, on a pitched or sloped roof.

BACKGROUND

The removal and/or application of roofing systems and roofing materials on sloped or pitched roofs presents long-standing problems, particularly on relatively steeply pitched roofs, such as those having a pitch above 8/12 (i.e., 8 feet of vertical rise for every 12 feet of horizontal run), problems that are particularly acute on steeply pitched roofs with pitches ranging from 10/12 to 16/12. Steeply pitched roofs are exceedingly difficult for roofing workers to work on, particularly to move, walk, stand, crouch, kneel, sit, or lie on, or otherwise, whether working to to remove an old roof or to construct a new roof, and including to distribute or store roofing tools or equipment or roofing materials for these purposes.

Various support systems and structures have been proposed to provide a platform for roofing workers, roofing tools, roofing materials, or a combination thereof, on pitched or sloped roofs. One common support structure comprises a plurality of spaced apart roof jacks that are used to support a jack board between them. The jack board generally provides a substantially horizontal surface on which roofing workers can move horizontally across the roof surface, and on which they may store roofing tools and roofing materials. A problem associated with this system is that the jack stands and jack boards are heavy and require a substantial expenditure of time and effort in order to locate, and in order to reposition as the deconstruction and/or construction of the roof systems proceed. In addition, attachment of the jack stands and the jack boards generally disadvantageously require anchoring to the roof deck by the insertion of nails or screws, or the resulting perforation of the upper portion of the shingles, underlayment material, or wooden roof deck, which are all known leakage paths for water from condensation, rain, and/or ice, for example.

Polymer based roof blocks have been proposed but have generally been unsuitable. In some cases, polymer roof blocks have been too rigid, such that the blocks are not non-skid and unstable and thus have a tendency to slide downwardly in the downslope direction over the surface of the pitched roof, particularly if the roof is steeply pitched.

Therefore, it would be very desirable provide a lightweight composite roofing support system that avoids the limitations described above, and a provides a level, stable, self-supporting platform for roofing workers, roofing tools, roofing materials, or a combination thereof, on pitched or sloped roofs, and particularly steeply pitched or sloped roofs.

SUMMARY OF THE INVENTION

In one embodiment, a lightweight composite roofing support system is disclosed. The lightweight composite roofing support system comprises a longitudinally-extending core member comprising a longitudinally-extending first roof contact side comprising a longitudinally-extending first edge and an opposed longitudinally-extending second edge, a longitudinally-extending second side comprising a second side working surface having a second width and a second length that is greater than the second width, the second side tapering toward the first edge at a first acute angle ($\alpha$) from the first roof contact side, and a longitudinally-extending third side comprising a third side working surface having a third width and a third length that is greater than the third width, the third side tapering toward the second edge at a second acute angle ($\beta$) from the first contact side that is different than the first acute angle ($\alpha$), a laterally-extending first end comprising an integral first recess defining a first handle or grip, and an opposed laterally-extending second end comprising an integral second recess defining a second handle or grip, the core member comprising a core material and a wedge-shaped lateral cross-section, the core member configured for disposition of a longitudinally-extending resiliently compressible cover layer comprising a resiliently compressible cover material on the first roof contact side to provide a first roofing support.

In another embodiment, a lightweight composite roofing support system is disclosed. The lightweight composite roofing support system comprises a longitudinally-extending core member comprising a longitudinally-extending first roof contact side comprising a longitudinally-extending first edge and an opposed longitudinally-extending second edge, a longitudinally-extending second side comprising a second side working surface having a second width and a second length that is greater than the second width, the second side tapering toward the first edge at a first acute angle ($\alpha$) from the first roof contact side, and a longitudinally-extending third side comprising a third side working surface having a third width and a third length that is greater than the third width, the third side tapering toward the second edge at a second acute angle ($\beta$) from the first contact side that is different than the first acute angle ($\alpha$), a laterally-extending first end comprising an integral first recess defining a first handle or grip, and an opposed laterally-extending second end comprising an integral second recess defining a second handle or grip, the core member comprising a core material and a wedge-shaped lateral cross-section. The lightweight composite roofing support system also comprises a resiliently compressible cover layer comprising a resiliently compressible cover material, the cover layer disposed on and covering the first roof contact side, the core member and cover layer comprising a first roofing support.

In yet another embodiment, a lightweight composite roofing support system connector is disclosed. The lightweight composite roofing support system connector comprises a longitudinally-extending connector comprising a first connector end and an opposed second connector end joined together by a longitudinally-extending intermediate portion, the first connector end configured for selective attachment to or detachment from a first roof support and the second connector end configured for selective attachment to or detachment from a second roof support, wherein upon attachment the connector is configured to connect the first roof support and the second roof support.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which:

FIG. 52 is a table illustrating representative properties of a core material comprising expanded polypropylene (EPP);

FIG. 53 is a table illustrating representative properties of a cover material comprising a flexible polyurethane foam (FPF).

DESCRIPTION OF THE EMBODIMENTS

Figure 1:
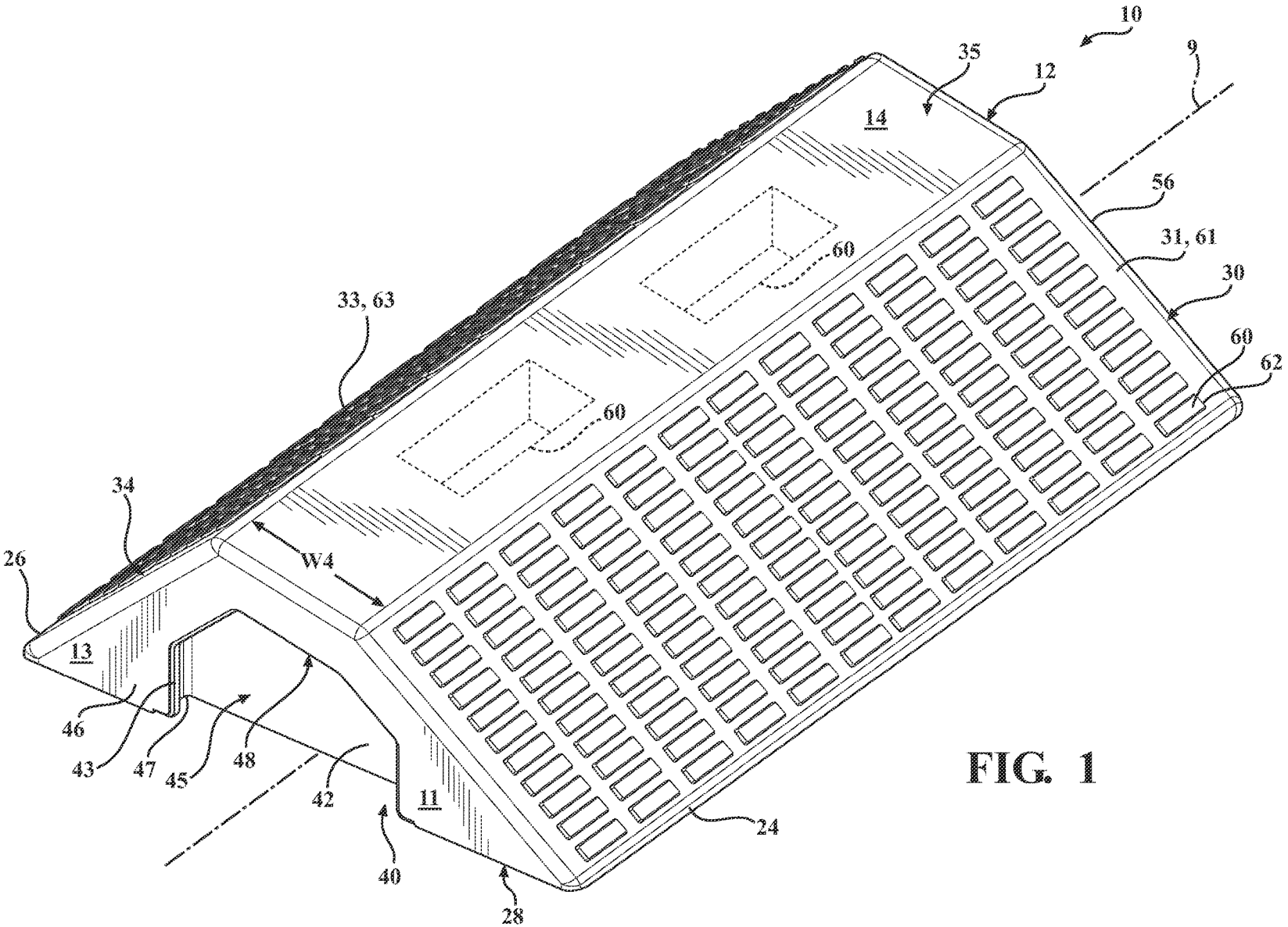
FIG. 1 is a perspective view of an embodiment of a roofing support system and roof support as disclosed herein illustrating an embodiment of a core member as described herein.
Figure 2:
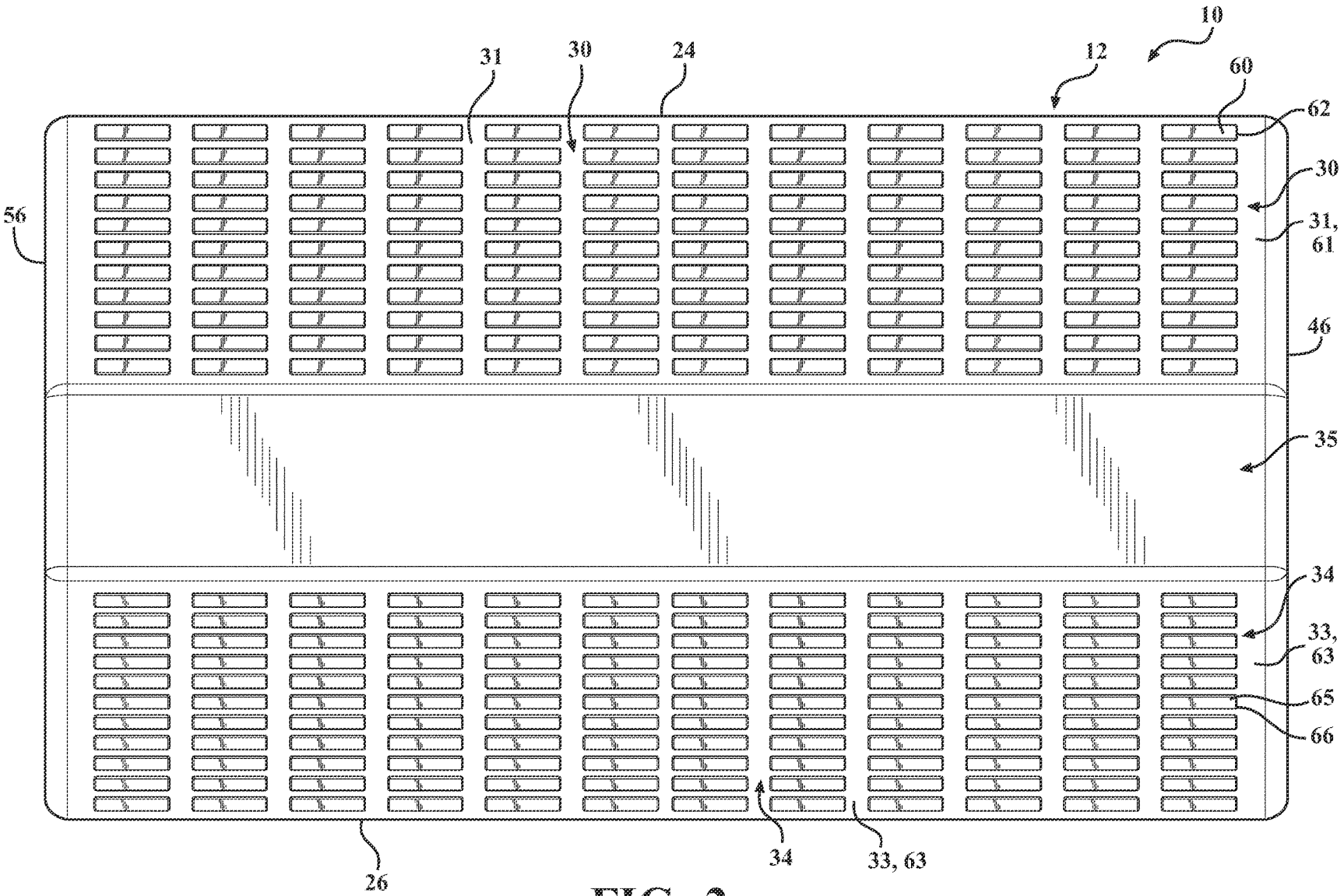
FIG. 2 is a top view of the roofing support system and roof support of FIG. 1.
Figure 3:
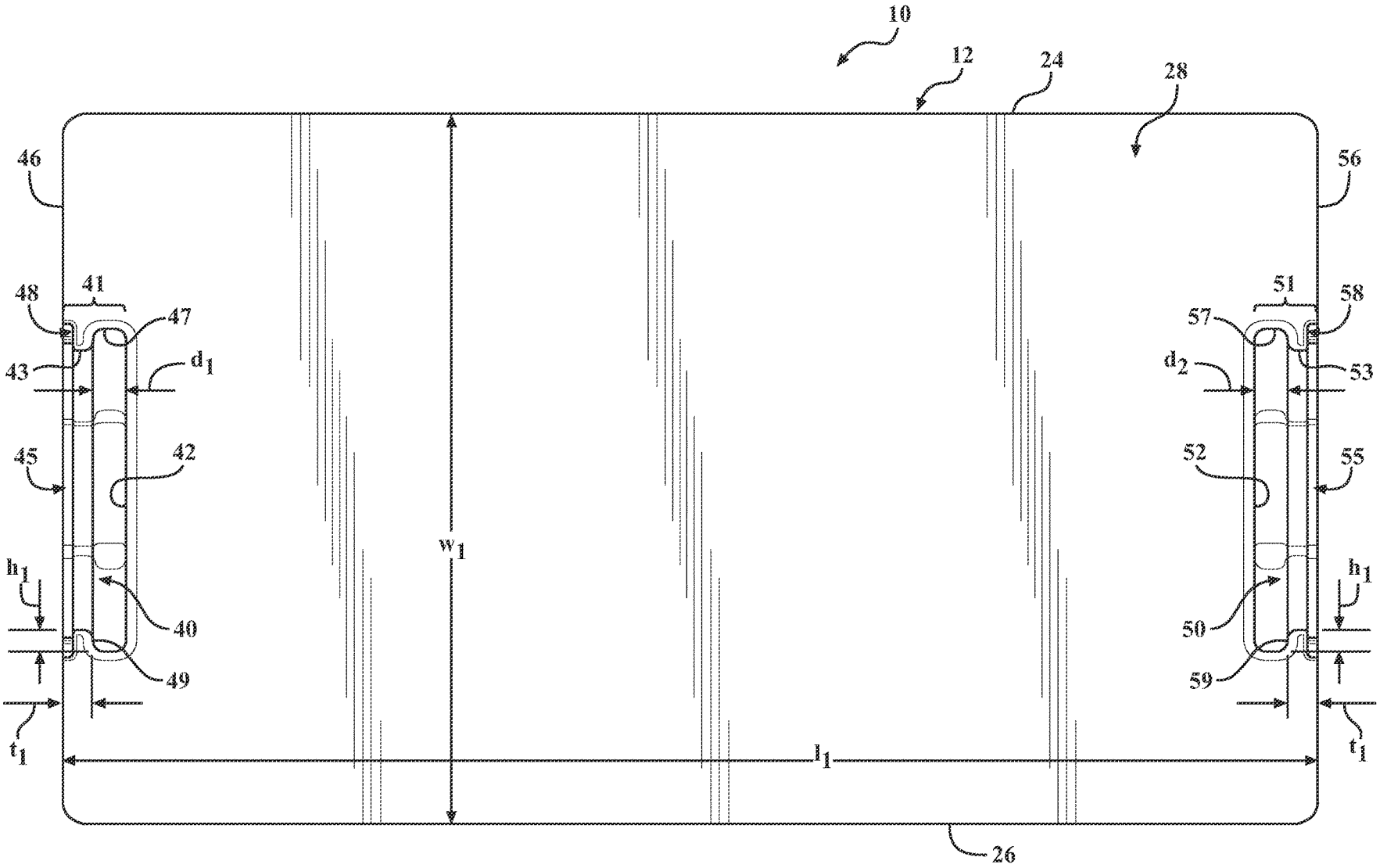
FIG. 3 is a bottom view of the roofing support system and roof support of FIG. 1.

This invention comprises a lightweight composite roofing support system comprising a reversible dual or double-wedge that supports, or acts as a support for, a load placed on a sloped or pitched roof. The load may include a roofing worker (person), or workers, or various roofing materials or equipment, or a combination thereof. The lightweight composite roofing support system may be used without the requirement of fasteners to hold it in place. As used herein, roofing workers includes any person performing work on the roof of a house or other building for any purpose, including those that repair, remove, or install roofing materials, as well as painters, carpenters, siding installers, seasonal light installers, satellite installers, HVAC equipment installers, homeowners, and any other person that has occasion to perform work upon a sloped or pitched roof, particularly a steeply sloped or pitched roof, as described herein. As used herein, roofing material may include any material or equipment or tool placed on the roof of a house or other building either temporarily or permanently, including roofing construction or repair materials, such as shingles, metal panels, boards, wooden or composite sheet or board underlayment, rolled roofing products, solar panels, vents, nails, staples, or screws, or materials or equipment that are placed on or in or protrude from a roof, such as various antennas, satellite dishes, chimney materials, skylights, windows, air conditioning components, and the like. The lightweight composite roofing support system represents an improvement over existing roofing support systems, sloped roof article holders and roof leveling platforms. The lightweight composite roofing support system can be used by roofing workers as a stable, non-skid platform to walk, stand, crouch, kneel, sit, or lie on, or stack, place or otherwise stage or store roofing materials or equipment on. The design allows the dual or double wedge to be manufactured at different lengths and for roofing workers as users to move freely along the length of the wedge analogous to the manner in which roofing workers would move along a traditional jack board that is used in combination with a plurality of roof jacks that are anchored to the roof with attachments such as nails or screws. The lightweight composite roofing support system advantageously does not require that it be anchored to the roof deck by the insertion of nails or screws with the resultant perforation of the upper portion of the shingles, underlayment, or wooden roof deck, which are all known leakage paths for water that occurs on the roof as a result of condensation, rain, hail, snow, or ice, for example. In one embodiment, the lightweight composite roofing support system or dual or double-wedge comprises a molded polymer support or core member with a plurality of support sides configured to provide a level working surface for at least two different specific roof slopes or pitches, and a substantially level work surface over a range of similar roof slopes that are greater than and less than the specific roof slopes, that has an attached cover layer or roof contact layer attached to a roof contact side that is configured to contact and provide compliance and adhesion to a steeply sloped roof surface. The core member also has integral handles or grips formed on opposed ends that may be used to easily lift or carry the roofing support system onto the sloped roof (e.g., up a ladder) or while working on the sloped roof.

In one embodiment, the lightweight composite roofing support system or dual wedge comprises a molded plastic support or core member with a plurality of support sides and a selectively attachable/detachable cover layer or roof contact layer and integral handles or grips formed on opposed ends.

In one embodiment, the lightweight composite roofing support system or wedge comprises a molded plastic support or core member with a plurality of support sides and a selectively attachable/detachable base and cover layer or roof contact layer and integral handles or grips formed on opposed ends.

The cross-sectional shape of the molded plastic support or core member may be configured with a triangular (e.g., scalene triangular), truncated triangular, scalene trapezoid, or irregular quadrilateral shape, for example, to provide a level working surface to move, walk, stand, crouch, kneel, sit, or lie on, or stack, place or otherwise store roofing materials or equipment on for two different specific roof slopes (e.g. 10/12 and 12/12), and a substantially level work surface over a range of roof slopes that are slightly less than or greater than the specific roof slopes, by merely rotating the base or roof contact surface of the wedge 180 degrees. The cover layer or roof contact layer includes a cover or roof contact material, such as various open-cell or closed-cell foams, including polyurethane foam, and natural or synthetic sponge rubber, and the like that advantageously provide a non-skid attachment or adhesion to most roof surfaces, particularly asphalt or fiberglass shingle roof surfaces, and including common roofing underlayment materials (e.g. asphalt felt, rubberized felt, and polymer or synthetic underlayment) or roof deck materials (e.g. dimensional lumber, plywood, and oriented strand board (OSB)). The cover or roof contact material may be configured to provide a coefficient of sliding friction, particularly when loaded, that in some embodiments prevents sliding movement down the roof, and other embodiments substantially prevents or resists sliding movement down the roof. Cost and weight are kept at a minimum while maintaining robustness by eliminating moving parts and the need for fasteners, such as nails and screws, found in related art devices.

In one embodiment, a triangular, truncated triangular, scalene trapezoidal, or irregular quadrilateral cross-sectional shape may be configured to provide dual or double-wedge lateral cross-sectional shape and a level working surface for two different roof slopes by merely rotating the wedge 180 degrees. In one embodiment, the level working surfaces of the support sides comprise a non-slip material, or include a surface roughness, texture, or pattern of protruding traction elements (e.g. raised rectangular, chevron, or wavy bars, or circular buttons) that provide a non-slip surface. The lightweight composite roofing support system or dual or double-wedge may include integral handles or grips, including integrally molded handles or grips, for easy transportation, including lifting or carrying the system onto a roof, and repositioning of the system or wedge on the roof while working.

As used herein, longitudinal or along the length refers to a direction that extends along an article centerline or axis, and may also be used in reference to a direction that is generally parallel to a roof peak. The term lateral or along the width or left-right refers to a direction that is orthogonal, or substantially orthogonal, to the longitudinal direction. The terms up or upward or down or downward refer to the top or bottom of the article, or to a direction substantially toward the top or bottom of the article, respectively, and may also be used in context in reference to a direction that is generally upward toward a roof peak or downward toward the ground. The terms in or inward refer to a direction toward the center of the article, and out or outward refers to the opposite direction away from the center or central portion of the article. The term upslope or up-roof refers to a direction or placement toward or closer to the peak or apex of a sloped roof and, conversely, the term downslope or down-roof refers to a direction or placement away from or farther from the peak or apex of a sloped roof and closer to the ground.

Referring to the figures, and particularly FIGS. 1-14 and 47-51, for example, a lightweight composite roofing support system 10 is disclosed. The lightweight composite roofing support system 10 is a roofing support or platform that supports a roofing load 2. The roofing load may be any static or dynamic roofing load 2 placed on a sloped or pitched roof 36, including a load from the weight of a roofing worker 6 or workers, or a roofing material 8, such as shingles 99 (e.g. asphalt or fiberglass shingles), rolled roofing material (e.g. tar paper, adhesive polymer snow and ice shield), structural members (e.g. dimensional lumber), underlayment (e.g. sheets of oriented strand board (OSB) and/or plywood), wood or clay or ceramic roofing tiles, metal roofing panels, solar shingles (e.g. solar panels applied directly to the roof and also serving as the roof covering) or solar roof panels (e.g. solar panels disposed onto or above the roofing material) and/or fasteners, or loads associated with any other construction materials (e.g. paint containers, siding, all manner of construction tools and/or equipment, and the like) placed thereon. In certain embodiments, the lightweight composite roofing support system 10 may also be referred to as a roof step or roof platform because it provides a platform for a worker, or workers, to move, walk, stand, crouch, kneel, sit, or lie on, or otherwise use as a level work surface while working on a sloped or pitched roof 36. The lightweight composite roofing support system 10 may be used without the requirement of fasteners to hold it in place. In these embodiments, the weight of a roofing load 2 placed on the lightweight composite roofing support system 10 together with the coefficient of friction of the contact surface of the support system in contact on the surface of the sloped or pitched roof 36 provides sufficient adhesion to secure the system to the roof. In one embodiment, the system 10 comprises a composite because it comprises a longitudinally-extending core member 12 made from a core material 14 and a longitudinally-extending cover layer 16 made from a cover material 18. Referring to the figures, and particularly FIGS. 8-14, in one embodiment, the lightweight composite roofing support system 10 described herein comprising longitudinally-extending core member 12 and longitudinally-extending cover layer 16 comprises a length of 24 inches and weighs 60-100 oz., more particularly 70-90 oz., and more particularly 75-85 oz. In another embodiment, the lightweight composite roofing support system 10 described herein comprising longitudinally-extending core member 12 and a longitudinally-extending cover layer 16 comprises a length of 32 inches and weighs 80-134 oz., more particularly 93-120 oz., and more particularly 100-113 oz.

Figure 4:
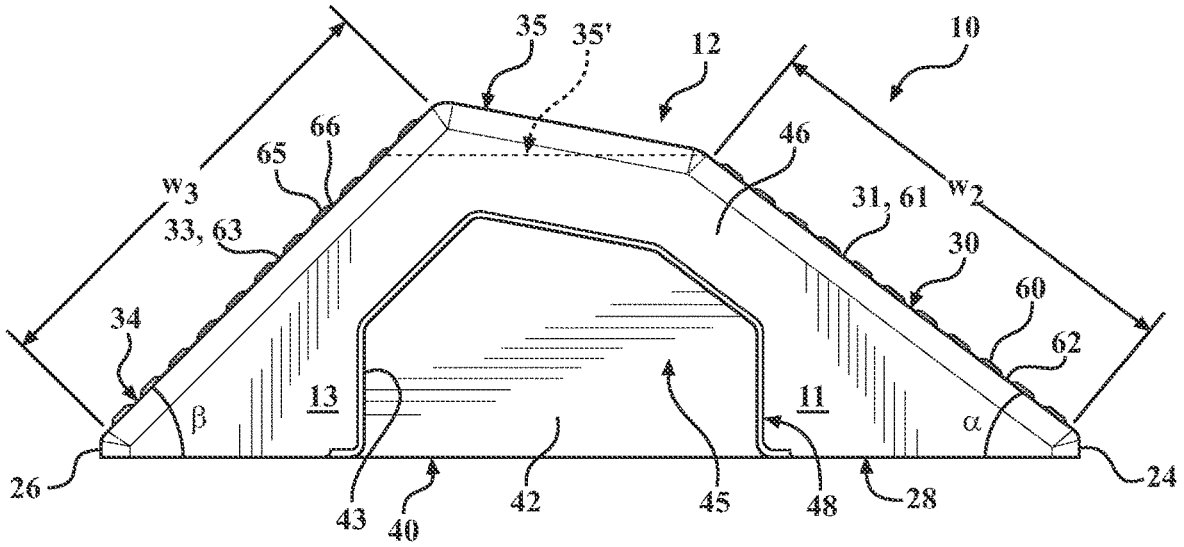
FIG. 4 is a left side view of the roofing support system and roof support of FIG. 1.
Figure 5:
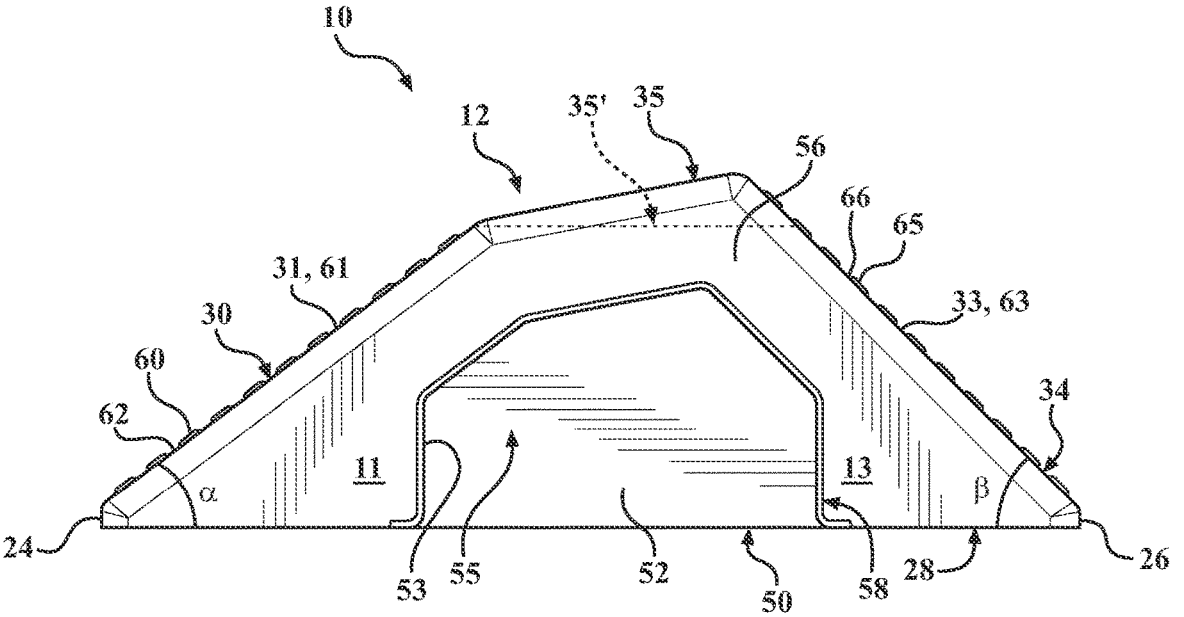
FIG. 5 is a right side view of the roofing support system and roof support of FIG. 1.
Figure 6:
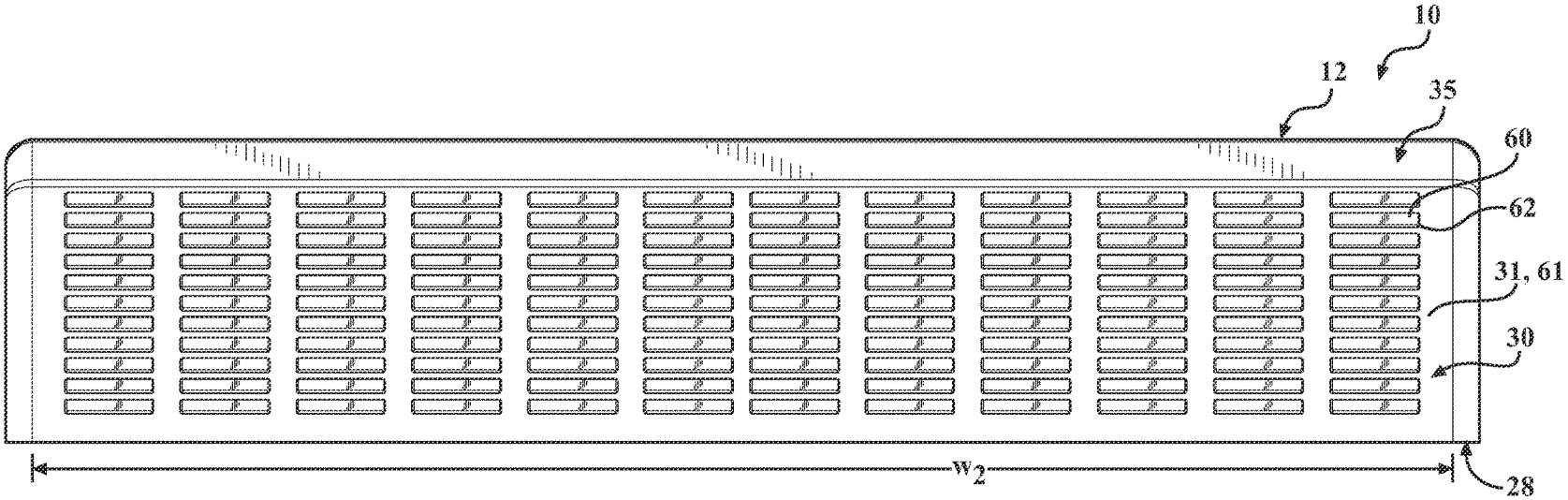
FIG. 6 is a front view of the roofing support system and roof support of FIG. 1.
Figure 7:
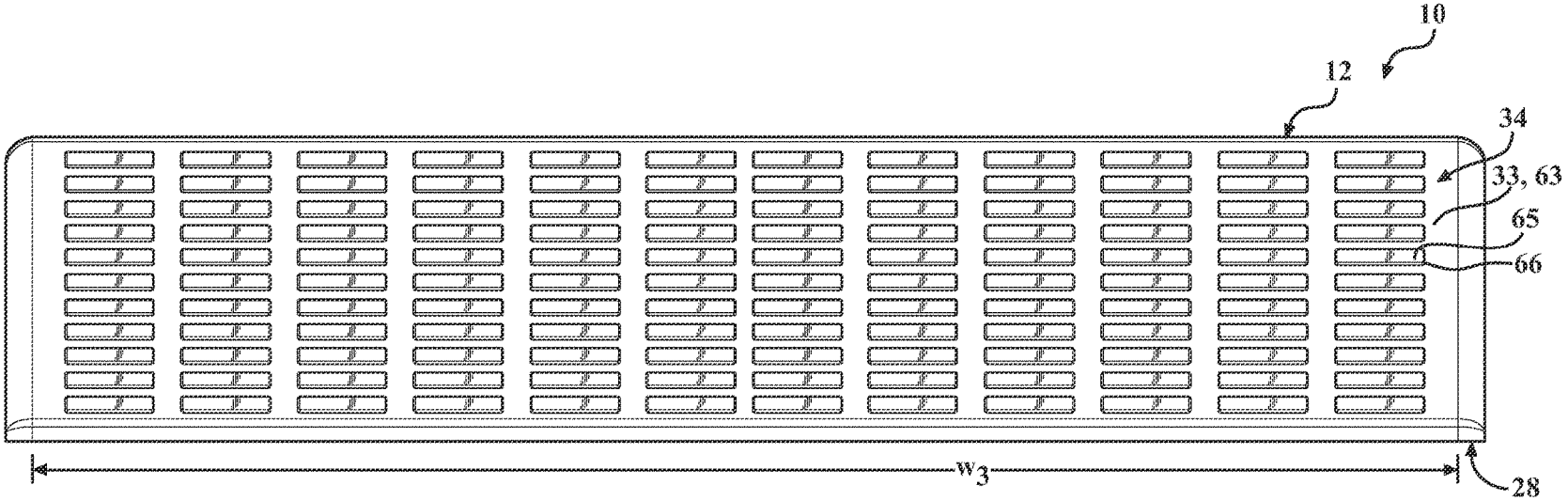
FIG. 7 is a rear view of the roofing support system and roof support of FIG. 1.
Figure 8:
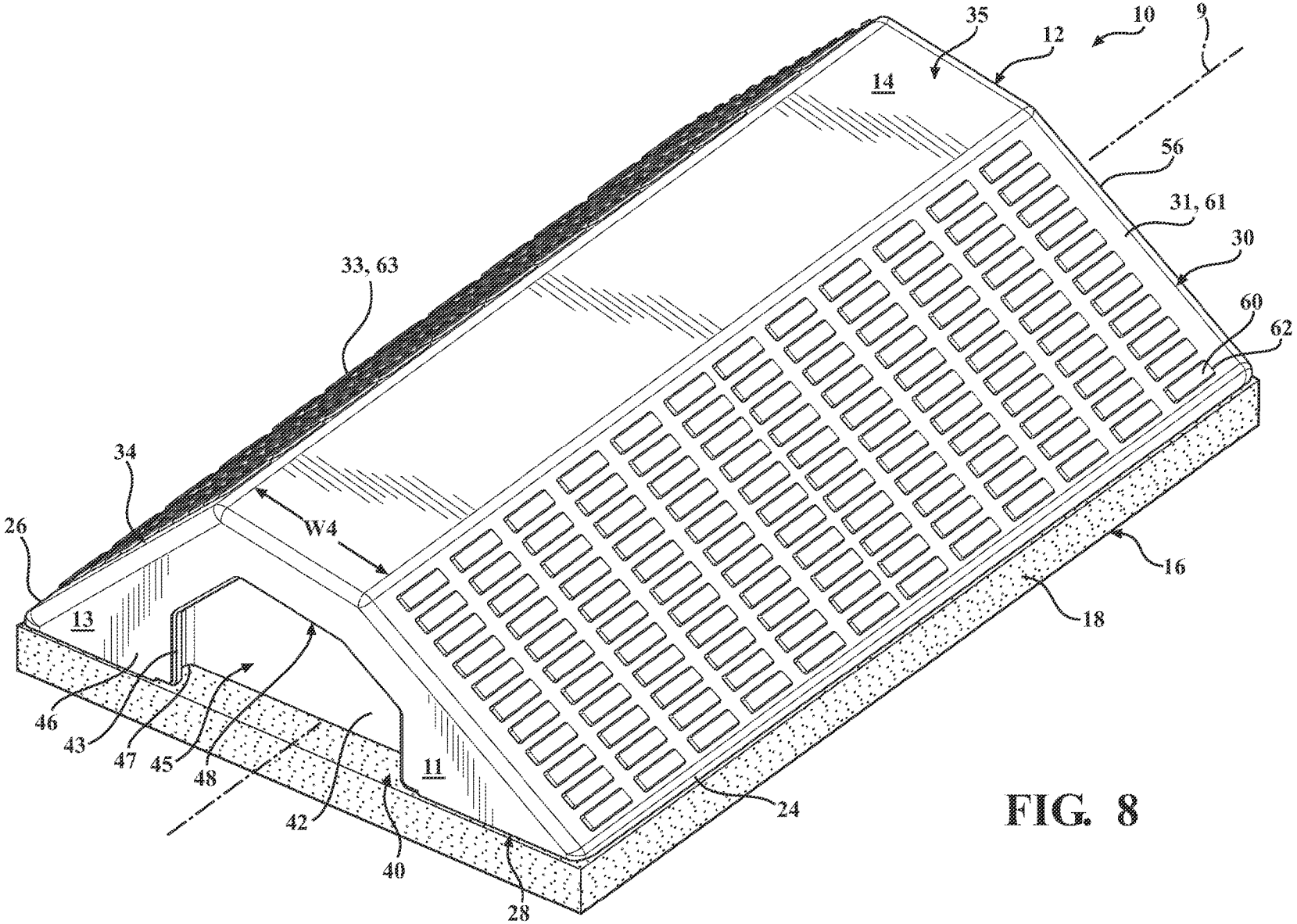
FIG. 8 is a perspective view of another embodiment of a roofing support system and roof support as disclosed herein illustrating a core member and attached resiliently compressible cover layer as described herein.
Figure 9A:
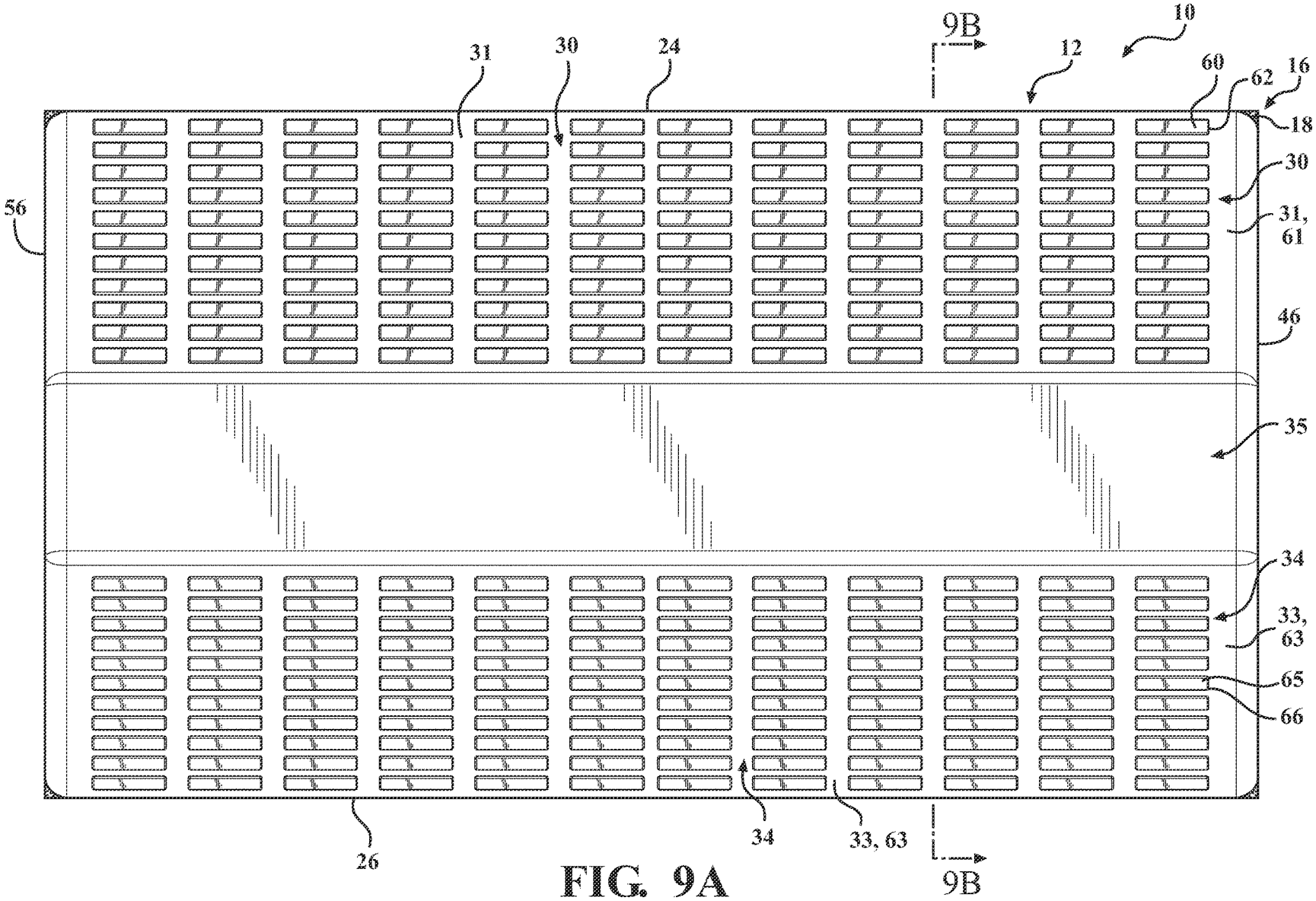
FIG. 9A is a top view of the roofing support system and roof support of FIG. 8.
Figure 9B:
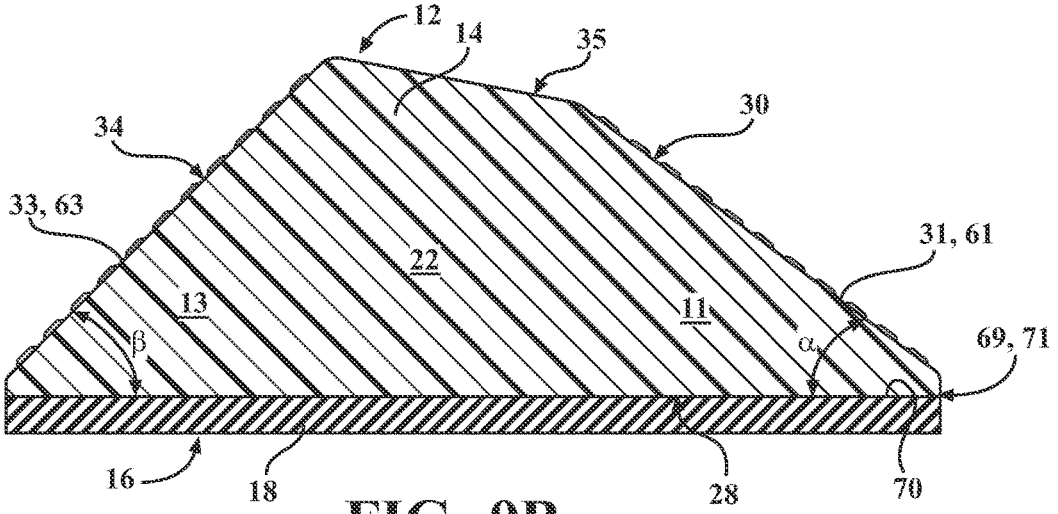
FIG. 9B is a cross-sectional view of FIG. 9A along Section B-B.
Figure 11:
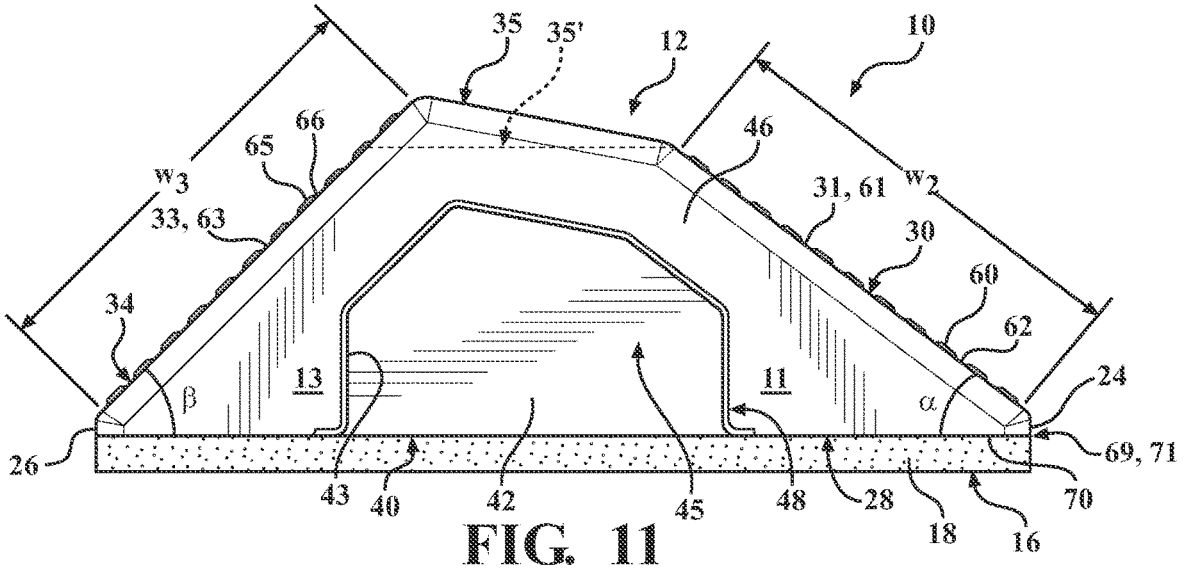
FIG. 11 is a left side view of the roofing support system and roof support of FIG. 8.
Figure 12:
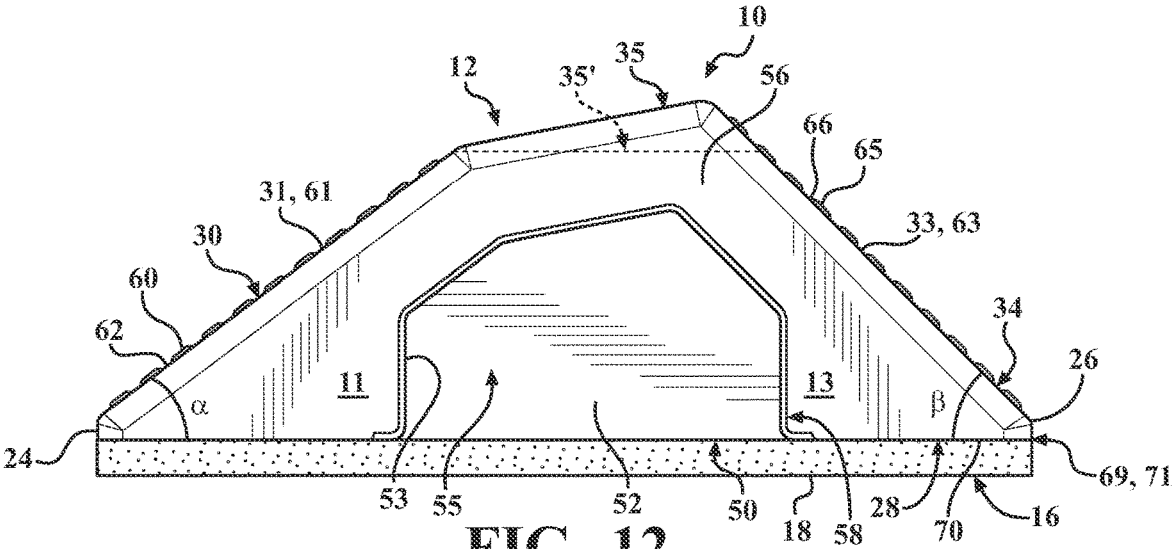
FIG. 12 is a right side view of the roofing support system and roof support of FIG. 8.
Figure 10:
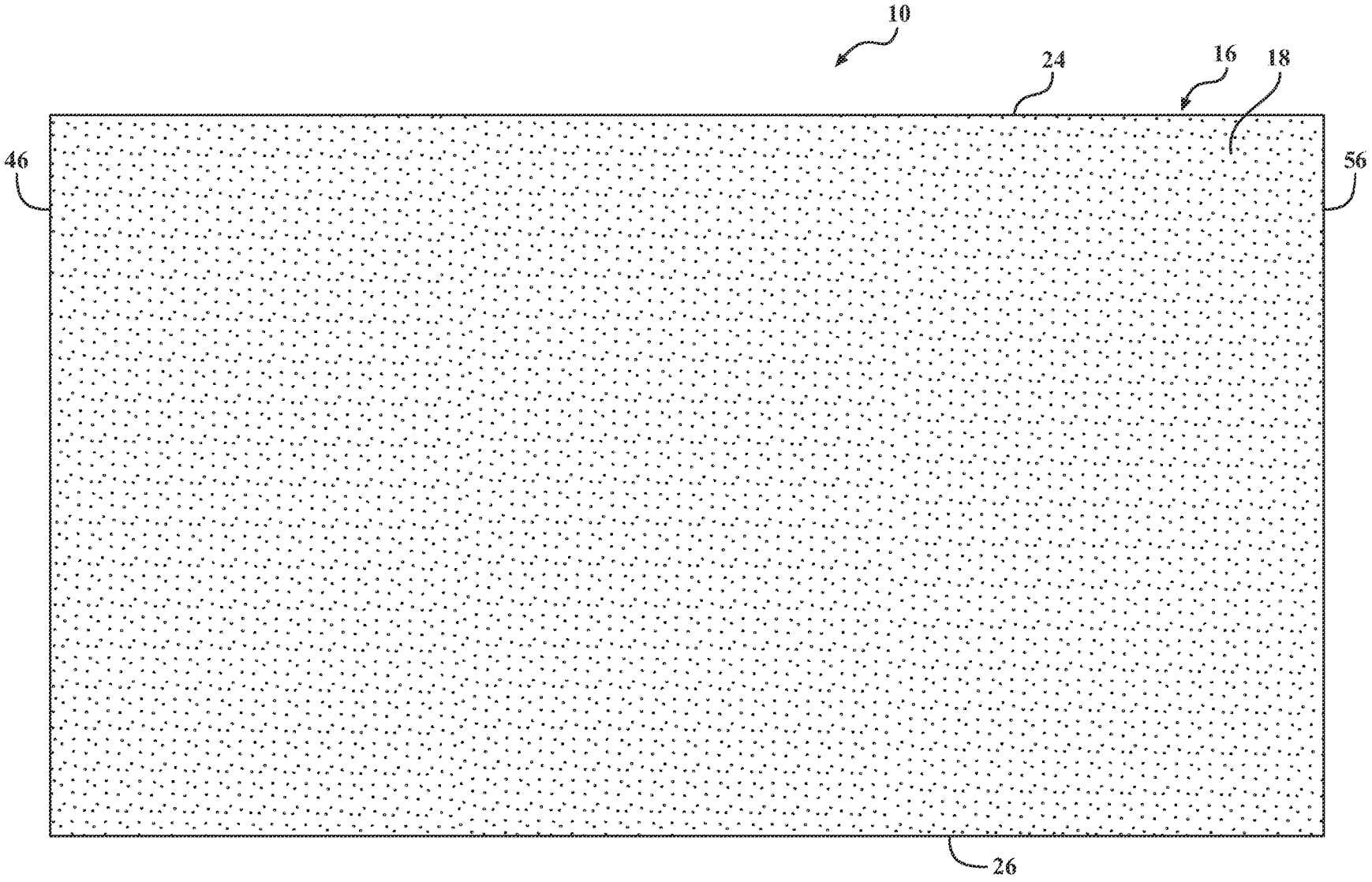
FIG. 10 is a bottom view of the roofing support system and roof support of FIG. 8.
Figure 13:
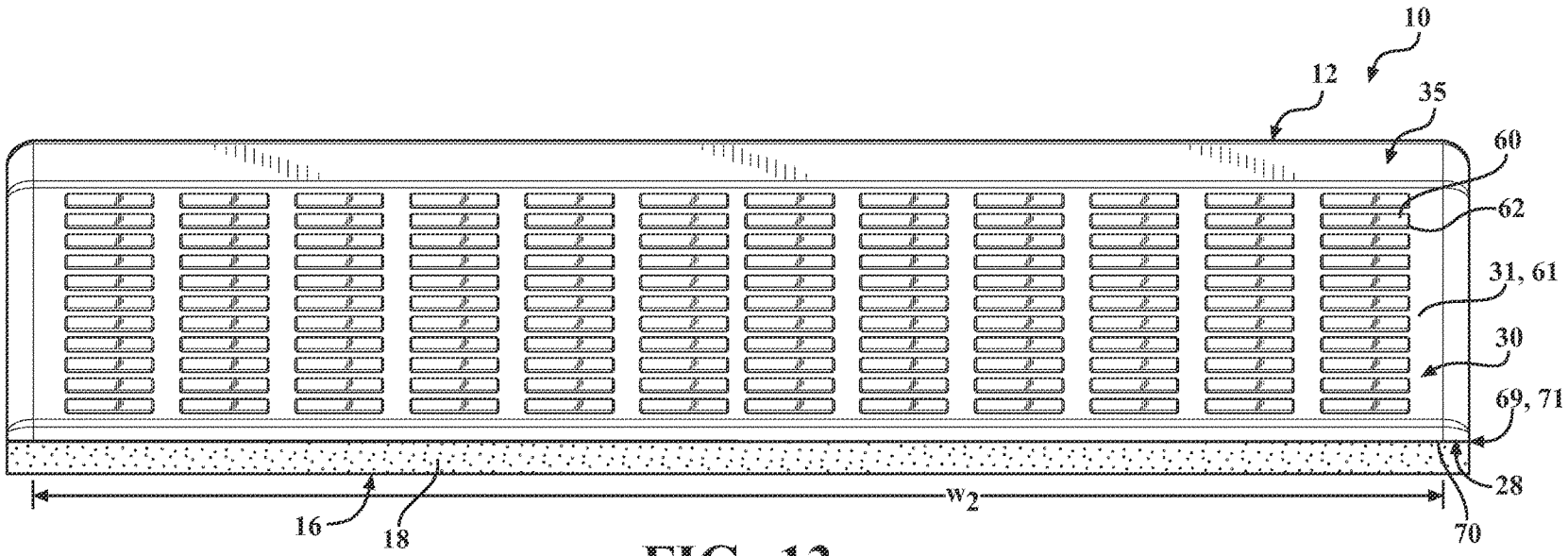
FIG. 13 is a front view of the roofing support system and roof support of FIG. 8.
Figure 14:
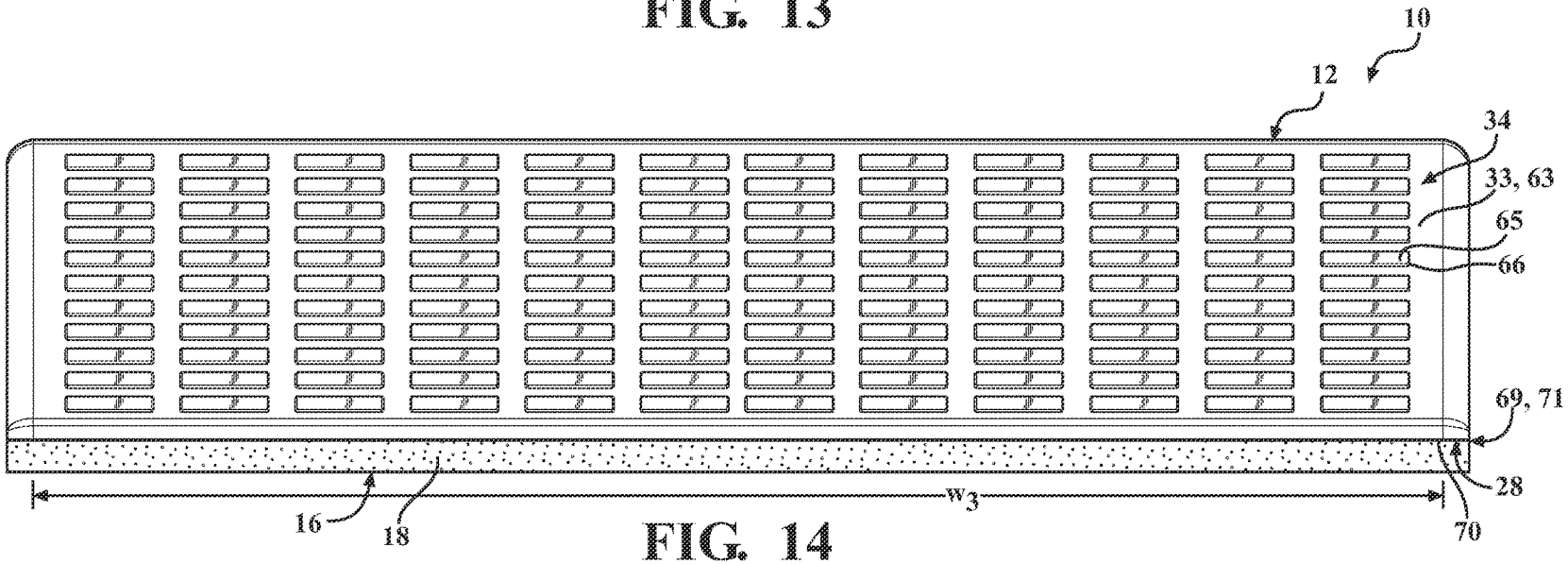
FIG. 14 is a rear view of the roofing support system and roof support of FIG. 8.
Figure 15:
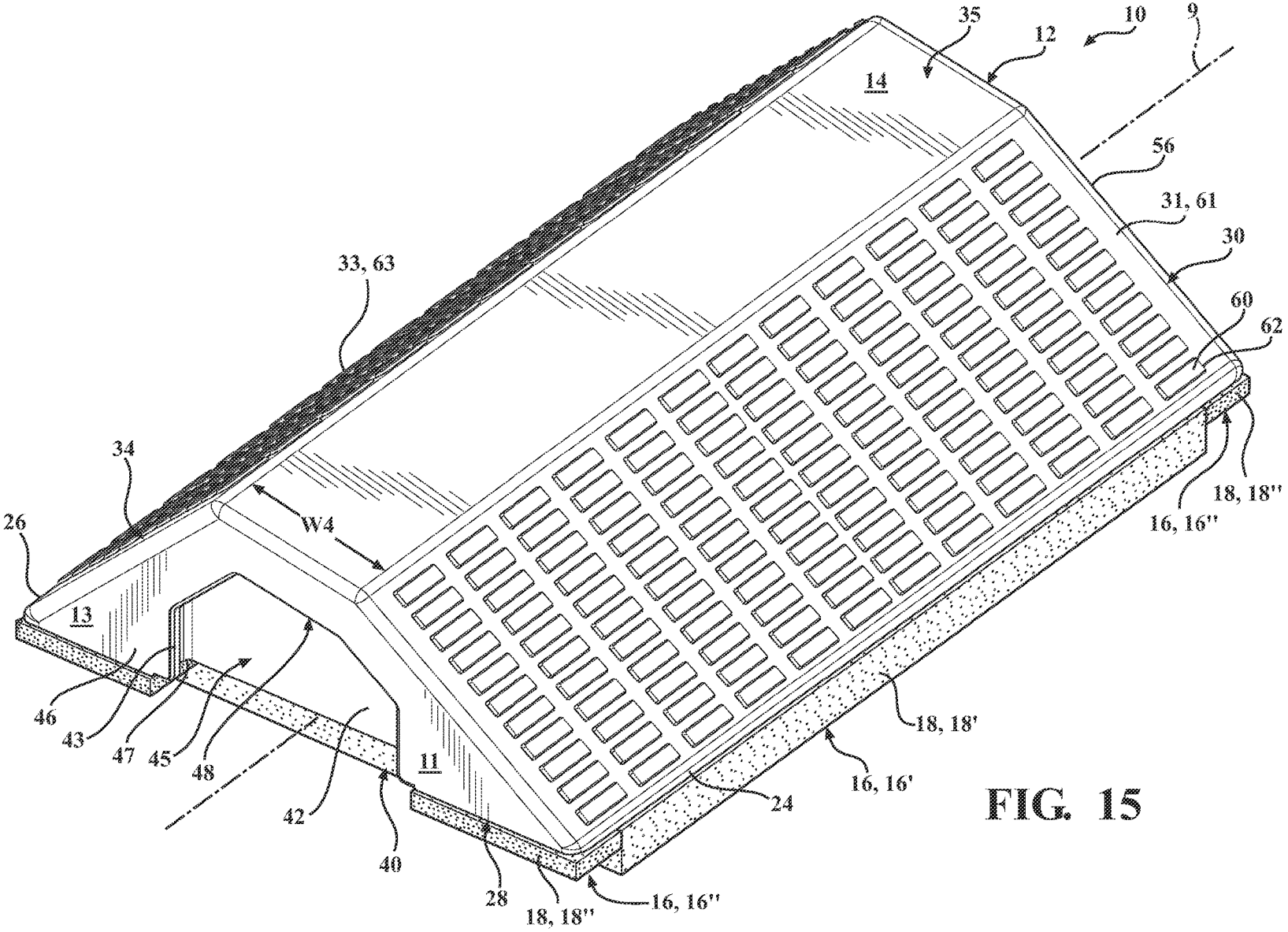
FIG. 15 is a perspective view of another embodiment of a roofing support system and roof support as disclosed herein illustrating a core member and resiliently compressible cover layer comprising a first resiliently compressible cover material and a second resiliently compressible cover material as described herein.
Figure 16:
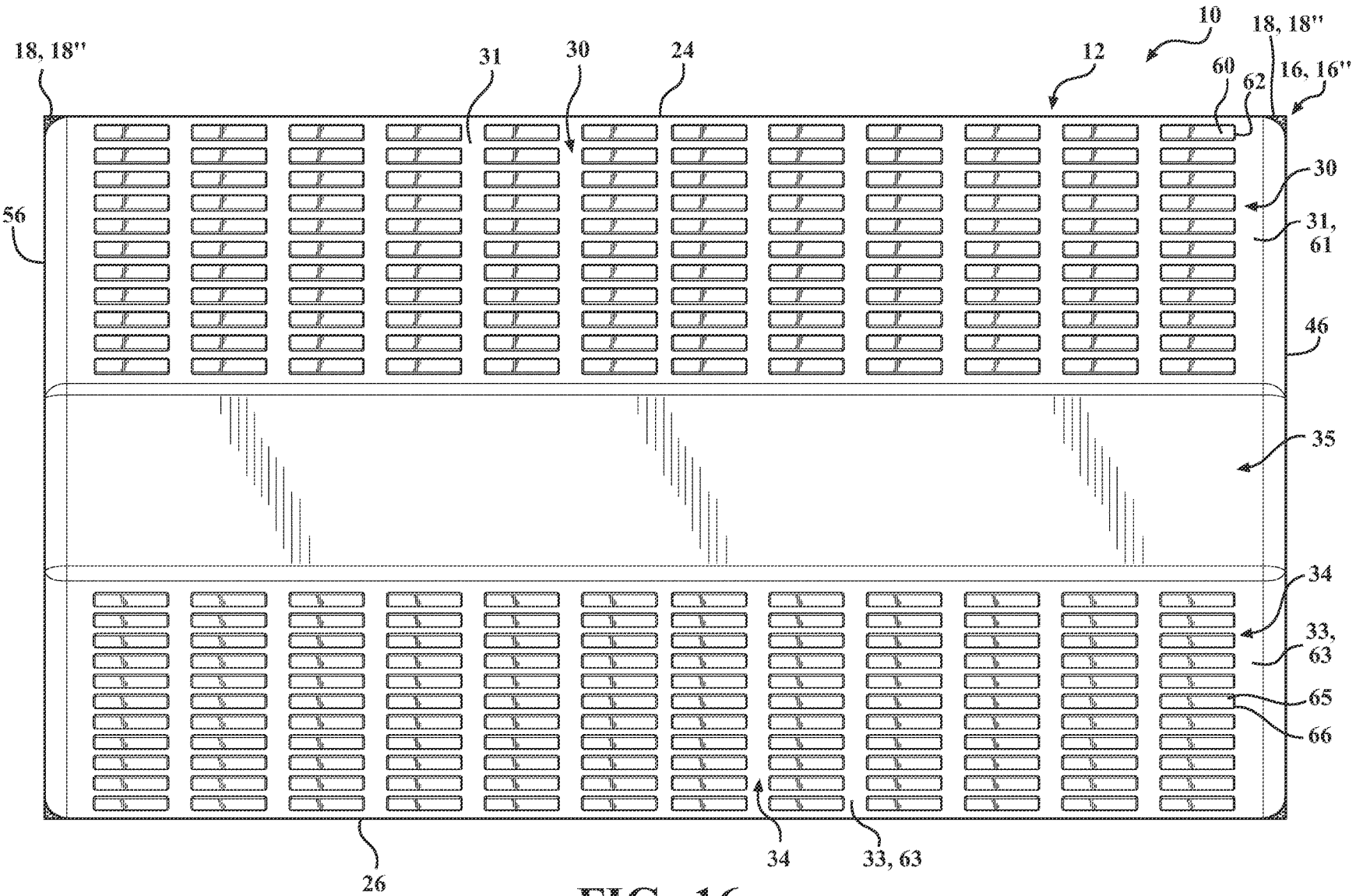
FIG. 16 is a top view of the roofing support system and roof support of FIG. 15.
Figure 17:
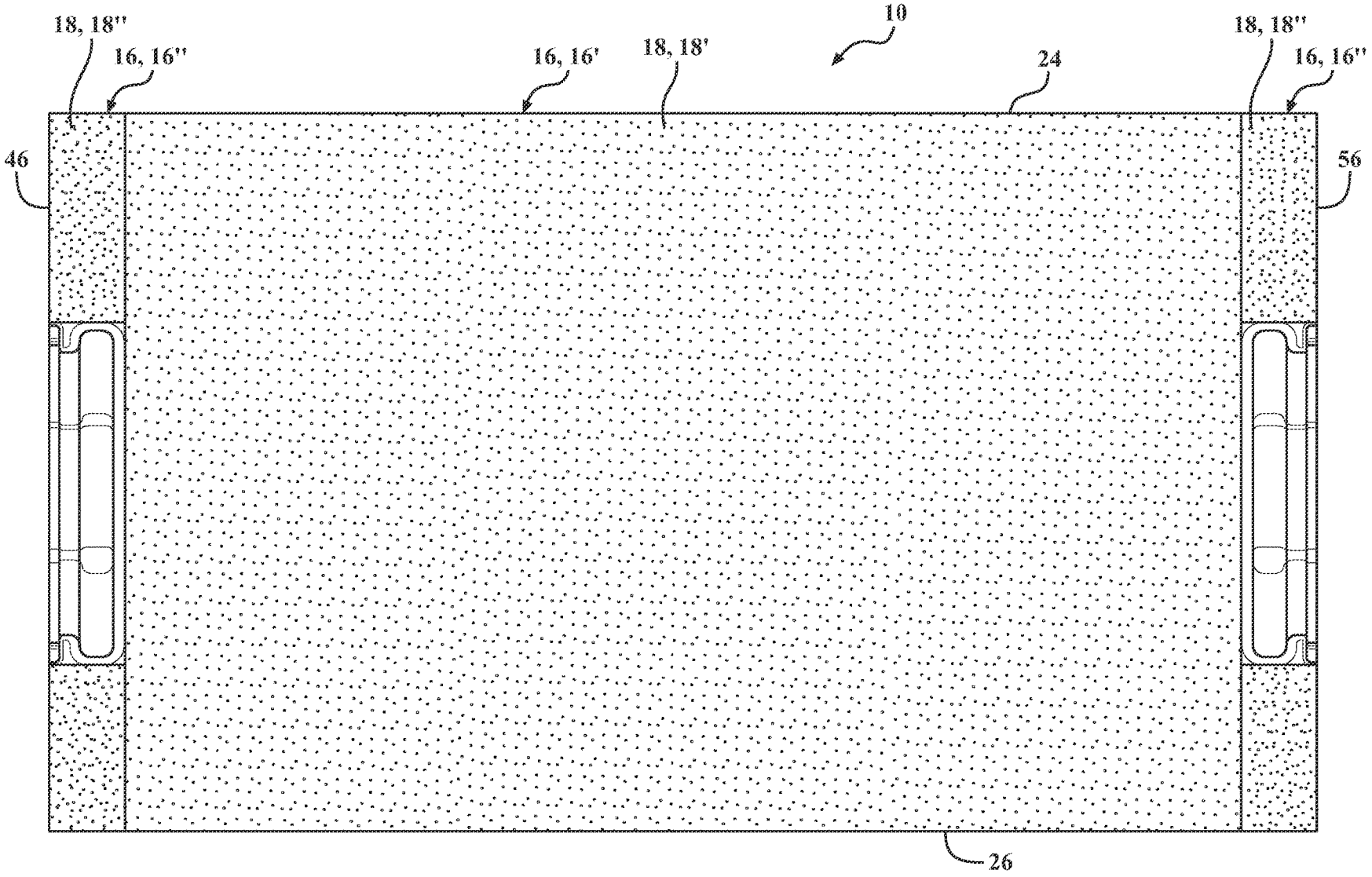
FIG. 17 is a bottom view of the roofing support system and roof support of FIG. 15.
Figure 18:
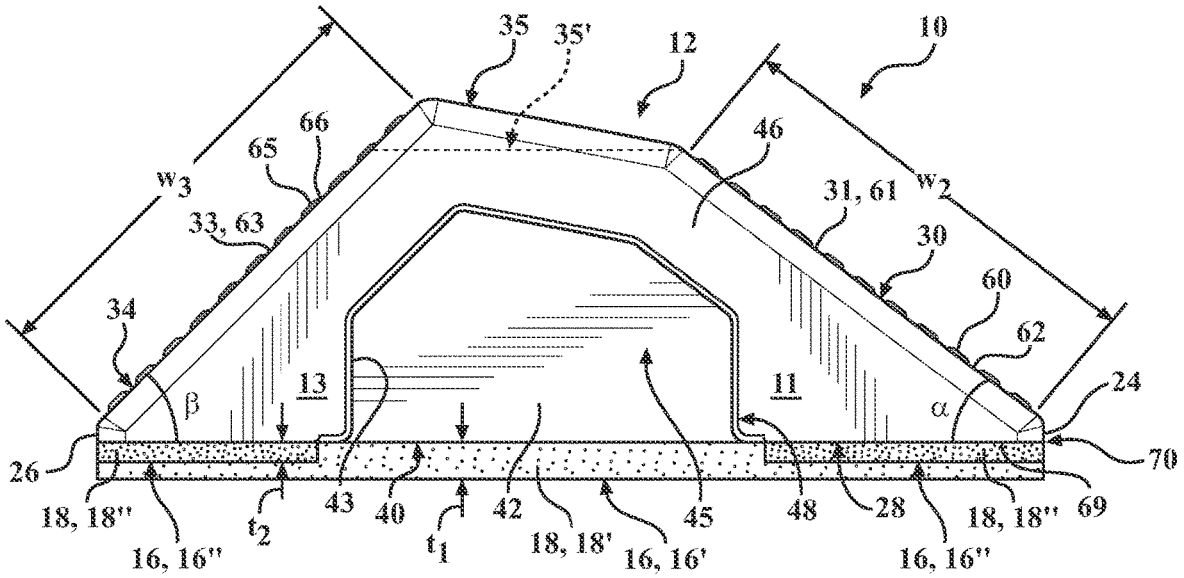
FIG. 18 is a left side view of the roofing support system and roof support of FIG. 15.
Figure 19:
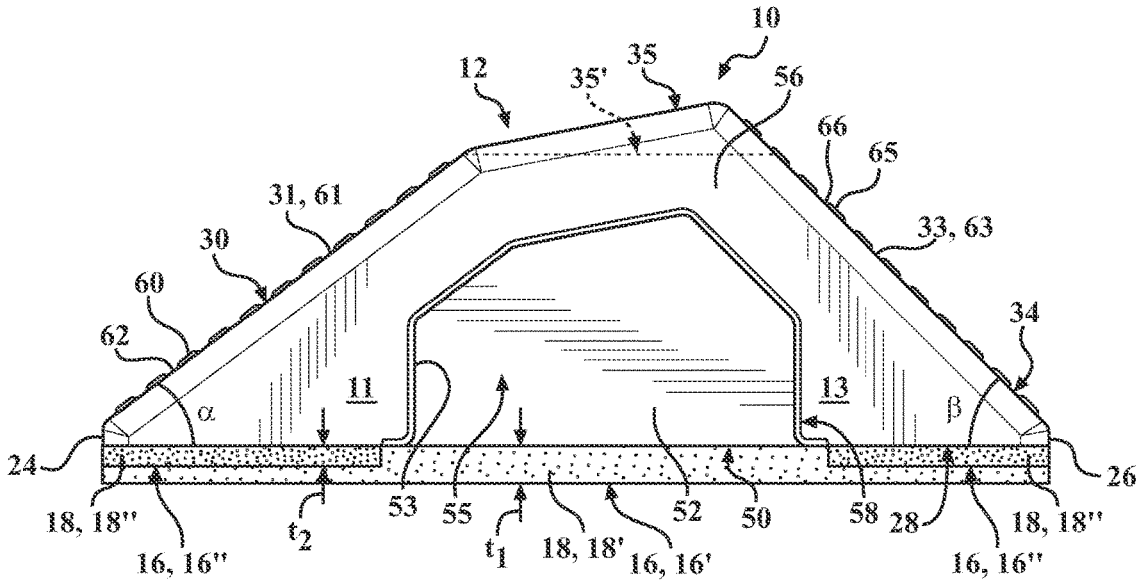
FIG. 19 is a right side view of the roofing support system and roof support of FIG. 15.
Figure 20:
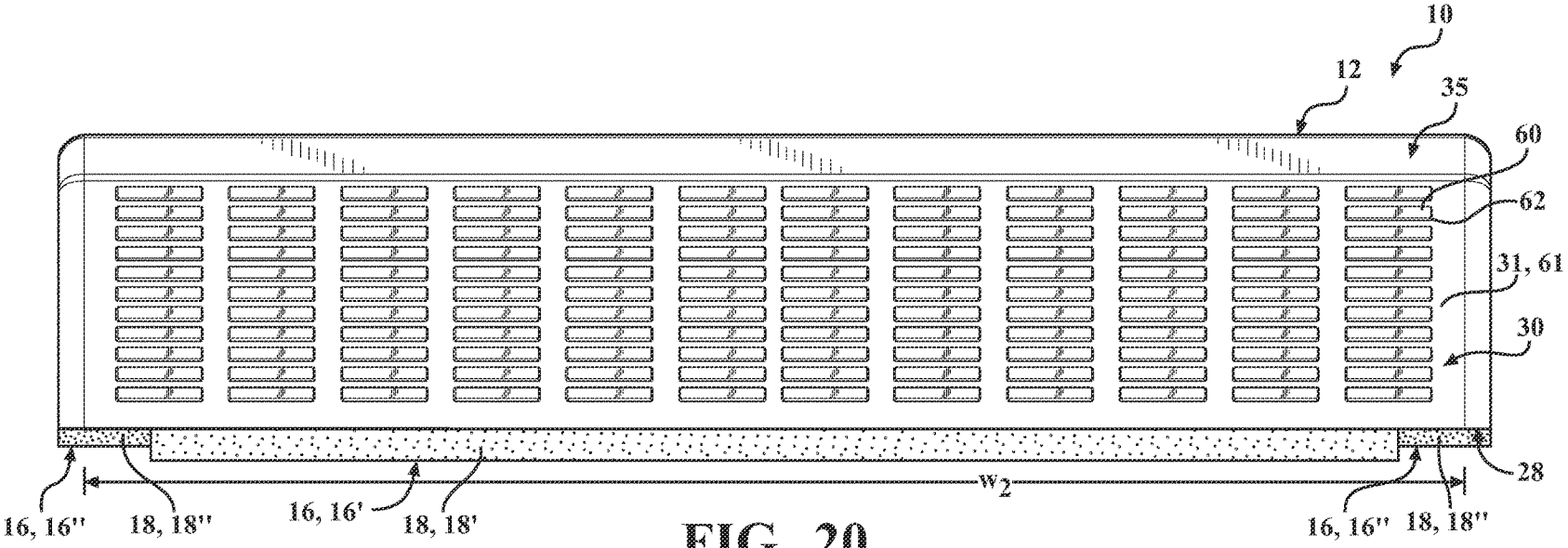
FIG. 20 is a front view of the roofing support system and roof support of FIG. 15.
Figure 21:
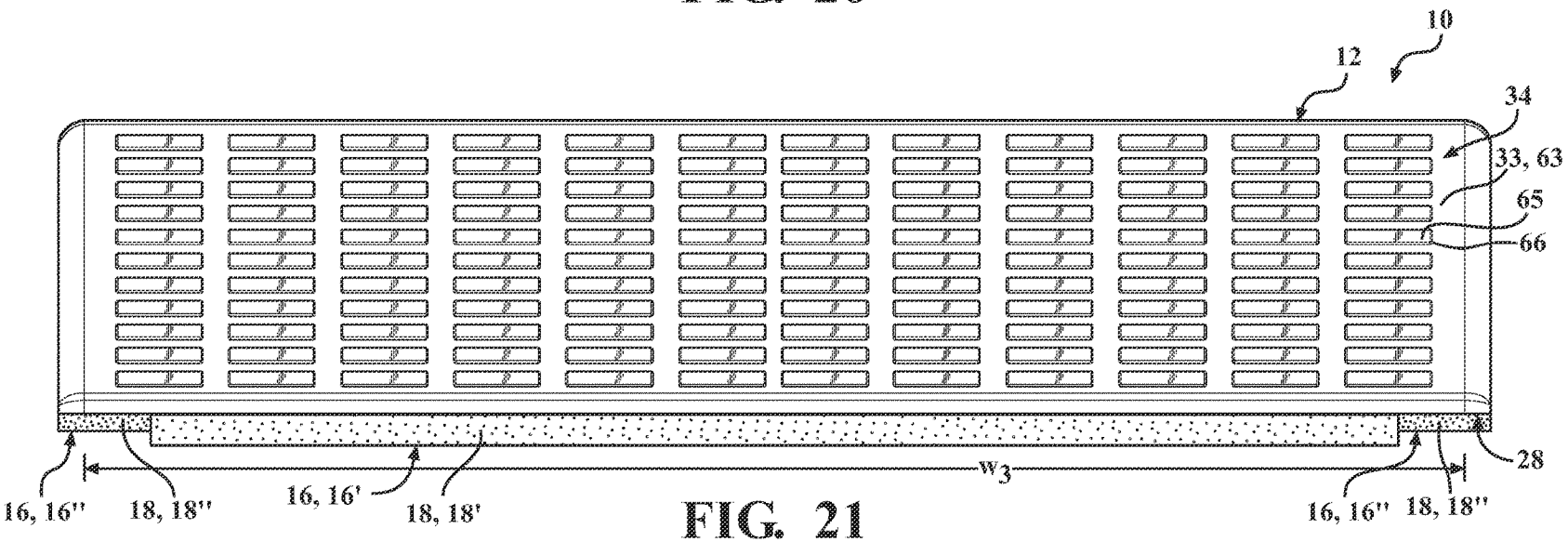
FIG. 21 is a rear view of the roofing support system and roof support of FIG. 15.

As illustrated, for example, in FIGS. 1-14 and 47-51, in one embodiment, the lightweight composite roofing support system 10 includes a longitudinally-extending core member 12 comprising a dual or double-wedge lateral cross-section 22 shape, more particularly a reversible, dual or double-wedge cross-section 22 shape having different acute wedge angles ($\alpha$, $\beta$) that comprises two opposed wedges 11, 13 in an opposed dual or double-wedge lateral cross-section 22 shape configuration having different acute wedge angles with the thin edges of the opposed wedges 11, 13 facing outwardly. The dual or double-wedge lateral cross-section 22 shape may be understood from the end views as shown, for example, in FIGS. 4 and 5 and the cross-sectional view of FIG. 9B. The thin edges of the wedges 11, 13 need not taper to a sharp edge or line as in a traditional wedge, but rather may taper to blunted or rounded edges or shoulders, such as longitudinally-extending first edge 24 and a longitudinally-extending second edge 26 as shown in FIGS. 1, 4 and 5, for example. The blunted or rounded edges or shoulders are advantageous because they are damage-resistant and less susceptible to damage during use by chipping or breaking off while being used by roofing workers 6 on a sloped roof 36 in the manner described herein or when being transported or stored off-roof together with other roofing equipment and/or materials as is typical in the roofing industry.

In one embodiment, the longitudinally-extending core member 12 comprises a longitudinally-extending first roof contact side 28 or roof facing side 28. The first roof contact side 28 or roof facing side of the core member is the side of the core member that is oriented to directly or indirectly contact or face the sloped or pitched roof 36 or whatever other surface the lightweight composite roofing support system 10 is to be placed on. While the core member 12 itself is not generally placed in direct contact with the roof surface or other contact surface, although in some configurations it could be, the term first roof contact side 28 or roof facing side refers to the orientation of this side toward or closest to the sloped or pitched roof 36, or whatever other surface the lightweight composite roofing support system 10 is to be placed on. The first roof contact side 28 is configured to receive the cover layer 16 made from a cover material 18 that also faces and is in direct contact with the sloped or pitched roof 36. The roof contact side 28 is generally rectangular or rounded rectangular and comprises a longitudinally-extending first edge 24 and an opposed longitudinally-extending second edge 26 and has a first width ($w_1$) and a first length ($l_1$) that is greater than the first width. In one embodiment, the first roof contact side 28 has a generally flat planar shape. In one embodiment, the longitudinally-extending first roof contact side includes a first slot opening 40 comprising a first slot or pocket 41 that is defined by the first inner slot wall 42 and a first recess lip 43 that protrudes inwardly toward the longitudinally axis 9 and extends around the periphery of the first recess 45 that is formed in the first end 46 of the longitudinally-extending core member 12. The first recess lip 43 may be spaced apart from the first inner slot wall 42 by any suitable spacing (d1), which in one embodiment is 0.5-2.0 inches, more particularly 0.75-1.25 inches. The first recess lip 43 protrudes inwardly from the first slot base 47, and may protrude inwardly any suitable height ($h_1$), which in one embodiment is 0.3-1.0 inches, and more particularly 0.4-0.75 inches, and have any suitable thickness ($t_1$) measured from the first end 46 and the first outer slot wall 49, which in one embodiment is 0.3-1.0 inches, and more particularly 0.4-0.75 inches. The first slot base 47 also extends around the periphery of the first recess 45. The first slot or pocket 41 and first recess lip 43 define a first handle or grip 48 that may be gripped by a hand of a roofing worker 6, for example, for carrying or movement of the roof support 32. In one embodiment, the longitudinally-extending first roof contact side includes an opposed second slot opening 50 proximate the opposed second end 56 that may comprise a mirror image of the first slot opening 40. The opposed second slot opening 50 comprising a second slot or pocket 51 that is defined by the second inner slot wall 52 and a second recess lip 53 that protrudes inwardly toward the longitudinally axis 9 and extends around the periphery of the second grip recess 55 that is formed in the second end 56 of the longitudinally-extending core member 12. The second recess lip 53 and second outer slot wall 59 may be spaced apart from the second inner slot wall 52 by any suitable spacing ($d_2$), which in one embodiment is 0.5-2.0 inches, more particularly 0.75-1.25 inches. The second recess lip 53 protrudes inwardly from the second slot base 57, and may protrude inwardly any suitable height ($h_2$), which in one embodiment is 0.3-1.0 inches, and more particularly 0.4-0.75 inches, and have any suitable thickness ($t_2$) measured from the second end 56 and the second outer slot wall 59, which in one embodiment is 0.3-1.0 inches, and more particularly 0.4-0.75 inches. The second slot base 57 also extends around the periphery of the second handle or grip recess 55. The second slot or pocket 51 and second recess lip 53 define a second handle or grip 58 that may be gripped by the hand of a roofing worker 6, for example, for carrying or movement of the roof support 32.

Figure 47:
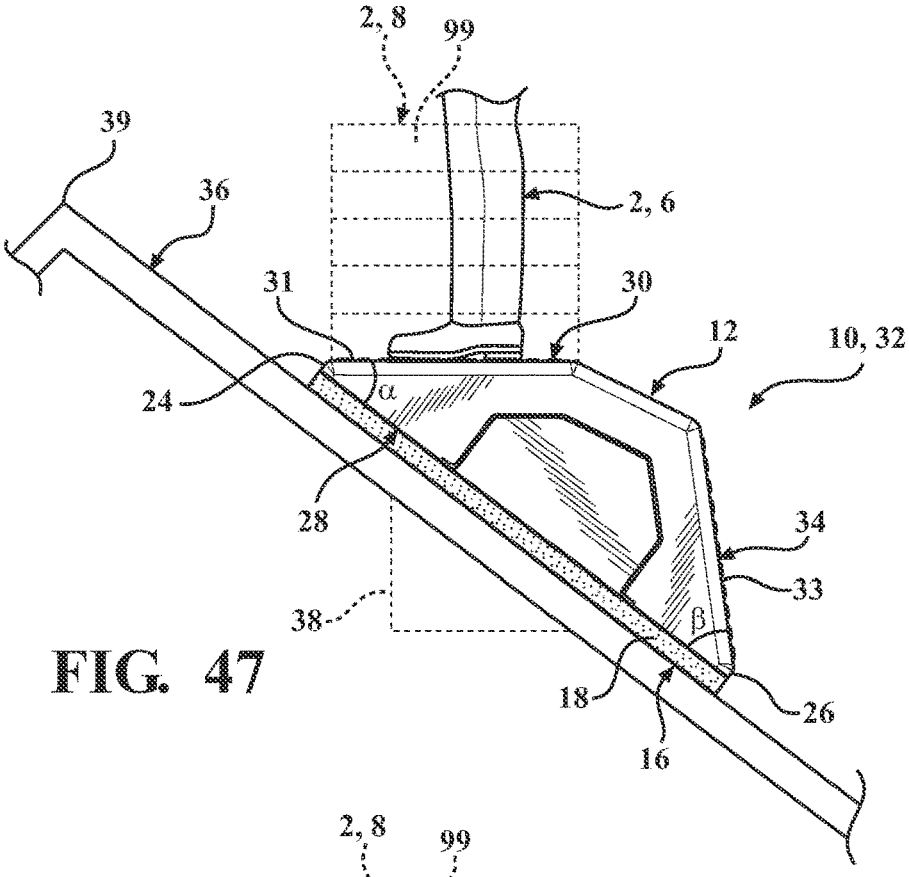
FIG. 47 is a schematic side view of a roofing support system and roof support as described herein (e.g., FIG. 8) in use on a first sloped roof with a first roof pitch and the second side and second working surface facing upslope and providing a horizontal or substantially horizontal second working surface and a portable platform for support of a roofing working or roofing load.
Figure 48:
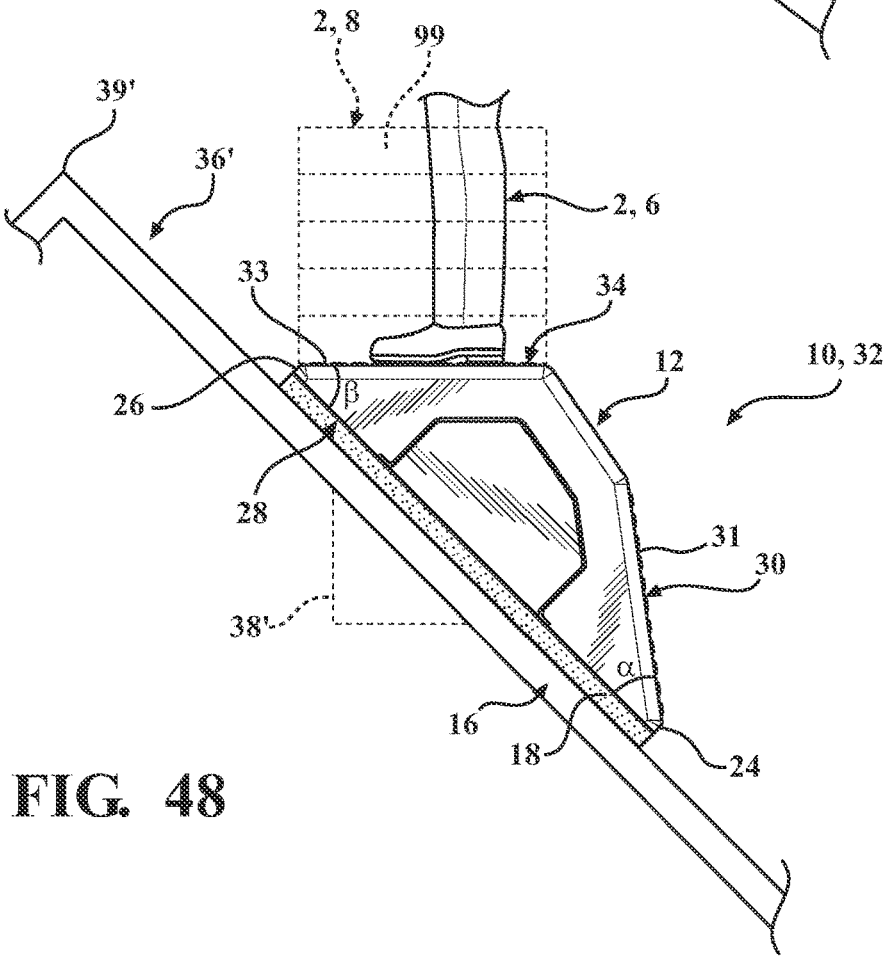
FIG. 48 is a schematic side view of a roofing support system and roof support as described herein (e.g., FIG. 8) in use on a second sloped roof with a second roof pitch and the third side and third working surface facing upslope and providing a horizontal or substantially horizontal third working surface and a portable platform for support of a roofing working or roofing load.

The longitudinally-extending core member 12 also comprises a longitudinally-extending second side 30 comprising a second side working surface 31 having a second width ($w_2$) and a second length ($l_2$) that is greater than the second width, and tapering toward the longitudinally-extending first edge 24 at a first predetermined acute angle ($\alpha$) from the first roof contact side 28. The longitudinally-extending first side 28 and the longitudinally-extending second side 30 taper toward one another at the longitudinally-extending first edge 24. The longitudinally-extending second side 30 may also be referred to as the second load-bearing side 30 and is configured to receive and support the roofing load 2 depending on the orientation of the lightweight composite roofing support system 10 on the roof 36 and which of the longitudinally-extending second side 30 or longitudinally-extending third side 34 is oriented upslope as shown in FIGS. 47 and 48. The longitudinally-extending second side 30 comprising a second side working surface 31 is a generally flat, planar, continuous surface, that is configured for use as described herein by a roofing worker, and in a preferred embodiment will not include any raised or recesses features or other surface discontinuities, other than non-skid or traction elements described herein, that would be recognized by those of ordinary skill in the roofing arts as a potential safety hazard, such as a potential stumbling or tripping hazard to a roofing worker.

The longitudinally-extending core member 12 also comprises a longitudinally-extending third side 34 comprising a third side working surface 33 having a third width ($w_3$) and a third length ($l_3$) that is greater than the third width, and tapering toward the longitudinally-extending second edge 26 at a second predetermined acute angle ($\beta$) from the longitudinally-extending first roof contact side 28. The longitudinally-extending third side 34 may also be referred to as the third load-bearing side 34 and is also configured to alternately receive and support the roofing load 2 depending on the orientation of the lightweight composite roofing support system 10 on the roof 36 and which of the longitudinally-extending second side 30 or longitudinally-extending third side 34 is oriented upslope as shown in FIGS. 47 and 48. The longitudinally-extending third side 34 comprising a second side working surface 33 is a generally flat, planar, continuous surface, that is configured for use as described herein by a roofing worker, and in a preferred embodiment will not include any raised or recesses features or other surface discontinuities, other than non-skid or traction elements described herein, that would be recognized by those of ordinary skill in the roofing arts as a potential safety hazard, such as a potential stumbling or tripping hazard to a roofing worker.

Figure 50:
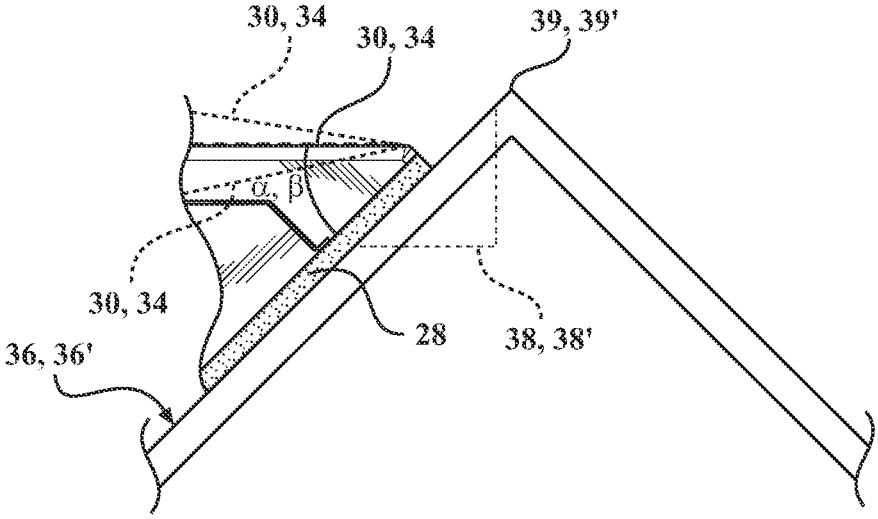
FIG. 50 is a schematic illustration of a roofing support system and roof support as disclosed herein illustrating that the second side or third side may be oriented on sloped roofs with a plurality of roof pitches to provide a horizontal or substantially horizontal working surface on these sloped roofs.

In one embodiment, as illustrated in FIG. 47, in a first configuration or orientation where the longitudinally-extending first edge 24 is defined by the intersection of the longitudinally-extending first side 28 and longitudinally-extending second side 30 and the predetermined first acute angle ($\alpha$) between these sides is configured for placement facing up-roof closest to the peak 39 or apex of the sloped roof 36 with the longitudinally-extending first roof contact side 28 facing and cover layer 16 in pressing contact against the sloped roof 36 and the longitudinally-extending first edge 24 substantially parallel or parallel to the peak. In this configuration, the predetermined first acute angle ($\alpha$) may be selected to be the same as a common first roof angle or pitch 38 (e.g., a 10/12 pitch) of the sloped roof 36, which in the case of a 10/12 pitch (39.81°) roof 36 means that the predetermined first angle ($\alpha$) is also 39.81°, so that the second side 30 extends in the direction of the first peak 39 as a substantially horizontal or horizontal first platform, which advantageously provides a very useful substantially level or level longitudinally-extending second side working surface 31 on the sloped roof 36 for use as described herein. As used herein, substantially parallel includes minor misorientations of the longitudinally-extending first edge 24 with the line defined by the first peak 39 such that they are non-parallel, and the longitudinally-extending second side 30 is not level, but rather substantially level although it may be slightly inclining or declining as compared to the first peak 39 of the first sloped roof 36. One of ordinary skill in the roofing arts will understand that substantially parallel orientations still provide a very advantageous and useful longitudinally-extending second side working surface 31 of longitudinally-extending second side 30 as compared to the alternative of using the steeply first pitched roof 36 as the working surface. One of ordinary skill in the roofing arts will also understand that the orientation with the longitudinally-extending first edge 24 at the intersection of longitudinally-extending first side 28 and longitudinally-extending second side 30 and defining predetermined first acute angle (α) is placed facing up-roof closest to the peak 39, and substantially parallel or parallel to the peak, that the lightweight composite roofing support system 10 also provides a very advantageous and useful longitudinally-extending second side working surface 31 (i.e. second side 30) for first sloped or pitched roofs 36 with a range of similar roof pitches that are greater than and less than the predetermined first acute angle (α) and the first predetermined roof angle or pitch 38 (e.g. a 10/12 pitch) as illustrated schematically in FIG. 50. In one embodiment, where the predetermined first acute angle (α) is 39.81° corresponding to a 10/12 first predetermined roof angle or pitch 38, the range of similar roof pitches may comprise a range of 14/12 to 7/12 (excluding 10/12), or more particularly 12/12 to 8/12 (excluding 10/12), even though the longitudinally-extending second side working surface 31 of second side 30 is only substantially horizontal, not completely horizontal, or level on these roofs. This is because the slight inward or outward slope of the second side working surface 31 of longitudinally-extending second side 30 over this range of similar roof pitches is still very advantageous and much preferred compared to working without the lightweight composite roof support system 10 and using the actual roof surfaces of these steeply pitched roofs 36 as the working surface to support roofing loads 2, particularly in the case of roofing workers 6 trying to move, walk, stand, crouch, kneel, sit, or lie on, or to stack, place or otherwise stage or store roofing materials 8 or equipment on, the sloped roof 36 as shown in FIG. 50. In one embodiment, the second side working surface 31 comprises a second side non-skid surface 61 over all, or a portion or portions, of the second side working surface 31. In one embodiment, the second side non-skid surface 61 comprises a second side surface texture or surface roughness, or a predetermined second side pattern, such as an embossed pattern. The second side non-skid surface 61 may be formed by adding a non-skid material after molding, or integrating a non-skid material or materials to the second side working surface 31 during molding, to provide a second side surface texture or pattern, or may be integrally formed in the core material of the second side working surface 31 by molding the same into the surface as an embossed pattern, for example. In one embodiment, the second side working surface 31 comprises a second side non-skid surface 61 comprising a plurality of integrally formed second side protrusions 60 projecting upwardly from the second side working surface 31 as second side traction elements 62. The protrusions may have any suitable shape or profile as viewed from above, including various circular, rectangular, chevron, herringbone, or whorl shapes. In one embodiment, the second side protrusions 60 have a protruding rectangular shape and are disposed in an array or pattern comprising a plurality of spaced apart columns and rows and comprise a plurality of second side traction bars or elements 62.

As illustrated in FIGS. 47 and 48, in one embodiment the lightweight composite roofing support system 10 is also reversible and configured for an alternate use in a second configuration or orientation on another sloped roof or sloped roofs 36' having a second predetermined roof pitch 38', or range of pitches, that is different from the first predetermined roof pitch 38 or range of pitches. Alternately, in this embodiment, as will easily be understood by one of ordinary skill both from FIGS. 1-14 and 47-50, the second configuration or orientation (FIG. 48) of lightweight composite roofing support system 10 may be reversed, rotated or otherwise changed by 180° from the first orientation (FIG. 47) so that predetermined second acute angle (β) is placed facing up-roof closest to the second peak 39' or apex of another or second steeply pitched roof 36' or roofs having a second predetermined roof pitch 38', or range of pitches, that is different than the first predetermined roof pitch 38. In the second configuration or orientation, the longitudinally-extending second edge 26 is defined by the intersection of the longitudinally-extending third side 34 and the longitudinally-extending first roof contact side 28 and the predetermined second acute angle (β) between these sides is configured for placement facing up-roof closest to the second peak 39' or apex of the second sloped roof 36' with the longitudinally-extending first side 28 facing and cover layer 16 in pressing contact against the sloped roof 16 and the longitudinally-extending second edge 26 substantially parallel or parallel to the peak. In this configuration, the predetermined second acute angle (β) may be selected to be the same as a second predetermined roof angle or pitch 38' (e.g., a 12/12 pitch) of the sloped roof 36, which in the case of a 12/12 pitch (45°) roof 36 means that the predetermined second acute angle (β) is also 45°, so that the longitudinally-extending third side 34 extends in the direction of the second peak 39' as a substantially horizontal or horizontal second platform, which advantageously provides a very useful substantially level or level longitudinally-extending third side working surface 33 on the second sloped roof 36' for use as described herein. As used herein, substantially parallel includes minor misorientations of the longitudinally-extending second edge 26 with the line defined by the second peak 39' such that they are non-parallel, and third side 34 is not level, but rather substantially level although it may be slightly inclining or declining as compared to the second peak 39' of the second steeply sloped roof 36'. One of ordinary skill in the roofing arts will understand that substantially parallel orientations still provide a very advantageous and useful longitudinally-extending third side working surface 33 of longitudinally-extending third side 34 as compared to the alternative of using the second steeply pitched roof 36' as the working surface. One of ordinary skill in the roofing arts will also understand that the orientation with the longitudinally-extending second edge 26 at the intersection of longitudinally-extending third side 34 and longitudinally-extending first side 28 and defining predetermined second acute angle (β) is placed facing up-roof closest to the peak 39, and substantially parallel or parallel to the peak, that the lightweight composite roofing support system 10 also provides a very advantageous and useful longitudinally-extending third side working surface 33 (i.e. third side 34) for second sloped or pitched roofs 36' with a range of similar roof pitches that are greater than and less than the predetermined second acute angle (β) and the second predetermined roof angle or pitch 38' (e.g. a 12/12 pitch). In one embodiment, where the predetermined second acute angle (β) is 45° corresponding to a 12/12 second predetermined roof angle or pitch 38', the range of similar roof pitches may comprise a range of 16/12 to 9/12 (excluding 12/12), or more particularly 14/12 to 10/12 (excluding 12/12), even though the longitudinally-extending third side working surface 33 of longitudinally-extending third side 34 is only substantially horizontal, not completely horizontal, or level on these roofs. This is because the slight inward or outward slope of the third side working surface 33 of the longitudinally-extending third side 34 for these roof pitches is still very advantageous and much preferred compared to working without the roof support system and using the roof surfaces of these steeply pitched roofs 36' as the working surface to support roofing loads 2, particularly in the case of roofing workers 6 trying to move, walk, stand, crouch, kneel, or sit on the roof as shown in FIG. 50. In one embodiment, the third side working surface 33 comprises a third side non-skid surface 63 over all, or a portion or portions, of the third side working surface 33. In one embodiment, the third side non-skid surface 63 comprises a third side surface texture or surface roughness, or a predetermined third side pattern, such as an embossed pattern, which may the same or different than the second side non-skid surface 61. The third side non-skid surface 63 may be formed by adding a non-skid material after molding, or integrating a non-skid material or materials to the third side working surface 33 during molding, to provide a third side surface texture or pattern, or may be integrally formed in the core material 14 of the third side working surface 33 by molding the same into the surface as an embossed pattern. In one embodiment, the third side working surface 33 comprises a third side non-skid surface 63 comprising a plurality of integrally formed third side protrusions 65 projecting upwardly from the third side working surface 33 as third side traction elements 66. The protrusions may have any suitable shape or profile as viewed from above, including various circular, rectangular, chevron, herringbone, or whorl shapes. In one embodiment, the third side protrusions 65 have a protruding rectangular shape and are disposed in an array or pattern comprising a plurality of spaced apart columns and rows and comprise a plurality of third side traction bars or elements 66.

In one embodiment, even though the second side working surface 31 may incorporate first non-skid surface 61 that may include traction elements 62 and third side working surfaces 33 may incorporate second non-skid surface 63 that may include traction elements 66, these working surfaces are generally planar and only include features that enhance the working surface for use by a roofing worker 6 (e.g., enhance traction or provide a non-skid surface), including the ability to move, walk, stand, crouch, kneel, sit, or lie on the surface safely, and will not include raised elements or features that protrude above the non-skid surface 63 or traction elements 66, such as raised trays or raised edges, or alternately recessed features, such as recessed trays or recessed features, that would make these surfaces non-planar and that one of ordinary skill in the art would understand to represent potential tripping or loss-of-balance hazards or otherwise comprise a safety hazard, since it is understood that the steeply sloped roofs 36 where lightweight composite roofing support system 10 are particularly advantageous require the avoidance and/or elimination of all such hazards.

Figure 49:
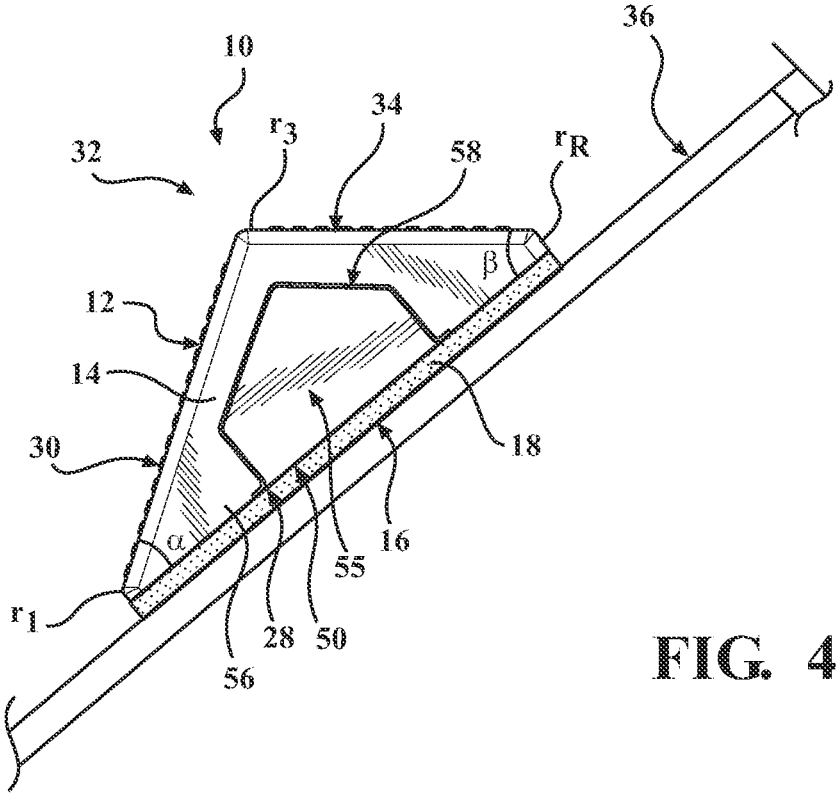
FIG. 49 is a side view of an embodiment of a roofing support system and roof support as disclosed herein illustrating an embodiment of a core member with an acute rounded triangular cross-section shape on a sloped roof with a roof pitch and the third side and third working surface facing upslope and providing a horizontal or substantially horizontal third working surface and a portable platform for support of a roofing working or roofing load.

In one embodiment the longitudinally-extending core member 12 comprises a dual or double-wedge lateral cross-section 22 shape that is substantially uniform or the same along the longitudinal axis 9, and in other embodiments that is substantially uniform or the same along the longitudinal axis except in the regions proximate the opposed first end 46 and second end 56, which include first slot opening 40 and first handle or grip recess 45 and second slot opening 50 and second handle or grip recess 55, respectively (e.g., FIGS. 1-14). In one embodiment, the dual or double-wedge lateral cross-section 22 comprises a scalene triangular cross-section shape that is substantially uniform or uniform along the longitudinal axis 9, and in other embodiments is a scalene triangle that is substantially uniform or uniform along the longitudinal axis except in the regions proximate the opposed ends, such as second end 56 (e.g. FIG. 49), which, for example, includes second slot opening 50 and second handle or grip recess 55, and has identical end features to those shown in FIGS. 1-14. The longitudinally-extending first roof contact side 28 is the hypotenuse of the scalene triangular cross-section shape and the shorter sides of the scalene triangle comprise the of the longitudinally-extending second side 30 and longitudinally-extending third side 34 as shown in FIG. 49.

In another embodiment, the lateral cross-section 22 comprises an irregular convex quadrilateral shape and/or trapezium shape (where none of the sides are of equal length) and/or a truncated scalene triangle (that is truncated proximate what would otherwise be the obtuse angle of the scalene triangle) that is substantially uniform or the same size along the longitudinal axis, and in other embodiments is substantially uniform or the same along the longitudinal axis except in the regions proximate the opposed first end 46 and second end 56, which include first slot opening 40 and first handle or grip recess 45 and second slot opening 50 and second handle or grip recess 55, respectively (e.g., FIGS. 1-14). The longest side of the irregular convex quadrilateral and/or trapezium and/or truncated scalene triangle comprises the longitudinally-extending first roof contact side 28, and the sides adjacent to the longitudinally-extending first side 28 comprise the longitudinally-extending second side 30, and longitudinally-extending third side 34. The irregular convex quadrilateral and/or trapezium and/or truncated scalene triangle also comprises a fourth side 35 as shown in FIGS. 1-14. In this embodiment, where the lateral cross-section 22 comprises an irregular convex quadrilateral and/or trapezium and/or truncated scalene triangle the longitudinally-extending fourth side 35 is not parallel to the longitudinally-extending first side 28. The longitudinally-extending fourth side 35 is generally not a working surface because of the rather extreme slope (e.g., FIGS. 47, 48), but rather a transition surface that extends between the second side 30 and the third side 34. However, in one embodiment, the fourth side 35 may optionally include a plurality of optional recesses or pockets 60 (e.g., FIG. 1) formed therein that may be used to temporarily hold and/or store any predetermined item, including various construction or roofing materials or equipment described herein, such as replacement nails for a nailing gun, for example. In one embodiment illustrated schematically in FIGS. 4 and 5, the dual or double-wedge lateral cross-section 22 shape may comprise a scalene trapezoidal shape and the longitudinally-extending fourth side 35' is parallel to the longitudinally-extending first side 28. While useful, a scalene trapezoidal lateral cross-section 22 generally reduces the width ($w_2$ or $w_3$) of the second side 30 or third side 34 and the respective size of the second side working surface 31 or third side working surface 33 as may be understood in FIGS. 4 and 5.

The longitudinally-extending core member 12 may have any suitable configuration and any suitable size. In one embodiment, the longitudinally-extending core member 12 has an integral one-piece configuration, which may be produced by molding or forming the core material 14 into the shape of the core member as illustrated in FIGS. 1-14, for example. While the size of the core member 12 may be characterized with regard to any of the sides thereof, in one embodiment, it is characterized by the size of the longitudinally-extending first contact side 28. The longitudinally-extending first contact side 28 may comprise any suitable length ($l_1$) and width ($w_1$). In one embodiment, the size may comprise a length ($l_1$) that ranges from 20 to 144 inches, more particularly 24 to 72 inches, even more particularly 24 to 48 inches, and yet more particularly 24-36 inches. In one embodiment, the size may comprise a width ($w_1$) that ranges from 18 to 48 inches, more particularly 20 to 40 inches, even more particularly 20 to 30 inches, and yet more particularly 22-28 inches. In one embodiment, the length ($l_1$) is greater than the width ($w_1$). In one embodiment, the second side length ($l_2$) and third side length ($l_3$) are the same as the first roof contact side length ($l_1$), the second side width ($w_2$) and third side width ($w_3$) will scale geometrically with the first roof contact side width ($w_1$) and the selection of acute angles ($\alpha$) and ($\beta$) together with the position, including width ($w_4$) and angulation from horizontal of longitudinally extending fourth 35. In one embodiment, the length ($l_1$) ranges from 24-48 inches, the width ($w_1$) ranges from 17-36 inches, the second side length ($l_2$) and third side length ($l_3$) are the same as the first roof contact side length ($l_1$), the second side width ($w_2$) ranges from 8-18 inches, $\alpha$=39.81° (e.g., an 10/12 pitch), the third side width ($w_3$) ranges from 8-18 inches, and $\beta$=45° (e.g., a 12/12 pitch).

The longitudinally-extending core member may be formed from any suitable core material 14, including various metals, engineering thermoplastic or thermoset polymers, or composites thereof. In one embodiment, the core material 14 comprises a rigid or substantially rigid engineering thermoplastic or thermoset polymer. In one embodiment, the core material 14 comprises a rigid or substantially rigid engineering thermoplastic or thermoset polymer comprising polystyrene (PS), polyethylene (PE), polypropylene (PP), polyurethane (PU), or ethylene-vinyl acetate (EVA), or a combination thereof, and more particularly an expanded foam comprising polystyrene (EPS), polyethylene (EPE), polypropylene (EPP), polyurethane (EPU), or ethylene-vinyl acetate (EEVA), or a combination thereof, which, as used herein, includes chemical or physical combinations thereof, including copolymers thereof. In one embodiment, the core material 14 comprises a rigid or substantially rigid expanded foam of EPP having the properties set forth in FIG. 52, or another expanded polymer foam having properties within the ranges set forth in FIG. 52, more particularly a density, compressive strength, compression set, tensile strength, and flexural strength within the ranges set forth in FIG. 52. In one embodiment, the expanded foam comprises EPP or EEVA comprising a density of 1.25-12 lb./ft$^3$, and more particularly 2-8 lb./ft$^3$, and more particularly 3-7 lb./ft$^3$, and yet more particularly 3-6 lb./ft$^3$. The core member 12 may be molded as an integral or one-piece component to include all of the elements described herein by any suitable molding or forming method, including various conventional molding methods employed to mold rigid or substantially rigid engineering thermoplastic or thermoset polymers, particularly rigid or substantially rigid expanded engineering thermoplastic or thermoset polymer foams, including injection molding. In one embodiment, as used herein, a rigid or substantially rigid core material 14 may be defined by the material properties, particularly a compressive strength, compression set, tensile strength and flexural strength within the ranges set forth in FIG. 52. In another embodiment, as used herein, a rigid or substantially rigid core material may be defined as substantially non-compressible (i.e. experiences only a minor amount of elastic deformation) under a predetermined roofing load 2 (l), including less than 10% elastic deformation under the predetermined roofing load (l), more particularly less than 5% deformation, and even more particularly less than 1% deformation, and includes ranges of 0.1-10% deformation, more particularly 0.1-5% deformation, and even more particularly 0.1-3% deformation. In one embodiment, the predetermined roofing load 2 may include the weight of at least one person, which in one embodiment ranges from 100 to 350 lbs., or the weight of at least one bundle of shingles, which in one embodiment ranges from 40-80 lbs., or the weight of at least one roll of underlayment, which in one embodiment ranges from 16-100 lbs., or a combination thereof. In other embodiments, the predetermined roofing load 2 may include a plurality of the above items.

As illustrated in FIG. 49 in one embodiment, the roofing support system 10 and first roofing support 32 comprises a longitudinally-extending third side 34, and the dual or double-wedge shape lateral cross-section comprises a triangular lateral cross-section, including a generally or substantially scalene triangular lateral cross-section, with the longitudinally-extending third side 34 opposite the first predetermined angle ($\alpha$) formed by the convergence, including the intersection, of the longitudinally-extending third side 34 and the longitudinally-extending second side 30. As used herein, generally or substantially with reference to the cross-sectional shape includes embodiments where the converging sides do not actually intersect to form a vertex, but rather shapes that include one or more blunted edge or radii (e.g., $r_1$, $r_2$, $r_3$ in FIG. 49) in place of the vertices (e.g., a blunted or rounded triangular shape), but where one of ordinary skill would readily recognize a generally or substantially triangular lateral cross-sectional shape or form.

Referring to FIGS. 1-14 and 47-51, particularly FIGS. 8-14, in one embodiment, the lightweight composite roofing support system 10 comprises a longitudinally-extending core member 12 comprising a core material 14 as described herein and a longitudinally-extending resiliently compressible cover layer 16 comprising a resiliently compressible cover material 18 that is disposed on and covering the longitudinally-extending first roof contact side 28. In one embodiment, the longitudinally-extending core member 12 and the longitudinally-extending resiliently compressible cover layer 16 comprise lightweight composite roofing support system 10 and first roofing support 32. As used herein, the term "covering" in the context of the longitudinally-extending cover layer 16 covering the longitudinally-extending first roof contact side 28 comprises covering all or any portion of the longitudinally-extending first roof contact side. The term "covering" includes in certain embodiments covering at least a portion of the longitudinally-extending first roof contact side 28, and in certain other embodiments includes covering all or substantially all of longitudinally-extending first side 28, and in certain other embodiments may extend outwardly beyond the edges of the longitudinally-extending first side 28, such as, for example, extending slightly outwardly of the longitudinally-extending first side 28, including in the corners as shown in FIG. 9A, for example.

The longitudinally-extending resiliently compressible cover layer 16 may comprise any suitable resiliently compressible cover material 18. In one embodiment, the resiliently compressible cover material comprises a resiliently compressible elastomer, including thermoset and thermoplastic elastomers. In one embodiment, the resiliently compressible cover material comprises a resiliently or reversibly compressible polymer, including a resiliently compressible polymer foam, and including a resiliently or reversibly compressible elastomeric foam. The resiliently or reversibly compressible elastomeric foam may include resiliently or reversibly compressible thermoset and/or thermoplastic elastomeric foams, and may include both open-cell and closed-cell foams. In one embodiment, the cover material 18 comprises a resiliently or reversibly compressible polymer, such as a resiliently or reversibly compressible elastomeric foam, and comprises polyurethane (PU), polystyrene (PS), polyisocyanurate (PIR), polyethylene (PE), polypropylene (PP), poly(ethylene-vinyl acetate) (EVA), poly(vinyl chloride) (PVC), or a natural or synthetic rubber, silicone, or a combination thereof which, as used herein, includes chemical or physical combinations thereof, including copolymers thereof. In one embodiment, the polyurethane (PU) foams may include both open-cell and closed-cell polyether polyurethane and polyester polyurethane foams. In one embodiment, the cover material 18 comprises a resiliently or reversibly compressible open-cell polyether polyurethane foam. In one embodiment, the cover material 18 comprises a viscoelastic, low-resilience, foam or memory foam, particularly various polyurethane (PU) memory foams. In one embodiment, the resiliently compressible cover material comprises a resiliently or reversibly compressible foam comprising a flexible foam, particularly a flexible polyurethane foam (FPF). In one embodiment, the cover material 18 comprises a resiliently or reversibly compressible flexible open-cell polyether polyurethane foam (FPF) having properties within the ranges specified in FIG. 53, or other resiliently or reversibly compressible open-cell foam having properties within the ranges specified in FIG. 53.

In one embodiment, the resiliently compressible cover material 18 may be selected as a function of the material comprising the surface of the sloped roof 36. In one embodiment, in the case of sloped roofs comprising asphalt and plastic rolled roofing materials, asphalt or fiberglass shingles, wood (e.g., cedar shakes), which generally have high surface roughness and high abrasiveness, the cover material 18 may comprise a resiliently compressible polymer foam, such as a flexible open-cell polyether polyurethane foam (FPF) as described herein. In another embodiment, in the case of sloped roofs comprising ceramic shingles or tiles, metal sheets, glass sheets, and polymer sheets, which generally have low surface roughness and low abrasiveness, the cover material 18 may comprise a resiliently compressible polymer or polymer foam, such as natural or synthetic rubber and rubber foams, as well as silicone and silicone foams. In another embodiment, in the case of sloped roofs comprising shingles, tiles, sheets, or panels comprising ceramic, metal, glass, and polymer, which generally have low surface roughness and low abrasiveness, the cover material 18 may comprise a resiliently compressible polymer or polymer foam, such as natural or synthetic rubber and rubber foams, as well as silicone and silicone foams. In another embodiment, in the case of sloped roofs comprising shingles, tiles, sheets, or panels comprising ceramic, metal, glass, and polymer, which generally have low surface roughness and low abrasiveness, but which have been formed to include a shape or texture of another material (e.g., glass solar tiles or shingles formed to resemble scalloped ceramic tiles or natural slate tiles, or cedar shakes), the cover material 18 may comprise a resiliently compressible composite such as an upper layer of a resiliently compressible polymer foam as described herein, such as a polyurethane foam, which may be relatively thicker, attached to a lower layer (i.e. roof contact layer) of a resiliently compressible polymer or polymer foam, such as natural or synthetic rubber and rubber foams, as well as silicone and silicone foams, which may be relatively thinner. The composite provides an upper foam to enable conformity to the shape and larger texture features of the roof material (e.g., the shape of a curved or scalloped tile or flat with texture variation like a slate tile) and a lower layer of resiliently compressible polymer or polymer foam, such as natural or synthetic rubber and rubber foams, as well as silicone and silicone foams to ensure adhesion to the surface (e.g., glass).

The resiliently compressible cover layer 16 may comprise any suitable shape and size, including in the embodiment of FIGS. 8-14, substantially the same or the same shape and size (e.g., area) as the longitudinally-extending first roof contact side 28, and in other embodiments (not shown) a different size and shape as described herein. In one embodiment, the resiliently compressible cover layer 16 comprises a rectangular shape, which includes various rounded rectangular shapes, and comprises the same length and width, including the same ranges of length and width, disclosed herein for the longitudinally-extending first roof contact side 28. In one embodiment, the resiliently compressible cover layer 16 covers the first slot opening 40 and the second slot opening 50 in the longitudinally-extending first roof contact side 28. The cover layer 16 may have any suitable thickness. In one embodiment, the resiliently compressible cover layer 16 has a thickness in the range of 0.020 to 2.5 inches, more particularly 0.5 to 1.5 inches, more particularly 0.5 to 1.0 inches.

In the embodiment of FIGS. 1-14, the longitudinally-extending core member 12 extends in the direction of axis 9, and the longitudinally-extending cover layer 16 is configured to be attached to and cover the core member. The longitudinally-extending resiliently compressible cover layer 16 may be attached to longitudinally-extending first roof contact side 28 by any suitable attachment 69 or attachment mechanism, including in one embodiment an adhesive 70 disposed between them to form an adhesive joint 71 as the attachment 69. Any suitable adhesive 70 may be used as the adhesive to form the adhesive joint 71, including those that are configured to provide a physical bond, or a chemical bond, or both, between the longitudinally-extending cover layer 16 and longitudinally-extending first roof contact side 28 layer. In one embodiment, the adhesive 70 comprises a hot-melt adhesive, particularly a formulated hotmelt adhesive that is designed for adhesion to hard-to-adhere substrates that has a medium set speed, high heat resistance, and excellent low temperature bond performance, such as ADH, Hot Melt Adhesive M535-100N.1 sold by Sonoco®. The adhesive 70 may be applied in any suitable conventional manner and method to the upper surface of the longitudinally-extending cover layer 16 and/or to the longitudinally-extending first roof contact side 28 layer, including in one embodiment as a layer that covers the entirety of one or both of these surfaces, and including in another embodiment as a pattern of adhesive applied to one or both of these surfaces as described herein. The longitudinally-extending resiliently compressible cover layer 16 and resiliently compressible cover material 18 may also be molded directly onto the longitudinally-extending core member 12 and core material 14, or vice versa, such as by co-molding where both elements are formed in a single mold, or by insert molding where one of the elements is formed separately and inserted into a mold for molding of the other element onto it, and the attachment comprises an integrally molded joint 71 comprising a physical and/or chemical bond formed at the interface between them, analogous to an integral adhesive joint. The attachment, such as an adhesive joint 71 or chemical bond as an attachment will have an adhesive shear strength that is greater than the shear forces at the interface between the longitudinally-extending cover layer 16 and the longitudinally-extending first roof contact side 28 upon application of a roofing load 2 as described herein.

In one embodiment, the longitudinally-extending core member 12 may be configured to receive a plurality of different longitudinally-extending cover layers 16 and cover layer materials 18. In one embodiment, the longitudinally-extending cover layers 16 and cover materials 18 may be configured to provide adhesion for use of the lightweight composite roofing support system 10 on a plurality of different slope or pitched roof 36 types, including different roof decks comprising different deck materials, such as wood (e.g. OSB, plywood, or cedar shakes), various asphalt and plastic rolled roofing materials, asphalt or fiberglass shingles, plastic/composite/ceramic shingles or tiles, metal sheets, glass sheets, polymer sheets and other conventional roofing materials, as well as the glass surface of various solar shingles and panels.

Figure 51:
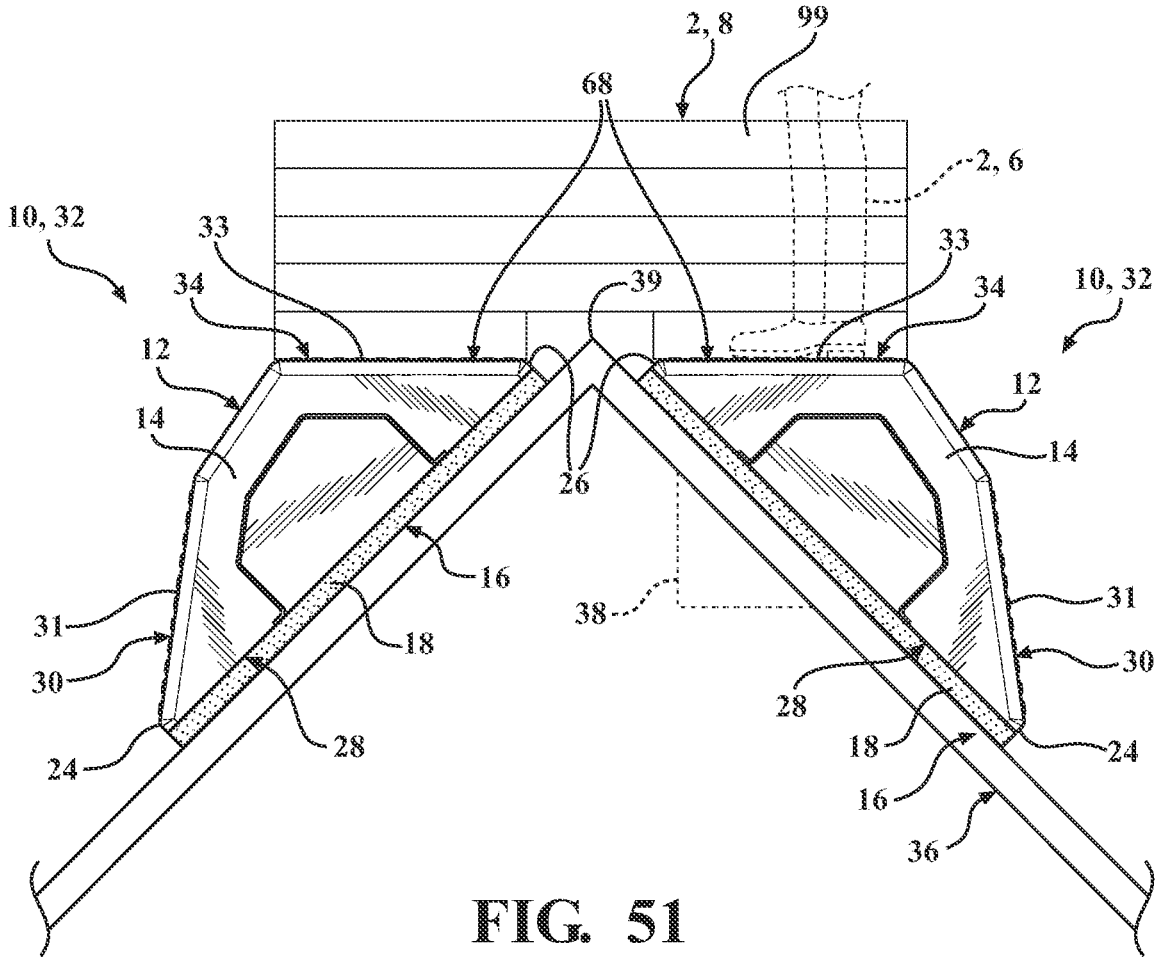
FIG. 51 is a schematic side view of two roofing support systems and roof supports (e.g., FIG. 8) in use on a sloped roof with a roof pitch disposed proximate and on opposing sides of the roof peak with the third sides and third working surfaces facing upslope and providing a horizontal or substantially horizontal third working surfaces and a peak platform for support of a roofing worker or roofing load at the roof peak.

As shown in FIG. 51, in one embodiment the lightweight composite roofing support system 10 further includes a two roofing supports 32 that are substantially identical and may include the features in the embodiments described above. The roofing supports 32 may be positioned on opposite sides of the peak 39 of a sloped roof as mirror images of one another with the longitudinally-extending second edges 26 of the wedges facing one another with their respective longitudinally-extending first roof contact sides 28, longitudinally-extending second sides 30, and longitudinally-extending third sides 34 all facing in the same directions. When placed in the positions shown proximate the peak 39 of a sloped roof 36, the lightweight composite roofing support system 10 comprising a plurality of opposed roofing supports 32 may be very advantageously used to provide a peak platform 68 that may be used by roofing workers 6, or to store the roofing materials 8, as described herein, such as a plurality of bundles 99 of shingles, proximate the roof peak 39. A peak platform 68 is very desirable and advantageous location for storage of roofing materials 8 as they can be easily distributed downslope to roofing workers 6 that are progressively applying these materials upslope generally from the eaves to the peak 39 of a sloped roof 36. A peak platform 68 is also very desirable as it provides a stable platform at the roof peak 39 for vendors of roofing materials 8 to use automated equipment to lift the materials to and unload the materials on the roof peak, without the need to manually unload the materials and make makeshift platforms at the roof peak generally using the construction materials themselves and make makeshifts or temporary platforms (e.g., using bundles of shingles), so that the roofing materials are available for distribution downslope during the construction of the sloped roof.

In one embodiment, the pressing engagement of the longitudinally-extending first side 28 and the attached longitudinally-extending cover layer 16 is sufficient to secure or attach the lightweight composite roofing support system 10 to the sloped roof 36 and prevent the system and a roofing load 2 (once applied) from sliding down the sloped roof 36 without the use of fasteners.

Referring to FIGS. 15-21, in one embodiment, the lightweight composite roofing support system 10 comprises a longitudinally-extending core member 12 as described herein and resiliently compressible cover layer 16 comprises a plurality of resiliently compressible cover layers 16 of resiliently compressible cover materials 18, which may be the same cover material 18 differing in some aspect, such as a material property or characteristic (e.g., thickness, density, or the like), or different cover materials 18. While described with reference to FIGS. 15-21, this embodiment of cover layers 16 and cover materials 18 may be used in any of the embodiments of lightweight composite roofing support system 10 described herein in FIGS. 1-53. A plurality of resiliently compressible cover layers 16 and resiliently compressible cover materials 18 may be employed, for example, to provide variable or different material properties at different locations on longitudinally-extending first roof contact side 28. For example, during construction, the surface of sloped roofs 16 may be very abrasive, from the innermost portion comprising a plywood and/or OSB roof deck to the outermost portion comprising asphalt or fiberglass shingles, and it may be desirable to employ a different resiliently compressible cover material 18 in the higher wear areas of the cover layer 16, such as the areas proximate the laterally-extending first end 46 and/or opposed second end 56, or along all or a portion of the longitudinally-extending first edge 24 and/or the longitudinally-extending second edge 26, since the edges associated with these locations may experience more abrasion and wear as the roof supports 32 are moved (e.g. lifted up and down, dragged, tossed, thrown, slid, scraped, etc.) because they frequently are the last point of prior contact and the first point of new contact or impact during a move. Any of the resiliently compressible cover materials 18 described herein may be used to provide a plurality of resiliently compressible cover layers 16 of resiliently compressible cover materials 18. Thus, for example, in one embodiment, it is desirable to place one resiliently compressible cover layer 16 of resiliently compressible cover material 18 with higher wear resistance in the locations that are subject to higher wear (e.g., high wear areas), and another resiliently compressible cover layer 16 of resiliently compressible cover material 18 at other locations that are subject to lower wear (e.g., low wear areas). In one embodiment, for example, the cover layer 16 comprises a plurality of resiliently compressible cover layers 16 comprising a first resiliently compressible cover layer 16' comprising a first resiliently compressible cover material disposed in a central portion of the first roof contact side and second resiliently compressible cover layers 16" comprising second resiliently compressible cover materials 18" disposed proximate the first end 46 and the opposed second end 56 that are different from the first resiliently compressible cover material 18'. The difference in the first and second cover layers 16', 16" and first and second cover materials 18', 18" may be any measurable difference in the cover materials, including the density, the thickness, the wear resistance, the coefficient of sliding friction on the roof deck material, the cell type (e.g., closed-cell, and open-cell), the cell size or porosity, a physical property (e.g., elastic modulus, tensile strength, compressive strength, compression set, indentation force deflection (IFD), flex fatigue, tear resistance, or the like). In one embodiment, the first resiliently compressible cover layer 16' comprising the first resiliently compressible cover material 18' has a first thickness and comprises polyurethane (PU) and the second resiliently compressible cover layers 16" and second resiliently compressible cover materials 18" have a second thickness ($t_2$) that is less than or equal to the first thickness and comprises polyurethane (PU), poly(ethylene-vinyl) acetate (EVA), natural rubber, or synthetic rubber, or a combination thereof.

Figure 22:
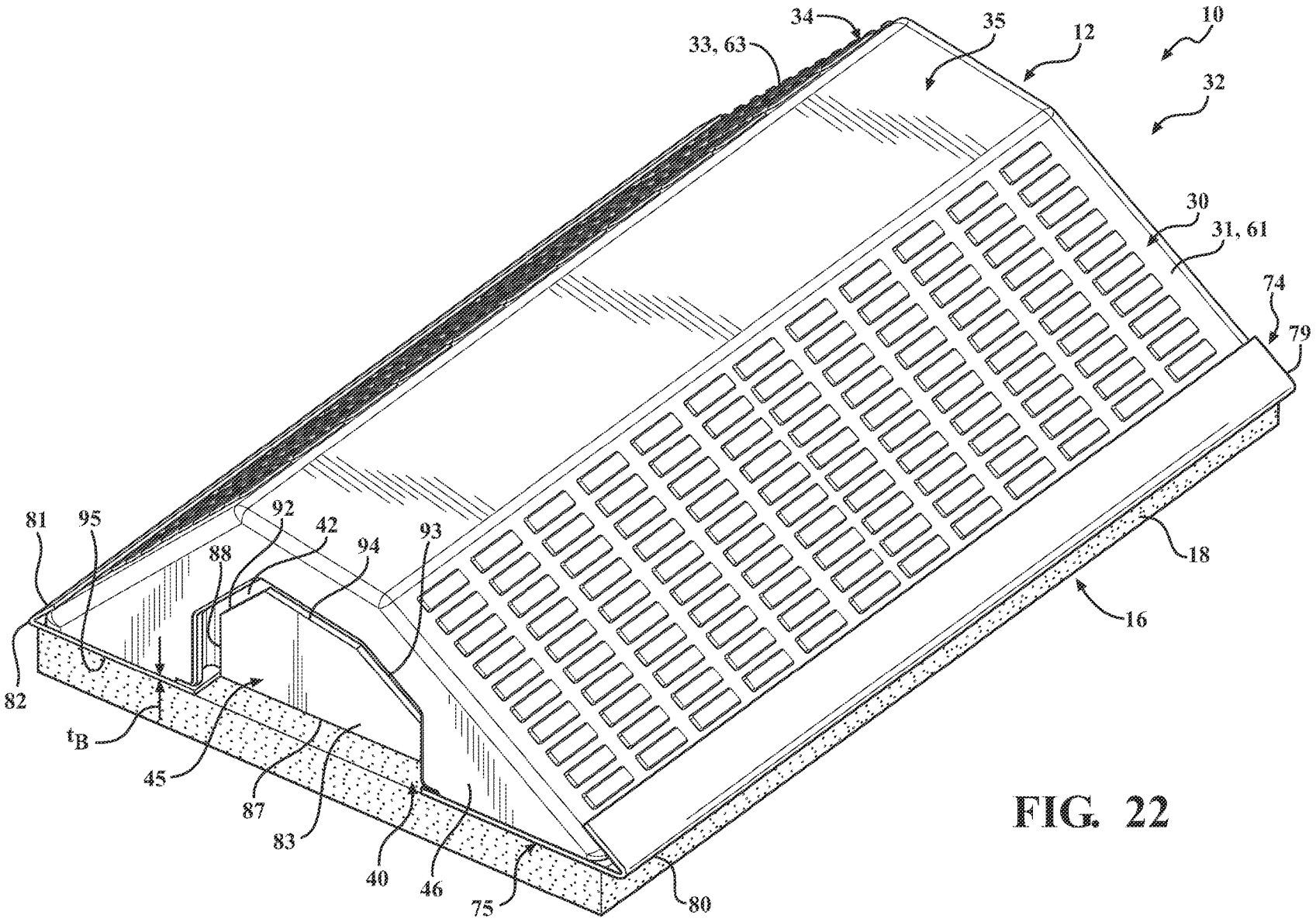
FIG. 22 is a perspective view of another embodiment of a roofing support system and roof support as disclosed herein illustrating a core member, selectively attachable/detachable base, and resiliently compressible cover layer attached to the base as described herein.
Figure 23:
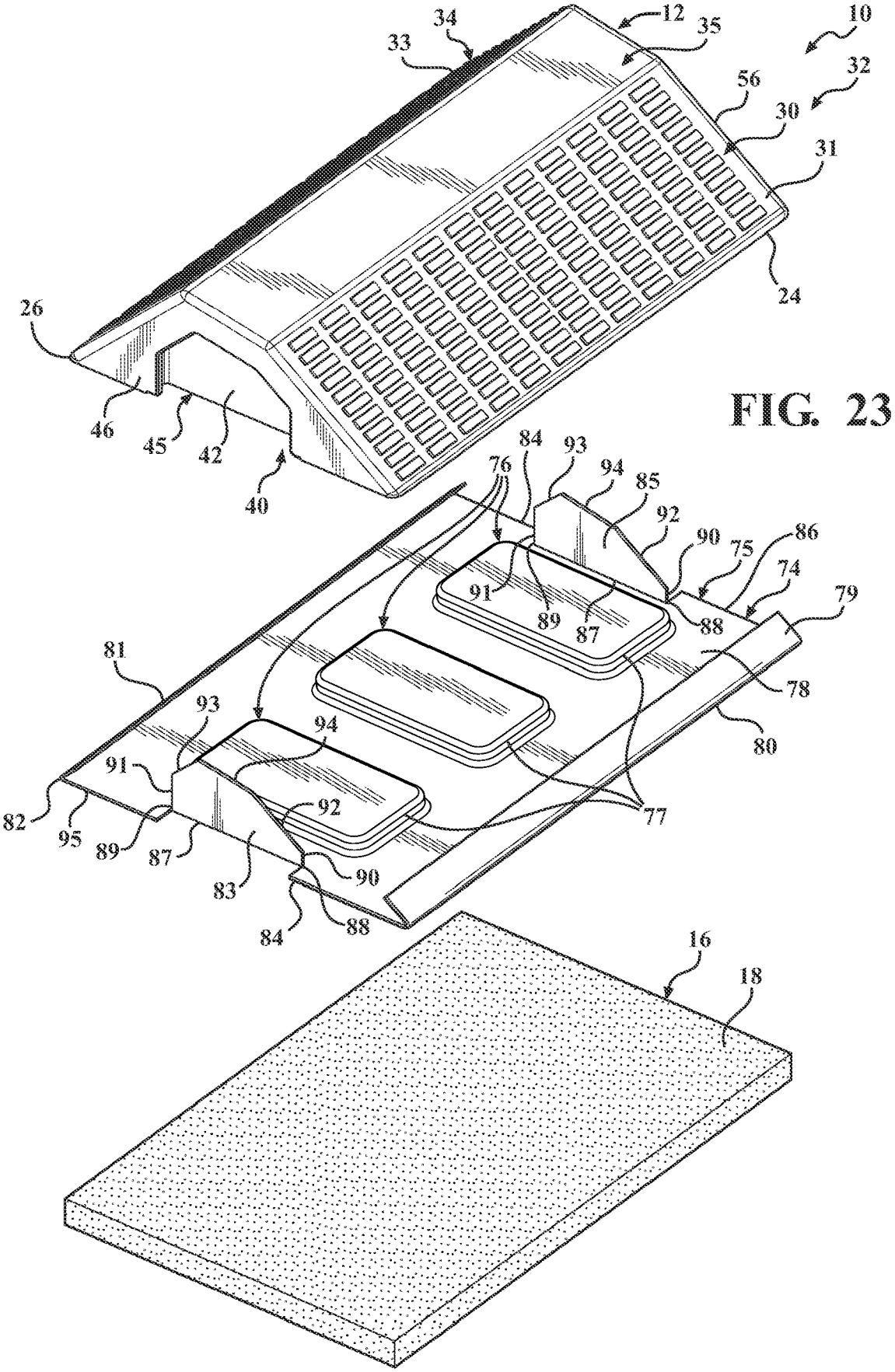
FIG. 23 is an exploded perspective view of the embodiment of a roofing support system and roof support of FIG. 22.
Figure 24:
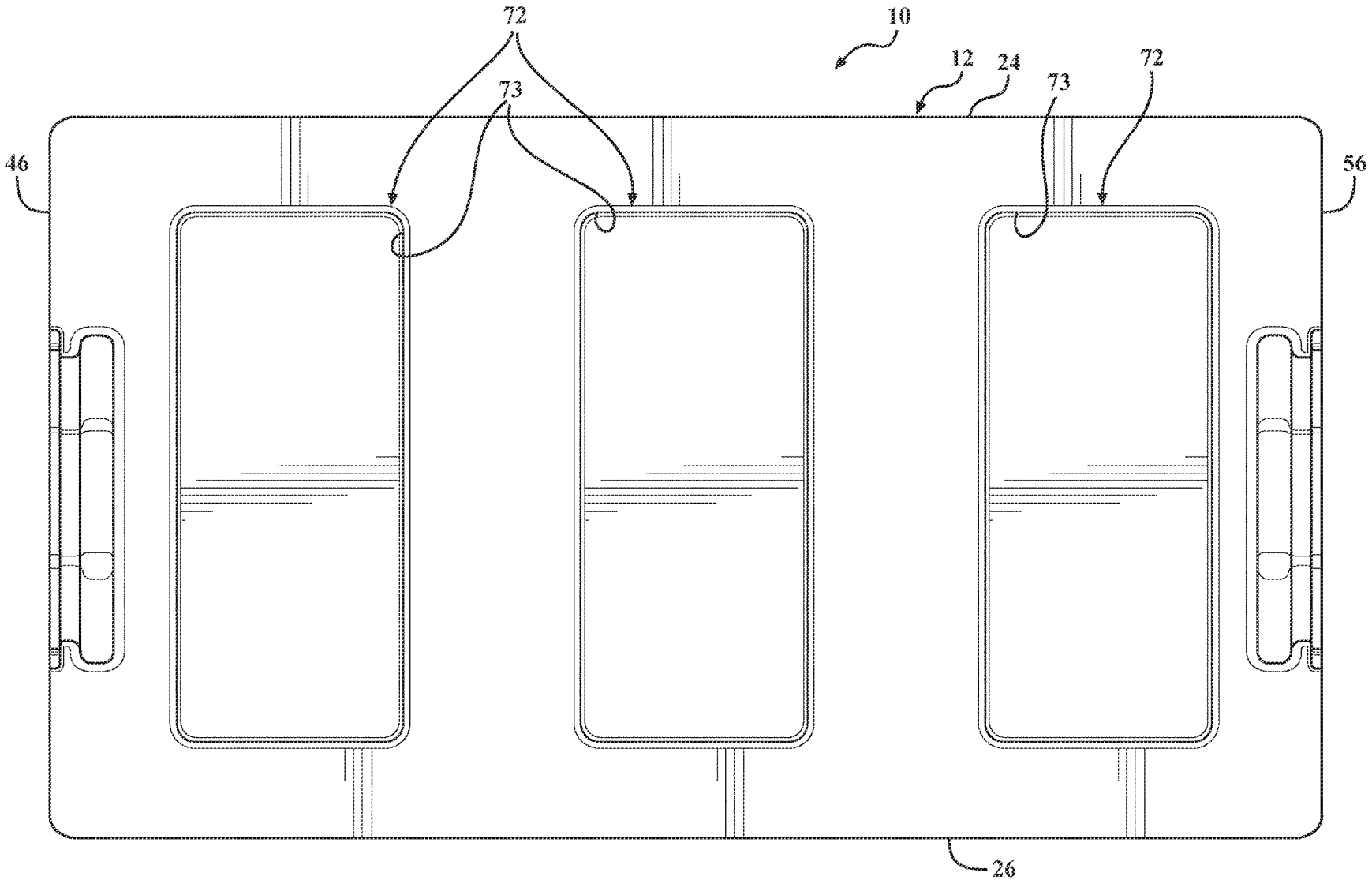
FIG. 24 is a bottom view of the core member of the roofing support system and roof support of FIG. 22.
Figure 25:
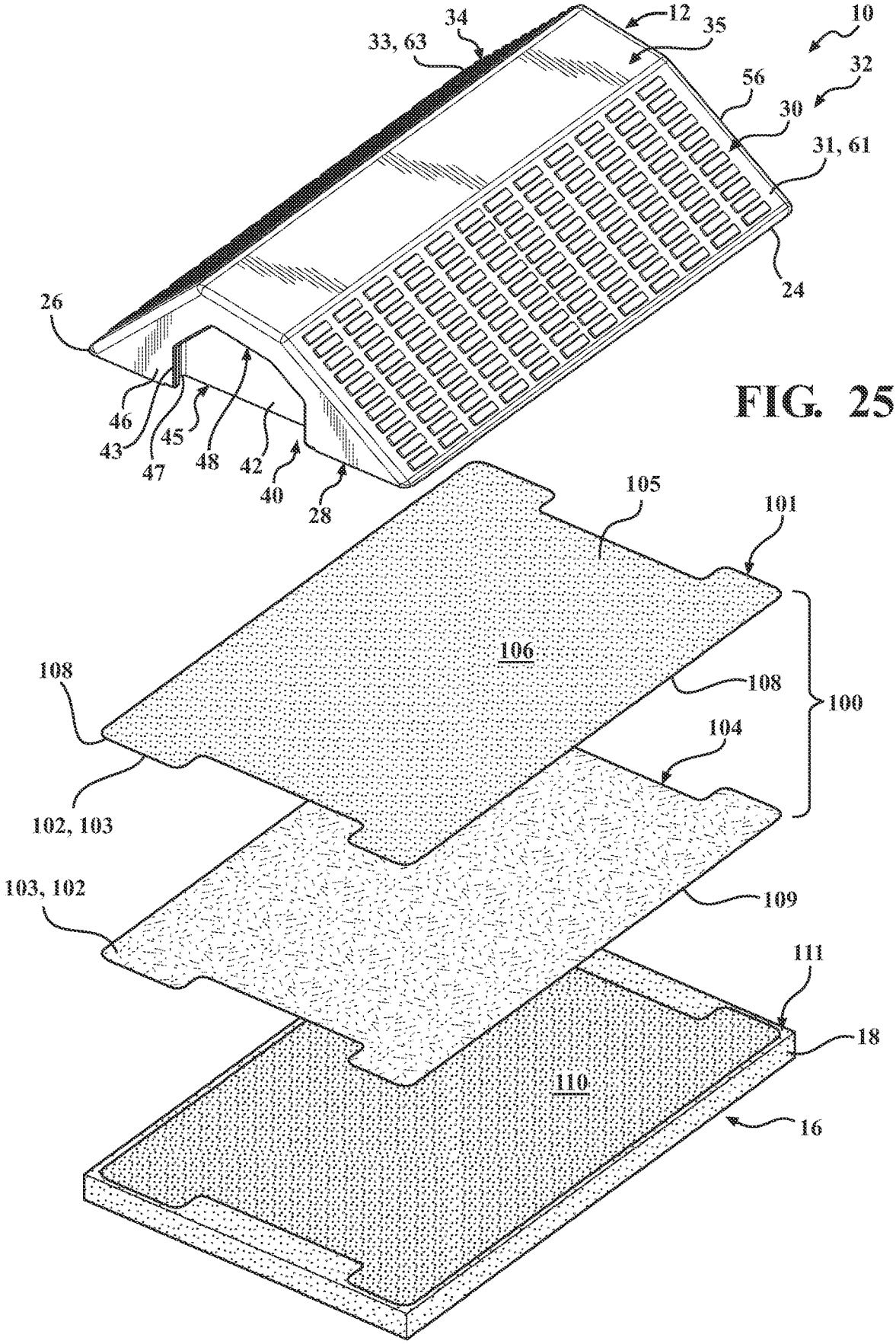
FIG. 25 is an exploded perspective view of another embodiment of a roofing support system and roof support as disclosed herein illustrating a core member, a selectively attachable/detachable hook and loop attachment device comprising a first sheet of hook material or loop material and second sheet of a loop material or a hook material, respectively, and a resiliently compressible cover layer that is selectively attachable and detachable by the attachment device as described herein.

Referring to FIGS. 22-24, in one embodiment, the lightweight composite roofing support system 10 comprises a longitudinally-extending core member 12 as described herein, wherein the longitudinally-extending first roof contact side 28 further comprises a plurality of longitudinally spaced apart first side recesses 72 (FIG. 24). The plurality of longitudinally spaced apart first side recesses 72 may include any suitable number of first side recesses, which in one embodiment comprises a range of 2-10, more particularly 2-8, and even more particularly 3-6. The first side recesses 72 may have any suitable shape or size, including various geometric shapes, including circular, elliptical, triangular, rectangular, and other polygonal shapes. In one embodiment, the first side recesses comprise three longitudinally spaced apart rectangular shape recesses with the longer sides of the rectangles oriented laterally across the width of the longitudinally-extending first roof contact side 28. The first side recesses 72 may have any suitable recess depth including a range of 0.25 to 1.5 inches, more particularly 0.5 to 1.25 inches, and even more particularly 0.5-1.0 inches. The first side recesses 72 may have any suitable recess sidewall 73 shape, including vertical recess sidewall, as well as inwardly (e.g., toward the center of the recess) and outwardly tapering recess sidewalls, as well as curved or angled sidewalls, including concave or convex curved or angled sidewalls that are configured to provide a snap lock engagement as described herein, or any combination of these sidewall shapes.

In the embodiment of FIGS. 22-24, in addition to longitudinally-extending core member 12, the lightweight composite roofing support system 10 further comprises a flexible, longitudinally-extending integral or one-piece base 74 and cover layer 14 configured to be disposed on a bottom surface 95 of the base. The base 74 is configured to be disposed between the core member 12 and the cover layer 14 and is selectively attachable to and detachable from the core member on the first roof contact side 28. The base 74 comprises a generally planar longitudinally-extending base member 75, a plurality of longitudinally spaced apart base protrusions 76 having protrusion sidewalls 77 extending upwardly from an upper surface 78 of the base member and corresponding for purposes of close fit, interference fit, or snap-fit engagement in number, shape, size, and protrusion sidewall 77 shape with the first side recesses 72 and recess sidewall 73 shape. The base 74 and base member 75 also comprises a longitudinally-extending first tapered retainer lip 79 attached at a first base member edge 80 and configured to extend inwardly and upwardly along the longitudinally-extending first base edge 24 and a portion of second side 30, a second tapered retainer lip 81 attached at a second base member edge 82 and configured to extend inwardly and upwardly along the longitudinally-extending second base edge 26 and a portion of third side 34, an upwardly-extending first recess insert 83 attached at a first base member end 84 and configured to be disposed along the first end 46 of core member 12 within first recess 45 adjacent to first inner slot wall 42 by insertion through first slot opening 40, and an upwardly-extending second recess insert 85 attached at a second base member end 86 and configured to be disposed along the second end 56 of core member 12 within second recess 55 adjacent to second inner slot wall 52 by insertion through second slot opening 50. The flexible, longitudinally-extending base 74 may be formed from any suitable lightweight flexible material, including various metals (e.g., aluminum, or magnesium alloys, or combinations thereof), or engineering thermoplastic or thermoset polymers, or a combination thereof. Engineering thermoplastic or thermoset polymers may comprise polystyrene (PS), polyester (PEST), polycarbonate (PC), polyethylene (PE), polypropylene (PP), polyurethane (PU), or ethylene-vinyl acetate (EVA), or a combination thereof, and more particularly an expanded foam comprising polystyrene (EPS), polyethylene (EPE), polypropylene (EPP), polyurethane (EPU), or ethylene-vinyl acetate (EEVA), or a combination thereof, which, as used herein, includes chemical or physical combinations thereof, including copolymers thereof. Base 74, and particularly base member 75, may have any suitable size and shape, but will generally have the same general shape and size (e.g., length and width) as the first roof contact side 28 because it is designed and selected to be applied to and to be selectively attachable to and detachable from, and cover, the first roof contact side 28. Thus, the ranges of sizes and shapes described herein for first roof contact side 28 are also generally applicable to the base 74 and base member 75. Base member 75 may have any suitable thickness, which in order to retain flexibility as described herein, will depend on the material selected, particularly the mechanical properties including the elastic modulus, to be configured, both laterally and longitudinally, to be flexed or elastically bent or deformed outwardly by a human user of average strength to allow the first tapered retainer lip 79 to be inserted over and engage the longitudinally-extending first base edge 24 and a portion of the second side 30, the longitudinally-extending second tapered retainer lip 81 to be inserted over and engage the longitudinally-extending second base edge 26 and a portion of the longitudinally-extending third side 34, the upwardly-extending first recess insert 83 to be disposed along the first end 46 and engage the first recess 45 and first inner slot wall 42 through first slot opening 40, and the upwardly-extending second recess insert 85 to be disposed along the opposed second end 56 and engage the second recess 55 and second inner slot wall 52 through second slot opening 50, while at the same time the spaced apart base protrusions 76 and protrusion sidewalls 77 engage the respective corresponding first side recesses 72 and first recess sidewalls 73, which in one embodiment may comprise a press fit engagement, a slight interference fit engagement, or a snap-lock or snap-fit engagement with the first roof contact side 28 and the upper surface 78 of base member 75 in substantially or near touching contact or touching contact. In one embodiment, the base thickness ($t_B$), may comprise 0.010 to 1.0 inches, more particularly 0.1 to 0.75 inches, and more particularly 0.25 to 0.50 inches. Base member 75 will generally have a flat planar lower surface 81 that is configured for disposition of the resiliently compressible cover layer 16 thereon. In one embodiment, core member 12 does not include first side recesses 72 and base member 75 does not include protrusions 76, but all other feature of the core member 12 of FIGS. 1-7 and base 74 remain the same.

The first tapered retainer lip 79 may be configured to taper at any suitable angle, including in one embodiment first acute angle ($\alpha$), and extend inwardly and upwardly along the longitudinally-extending first edge 24 and a portion of second side 30 to any suitable extent or distance, which in one embodiment may include 0.25 to 1.5 inches, more particularly 0.5 to 1.0 inches. The uppermost edge of first tapered retainer lip 79 may also be tapered down to the second side 30 to provide close continuity with the first side working surface 31. The second tapered retainer lip 81 may be configured to taper at any suitable angle, including in one embodiment second acute angle ($\beta$), and extend inwardly and upwardly along the longitudinally-extending second base edge 26 and a portion of third side 34 to any suitable extent or distance, which in one embodiment may include 0.25 to 1.5 inches, more particularly 0.5 to 1.0 inches. The uppermost edge of second tapered retainer lip 81 may also be tapered down to the third side 34 to provide close continuity with the second side working surface 34.

The upwardly-extending first recess insert 83 to be disposed along the first end 46 and engage the first recess 45 and first inner wall 42 through first slot opening 40 may comprise any suitable shape configured for disposition and engagement as described. In one embodiment, the first recess insert 83 has the same shape as the opening shape of first recess 45, namely, an irregular hexagon shape comprising a lateral edge 87 having a second side end 88 and an opposed third side end 89, a second side vertical edge 90 extending from the second side end 88 upwardly toward second side 30, a third side vertical edge 91 extending from the third side end 89 upwardly toward third side 34, a tapered second side edge 92 configured to extend upwardly parallel to second side 30, a tapered third side edge 93 configured to extend upwardly parallel to third side 34, a tapered fourth side edge 94 configured to extend parallel to fourth side 35 between second side edge 92 and third side edge 93.

The upwardly-extending second recess insert 85 to be disposed along the second end 56 and engage the second recess 55 and second inner slot wall 52 through first slot opening 50 may comprise any suitable shape configured for disposition and engagement as described. In one embodiment, the second recess insert 85 has the same shape as the opening shape of second recess 55, namely, an irregular hexagon shape and comprises a mirror image of first recess insert 83, and may be described as having the same elements.

In an attached position and condition the base 74 comprising base member 75 is disposed against the first roof contact side 28, the first tapered retainer lip 79 is disposed over and retains the first edge 24, the second tapered retainer lip 81 is disposed over and retains the second edge 26, the first recess insert 83 is disposed in the first recess 45, the second recess insert 85 is disposed in the second recess 55, and the plurality of spaced apart base protrusions 76 are disposed in and engage the spaced apart first side recesses 72, and the cover layer 16 is attached to the bottom surface 95 of the base. The first side recesses 72/base protrusions 76 and recess inserts 83, 85 serve to index the core member 12 and base 74 during attachment of the base to the core member.

In the embodiment of FIGS. 22-24, the cover layer(s) 16 and cover material(s) 18 may comprise those described in any of the embodiments of lightweight composite roofing support system 10 described herein. The cover layer(s) 16 may be disposed on the base 74 in any suitable matter using any suitable attachment, including using any cover layer attachment described in any of the embodiments of lightweight composite roofing support system 10 described herein.

Figure 26:
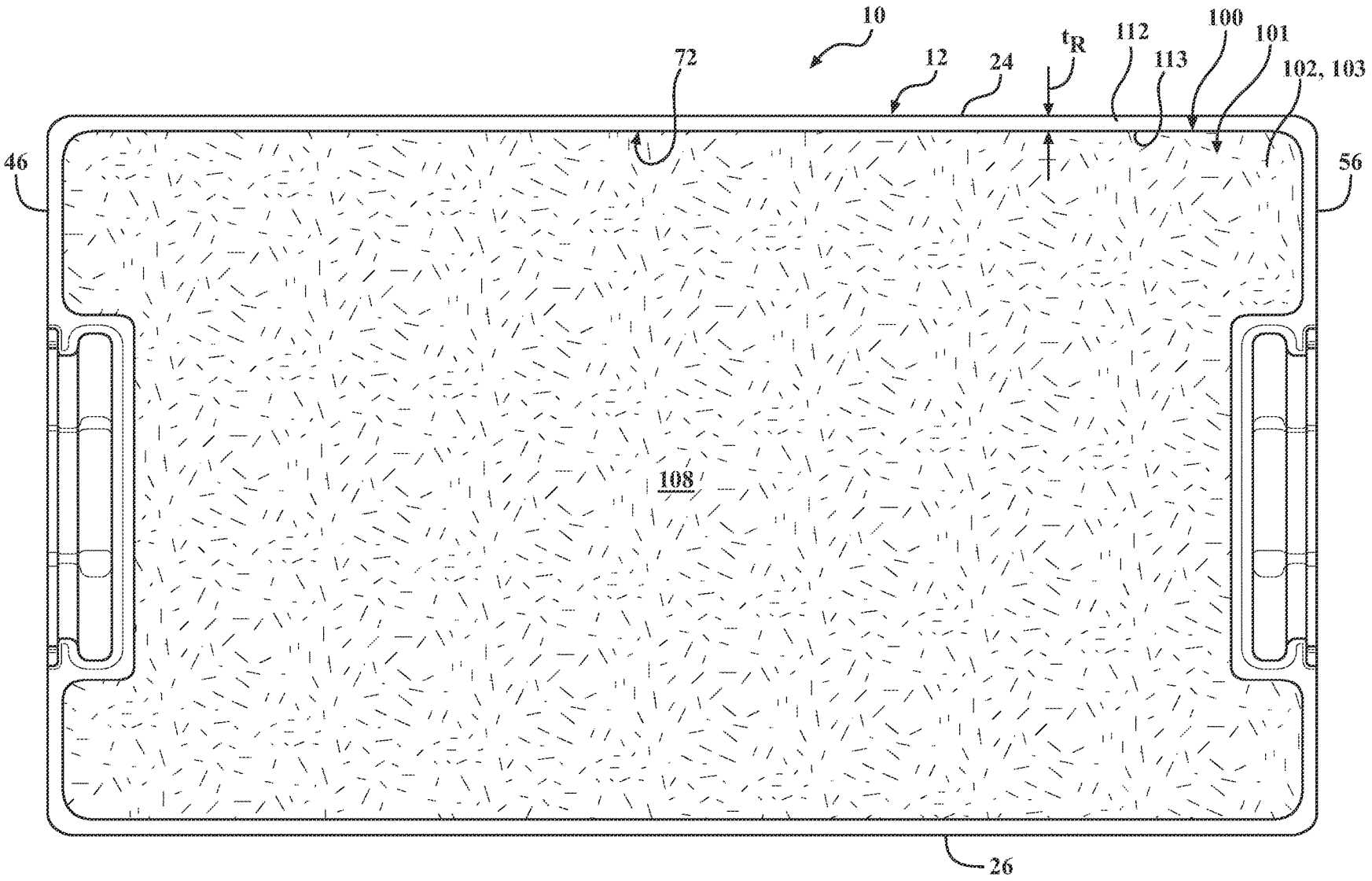
FIG. 26 is a bottom view of the core member of the roofing support system and roof support of FIG. 25 and the first sheet of hook material or loop material attached thereto.
Figure 27:
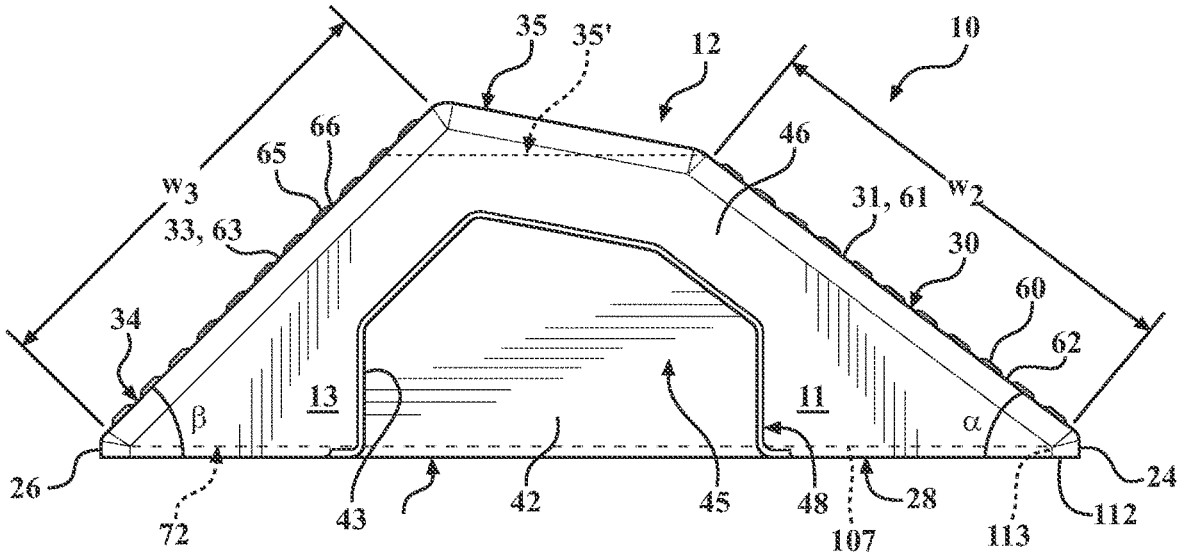
FIG. 27 is a left side view of the core member of FIG. 26.
Figure 28:
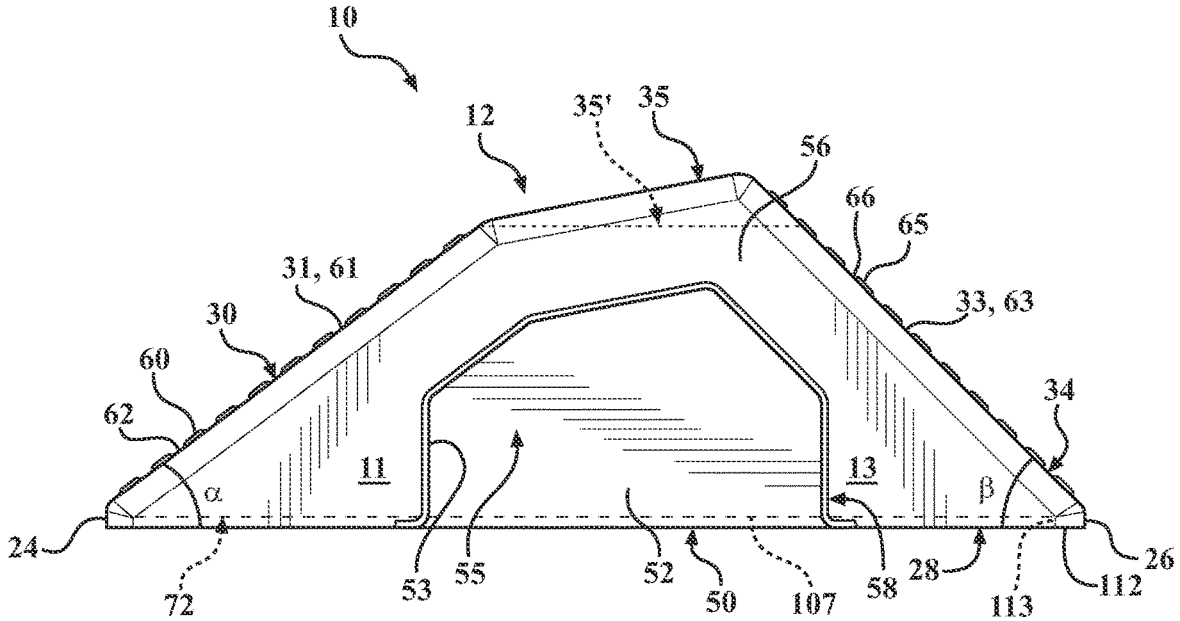
FIG. 28 is a right side view of the core member of FIG. 26.
Figure 29:
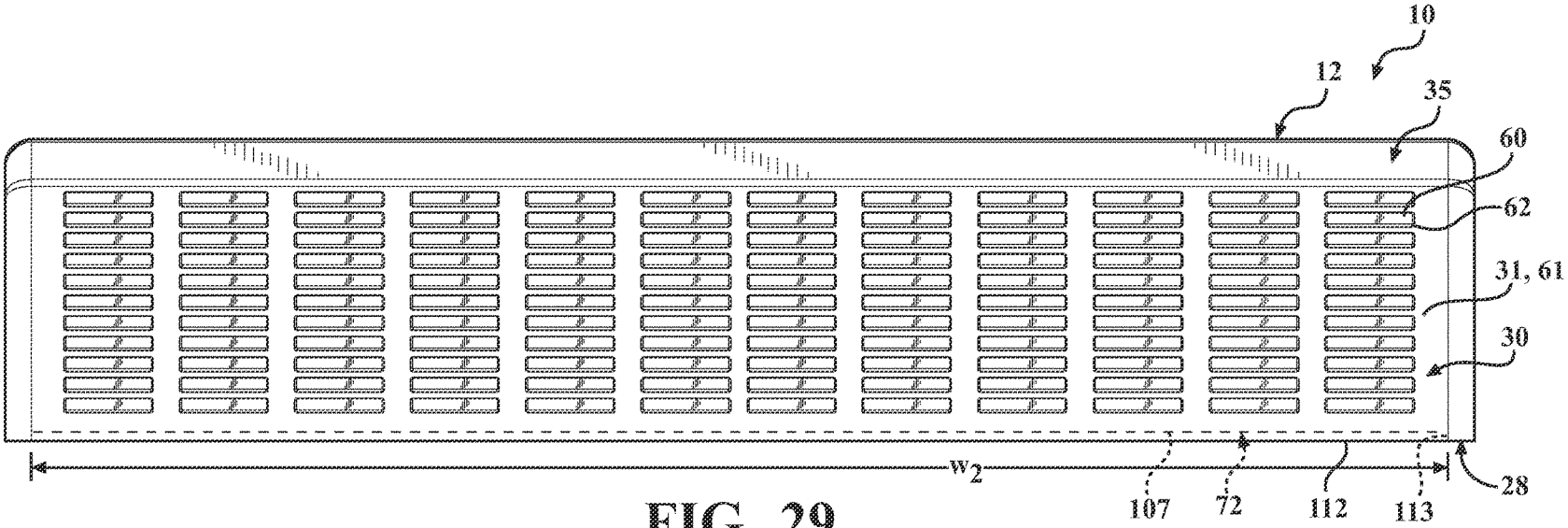
FIG. 29 is a front view of the core member of FIG. 26.
Figure 30:
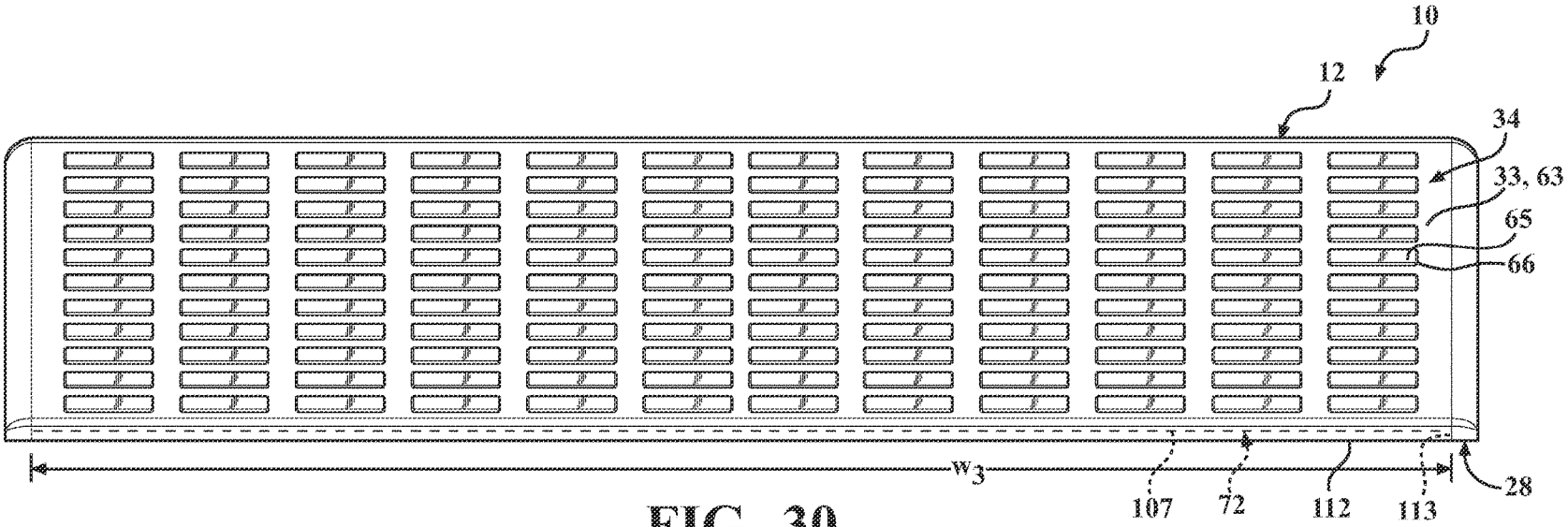
FIG. 30 is a rear view of the core member of FIG. 26.
Figure 31:
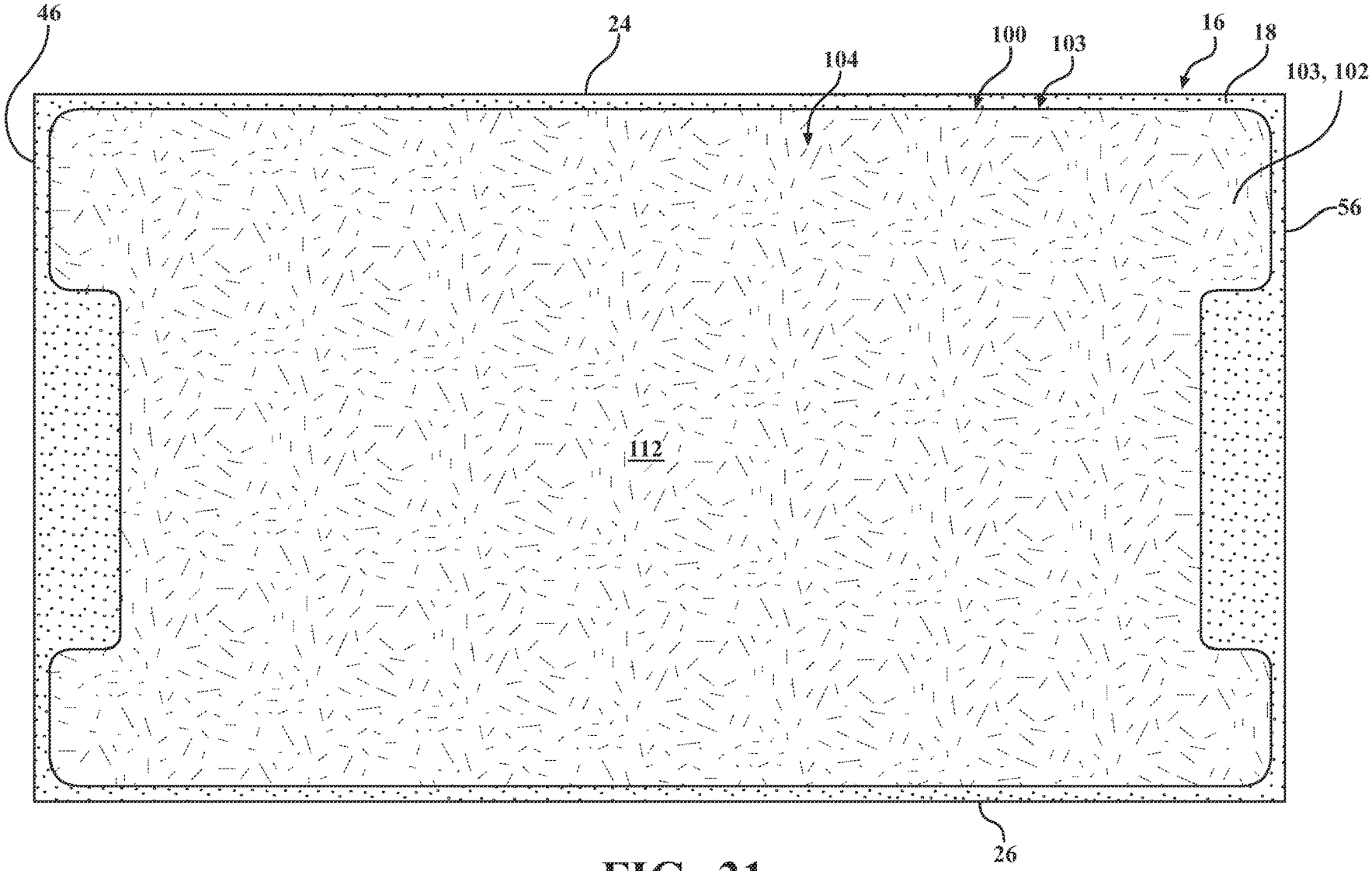
FIG. 31 is a top view of the resiliently compressible cover layer of the roofing support system and roof support of FIG. 25 and the second sheet of hook material or loop material attached thereto.
Figure 32:
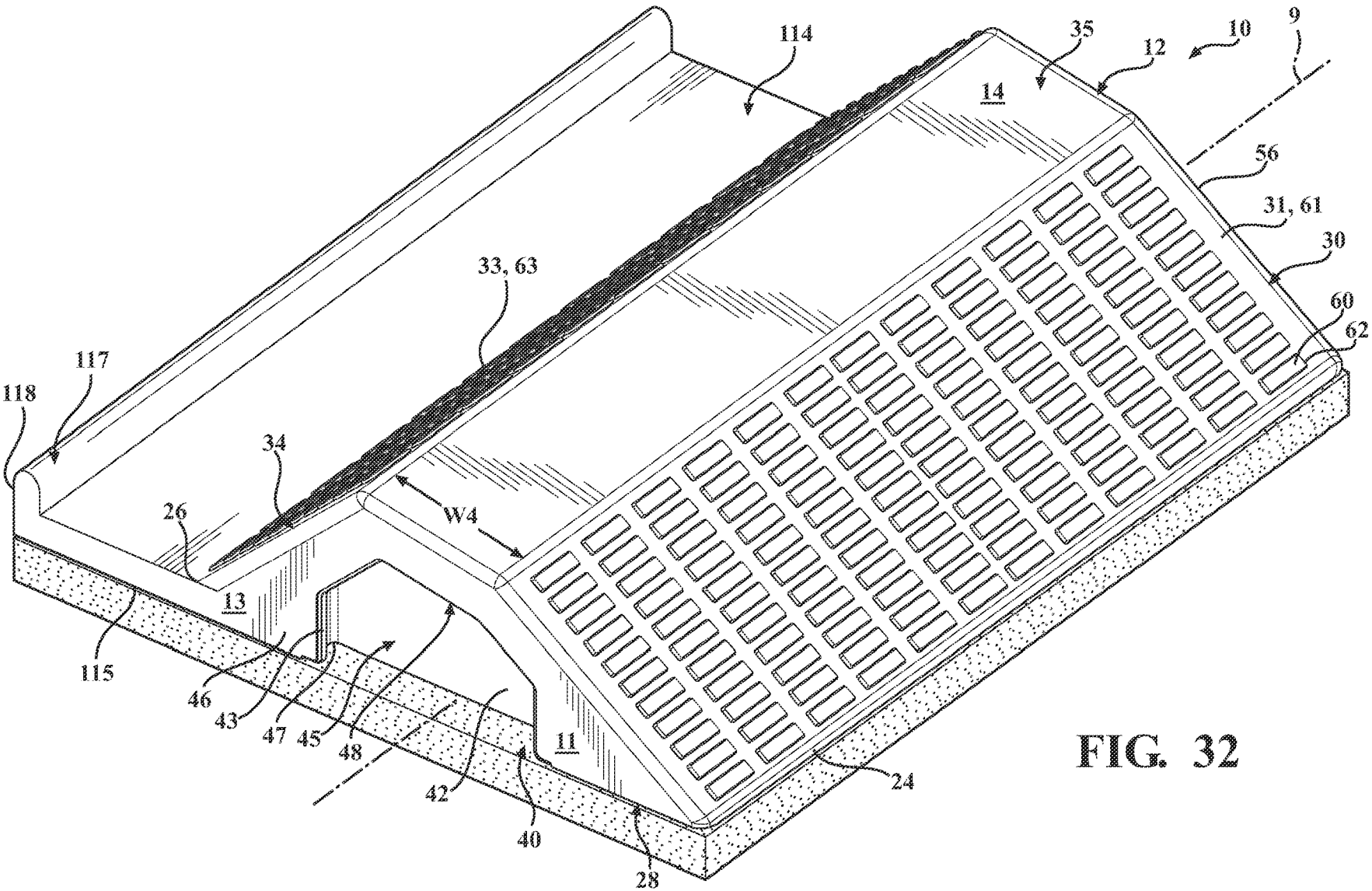
FIG. 32 is a perspective view of another embodiment of a roofing support system and roof support as disclosed herein illustrating a core member with an integral longitudinally-extending shelf and attached resiliently compressible cover layer as described herein.
Figure 33:
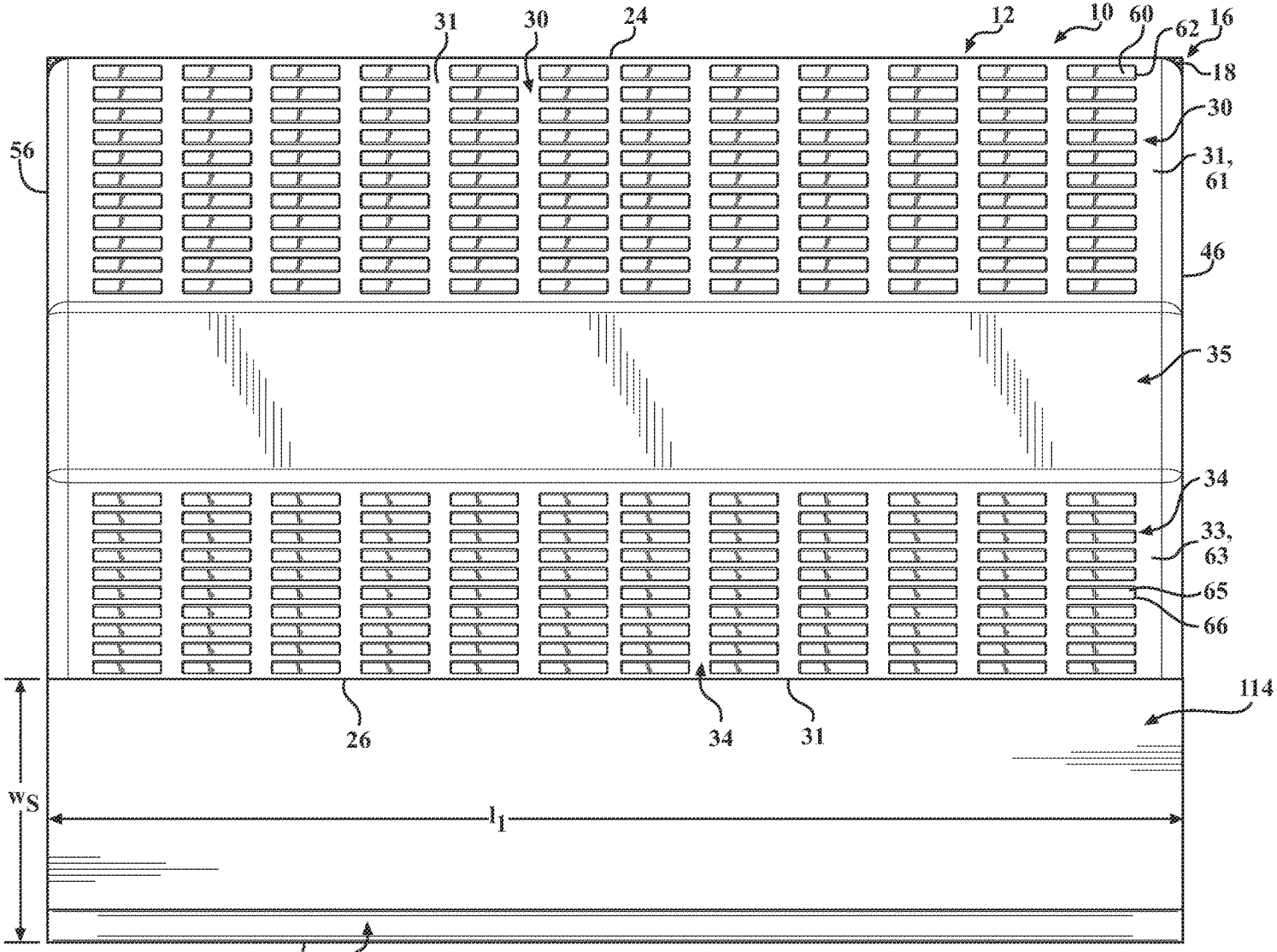
FIG. 33 is a top view of the roofing support system and roof support of FIG. 32.
Figure 34:
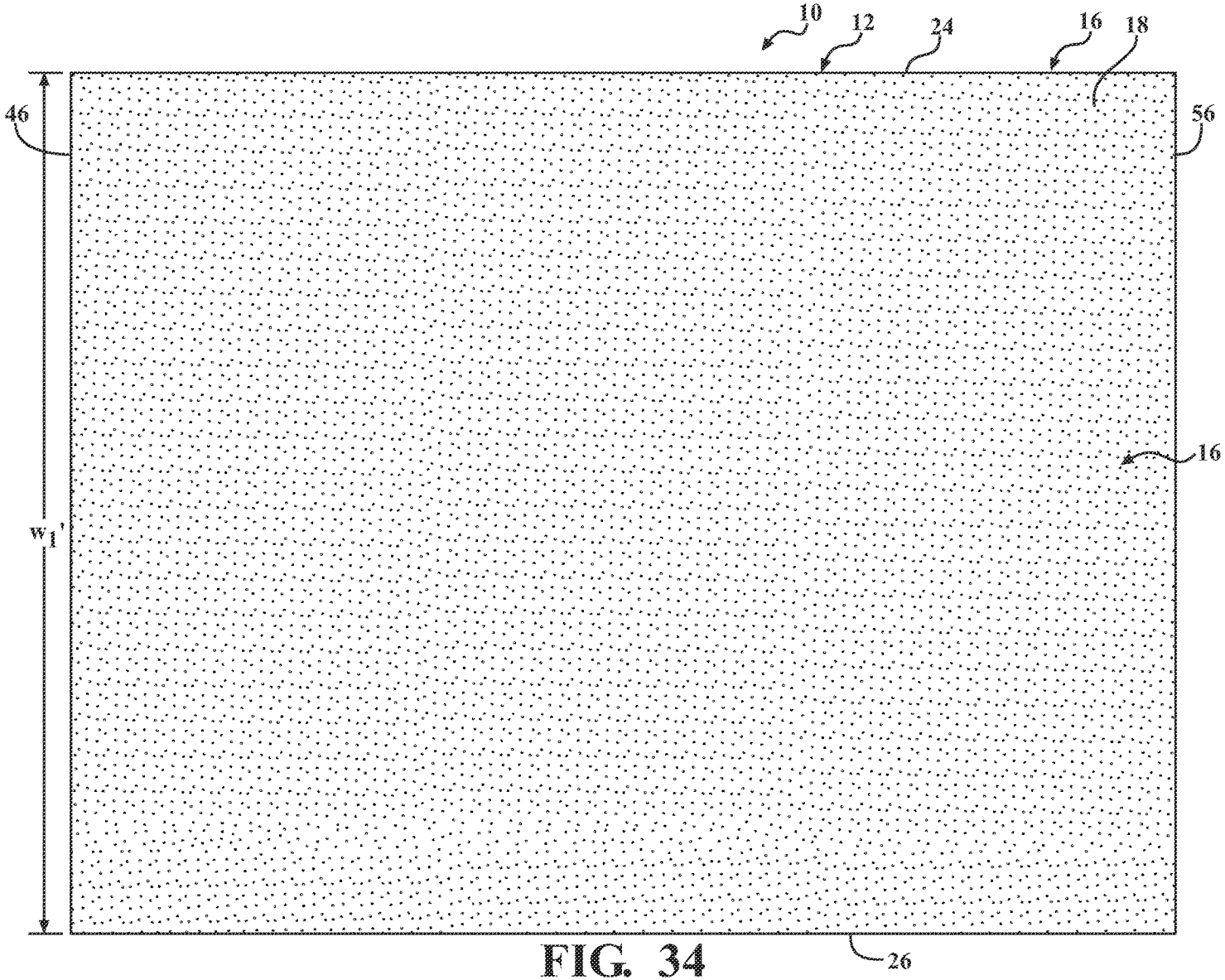
FIG. 34 is a bottom view of the roofing support system and roof support of FIG. 32.
Figure 35:
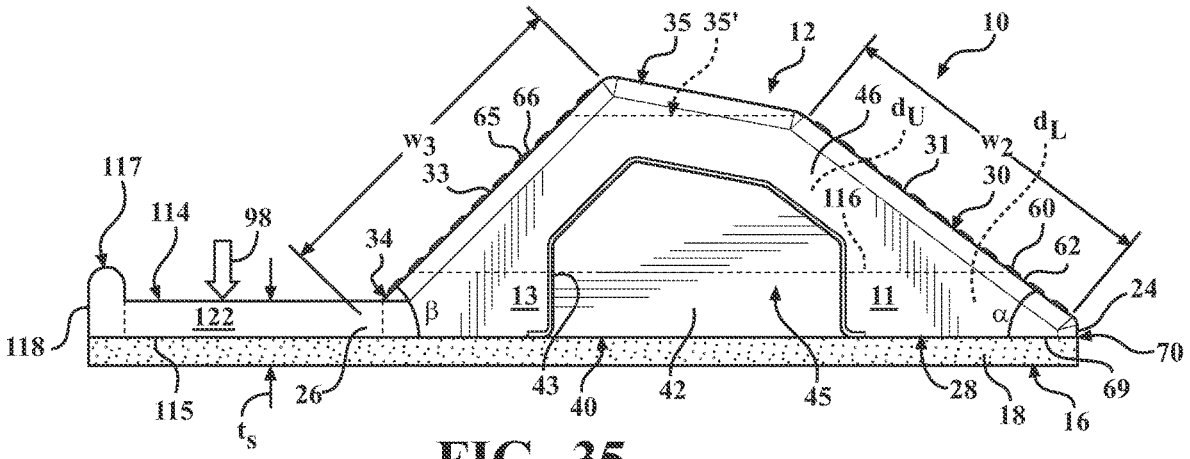
FIG. 35 is a left side view of the roofing support system and roof support of FIG. 32.
Figure 36:
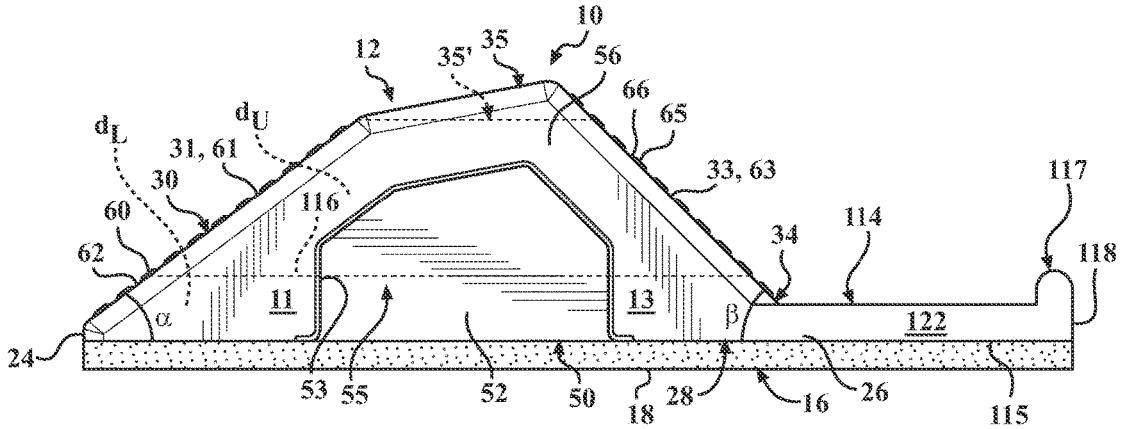
FIG. 36 is a right side view of the roofing support system and roof support of FIG. 32.
Figure 37:
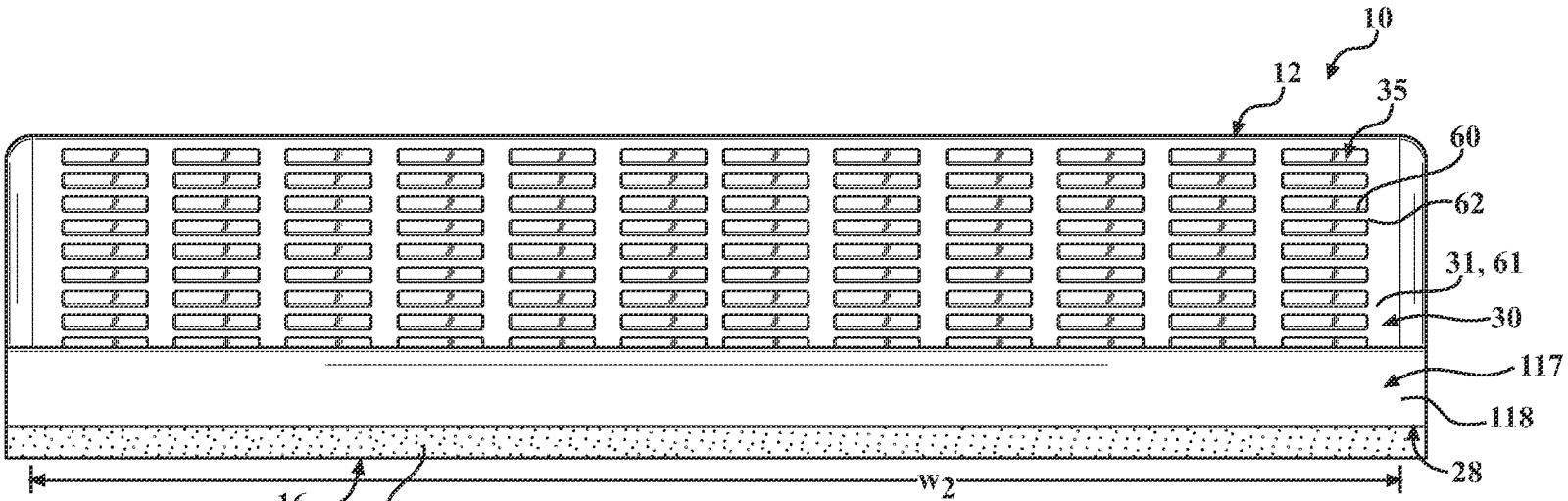
FIG. 37 is a rear view of the roofing support system and roof support of FIG. 32.
Figure 38:
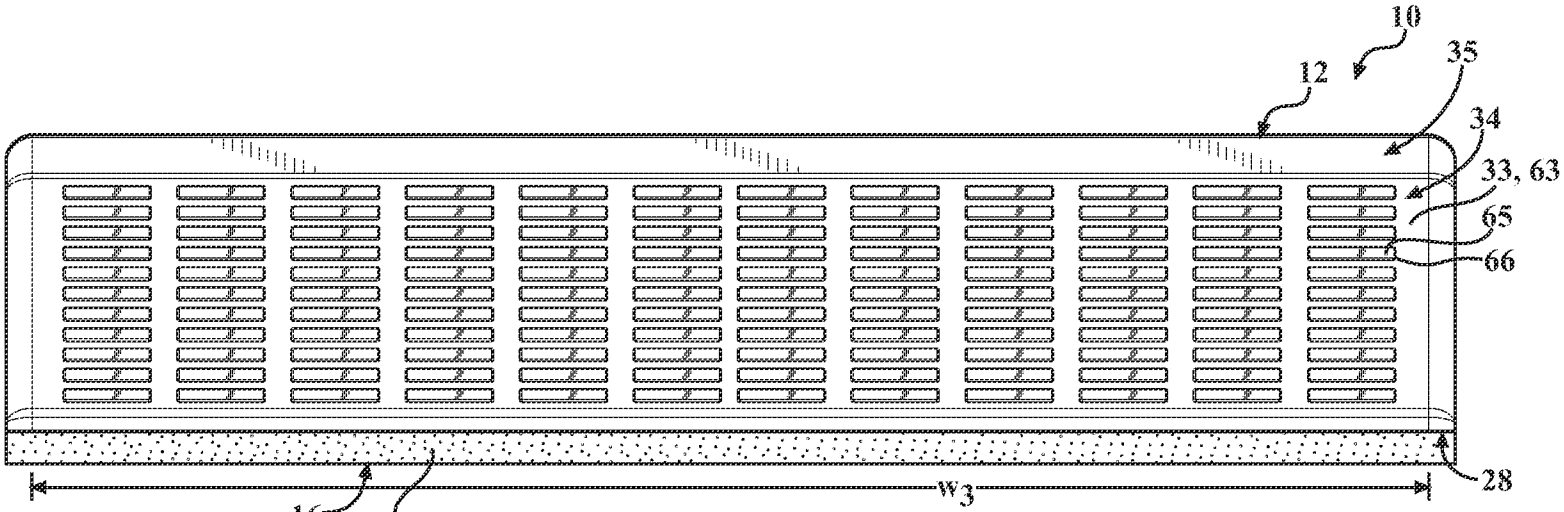
FIG. 38 is a front view of the roofing support system and roof support of FIG. 32.
Figure 39:
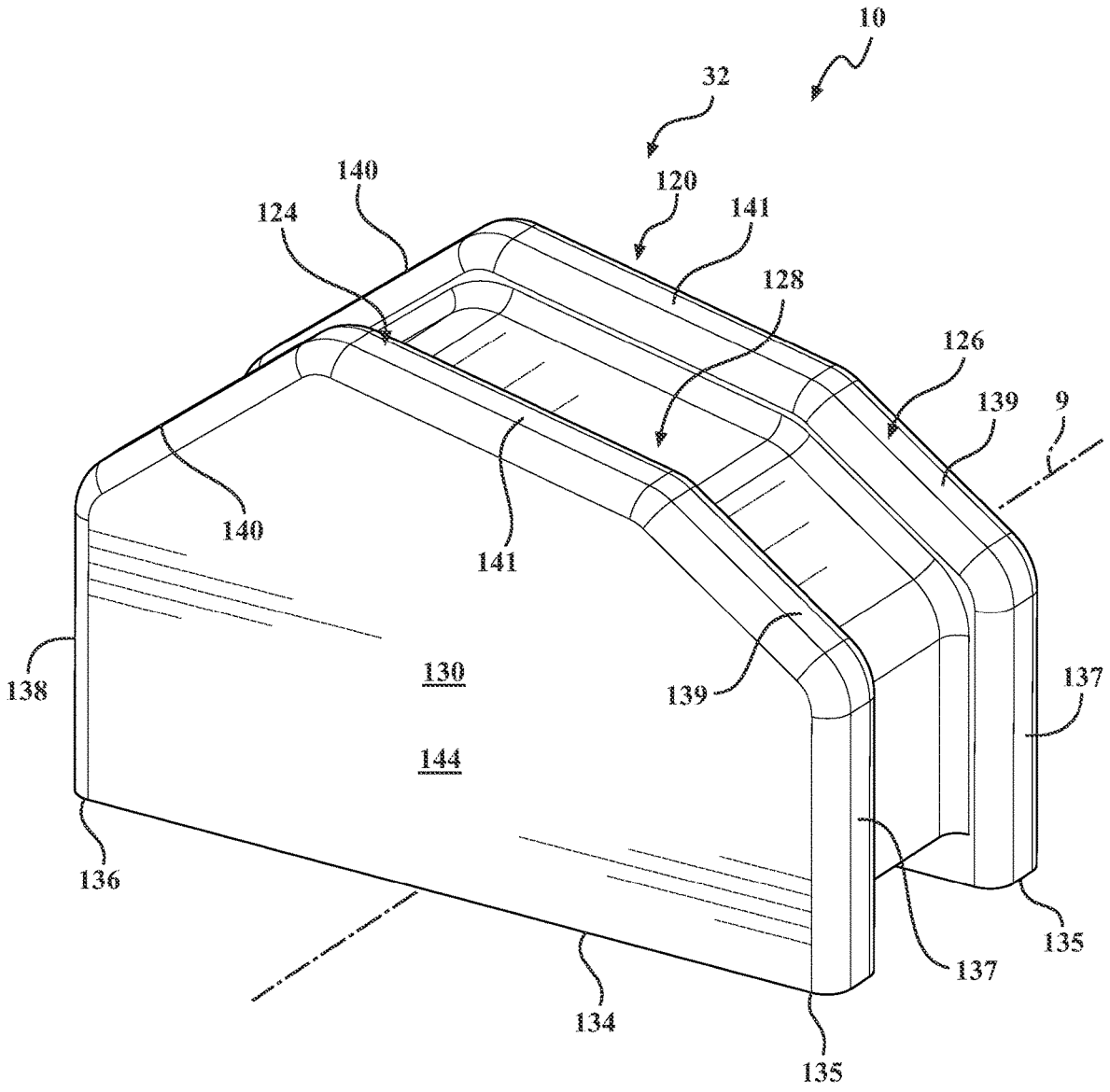
FIG. 39 is a perspective view of an embodiment of a lightweight roofing support system connector as described herein.
Figure 40:
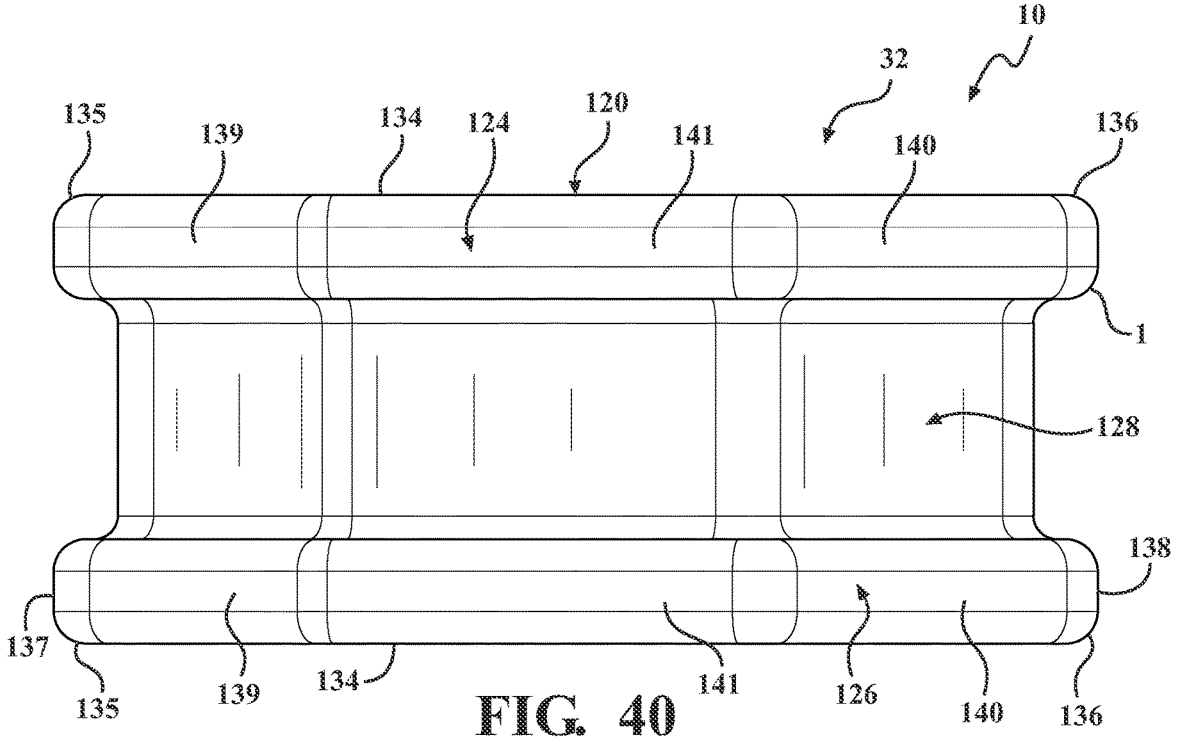
FIG. 40 is a top view of the roofing support system connector of FIG. 39.
Figure 41:
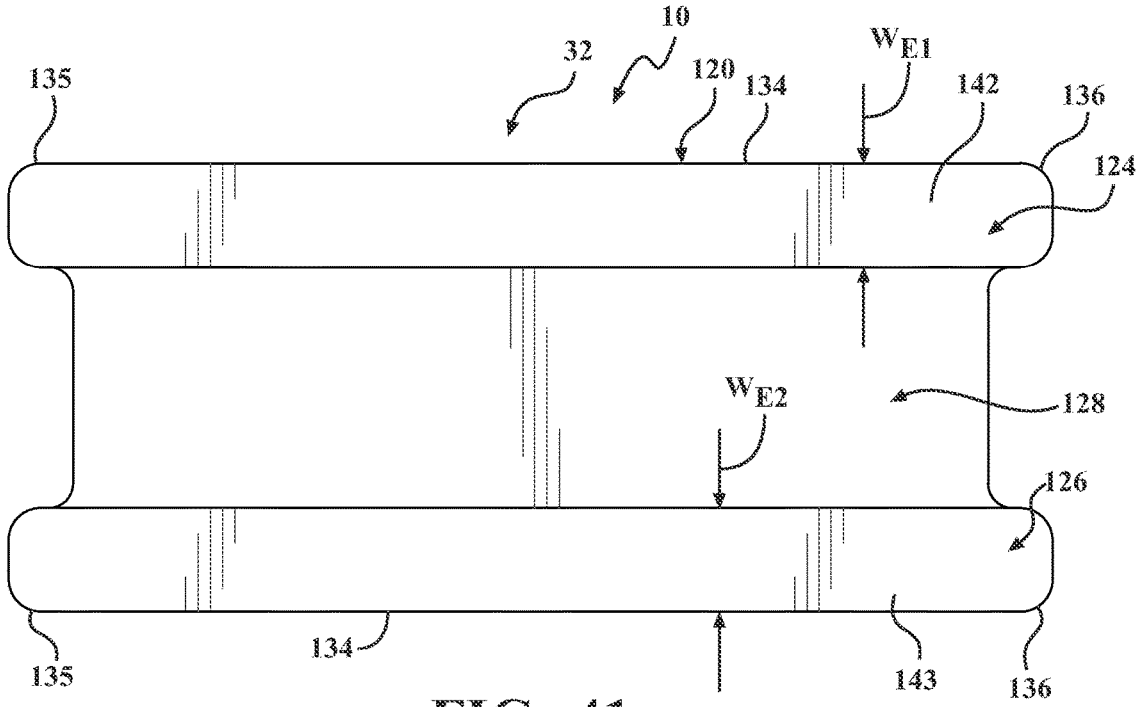
FIG. 41 is a bottom view of the roofing support system connector of FIG. 39.
Figure 42:
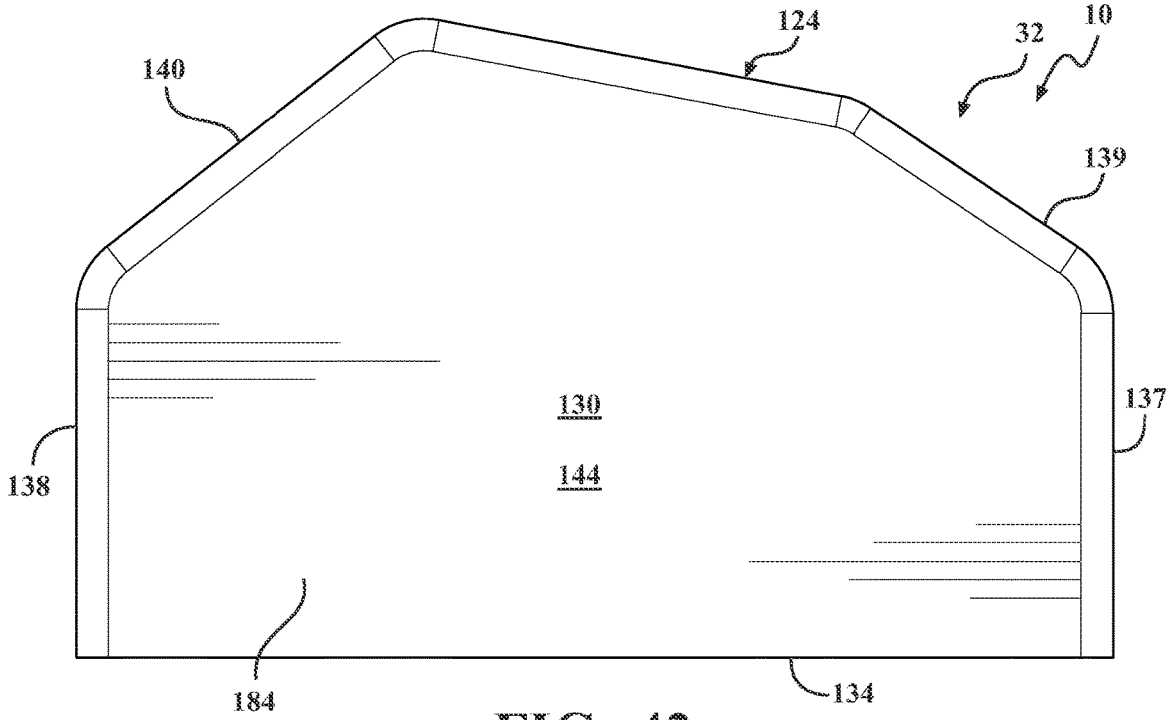
FIG. 42 is a left side view of the roofing support system connector of FIG. 39.
Figure 43:
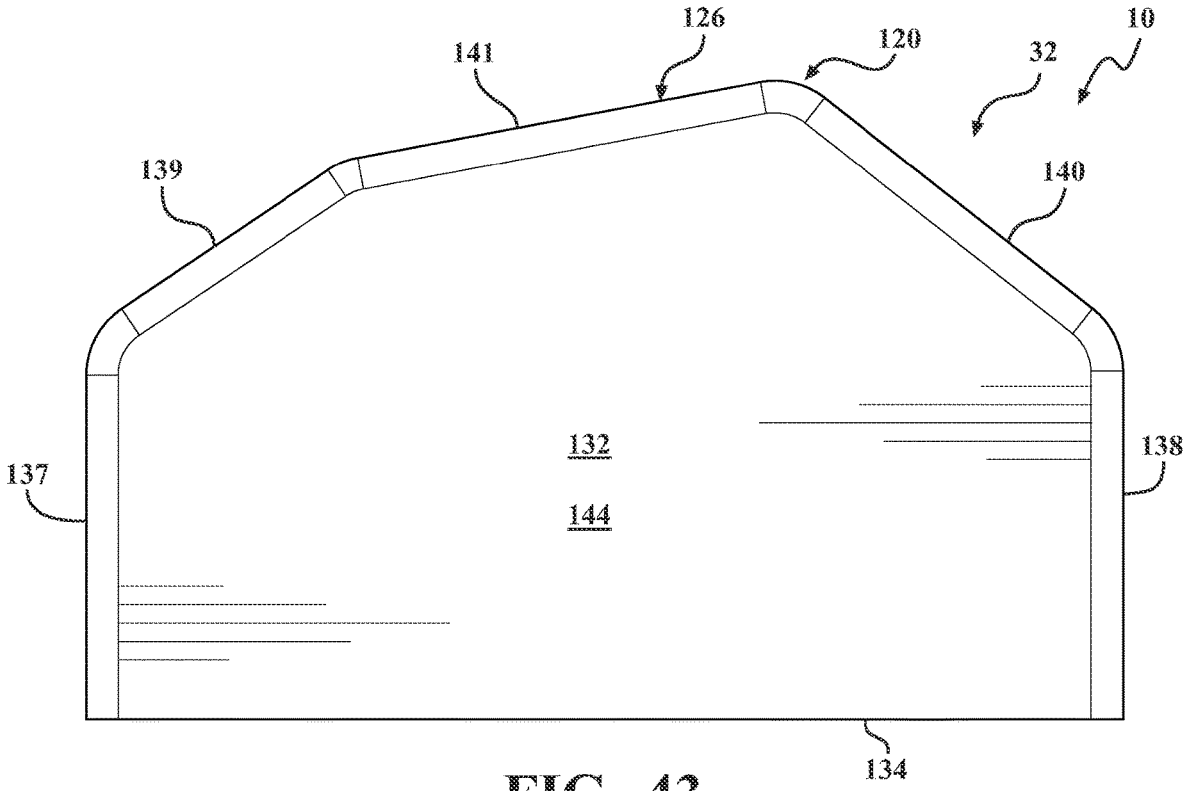
FIG. 43 is a right side view of the roofing support system connector of FIG. 39.
Figure 44:
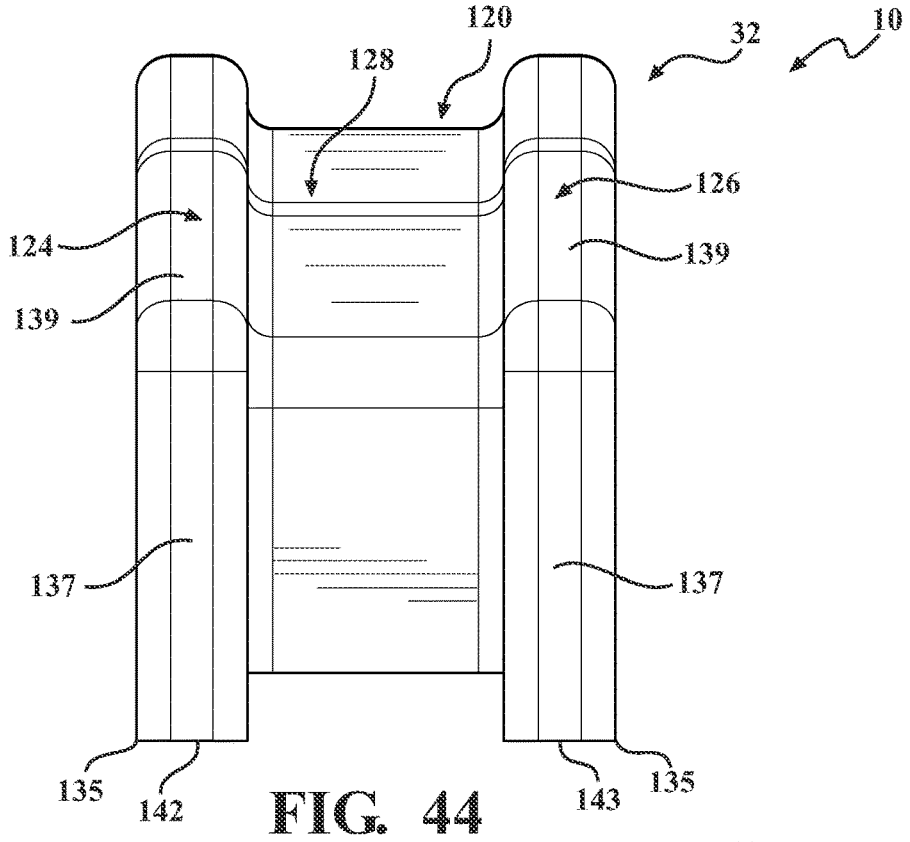
FIG. 44 is a front view of the roofing support system connector of FIG. 39.
Figure 45:
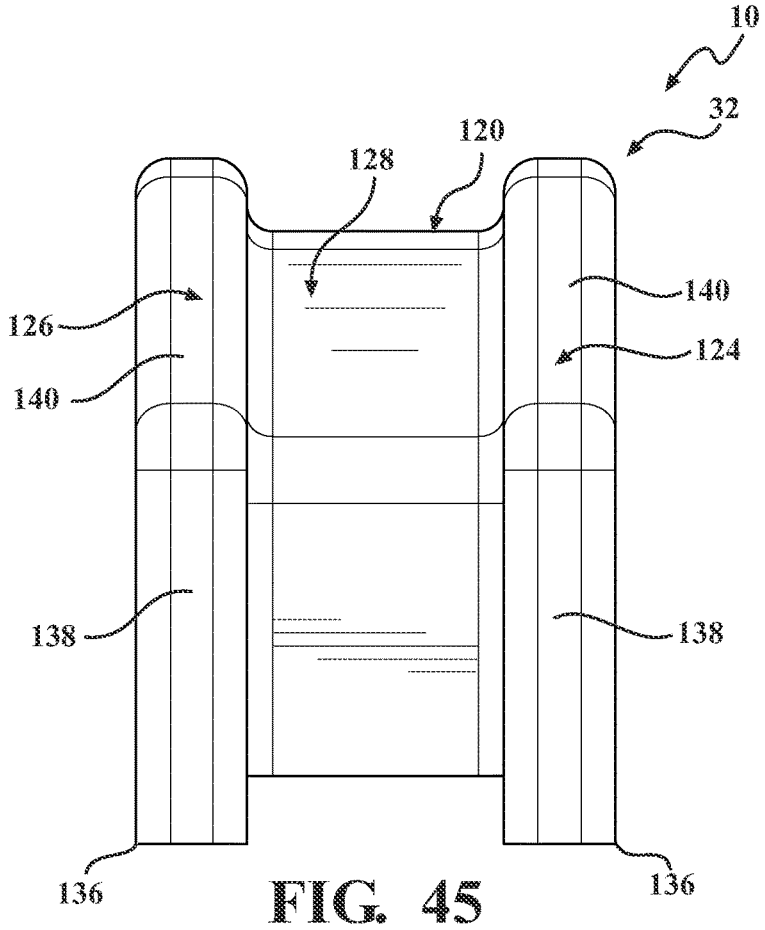
FIG. 45 is a rear view of the roofing support system connector of FIG. 39.

Referring to FIGS. 25-31, in one embodiment, the lightweight composite roofing support system 10 comprises a longitudinally-extending core member 12 as described herein, wherein the longitudinally-extending first roof contact side 28 further comprises a first side recess 72 (FIG. 26). In one embodiment, the first side recess 72 comprises a single recess 72, but in other embodiments may comprise a plurality of longitudinally spaced apart first side recesses 72 (e.g., FIG. 24 with 3 recesses) in any suitable number as described herein. The first side recesses 72 may have any suitable shape or size, including various geometric shapes, including circular, elliptical, triangular, rectangular, and other polygonal shapes. In one embodiment (FIG. 26), the first side recess 72 comprises an I-shaped recess. In these embodiments, the first side recesses 72 may have any suitable recess depth including a range of 0.01 to 0.5 inches, more particularly 0.025 to 0.375 inches, and even more particularly 0.05 to 0.25 inches. The first side recesses 72 may have any suitable recess sidewall 73 shape, including vertical recess sidewall, as well as inwardly (e.g., toward the center of the recess) and outwardly tapering recess sidewalls, as well as curved sidewalls, including concave or convex curved sidewalls, or any combination of these sidewall shapes. In this embodiment, the first side recess 72 lowers the attachment interface below the plane of longitudinally-extending first roof contact side 28 such that the shear forces applied to the attachment during use of lightweight composite roofing support system 10 advantageously do not occur in the plane of the first roof contact side.

In the embodiment of FIGS. 25-31, in addition to longitudinally-extending core member 12, the lightweight composite roofing support system 10 further comprises a hook and loop attachment device 100 disposed between the core member and the cover layer 16. The attachment device 100 comprising a first sheet 101 of a loop material 102 comprising a plurality of hooks or a hook material 103 comprising a plurality of loops that is disposed in and attached to the first side recess 72 and a second sheet 104, respectively, of hook material 103 comprising a plurality of loops or loop material 102 comprising a plurality of hooks that is attached to the cover layer 16, wherein in an attached position and condition the first sheet 101 and the second sheet 104 are in pressed interlocking engagement with the respective plurality of hooks lockingly engaging the plurality of loops, and wherein the cover layer 16 is selectively attachable to and detachable from the core member 12 using the attachment device 100. The first sheet 101 and second sheet 104 may have any suitable size and shape, including the same size and shape as the shape of the first side recess 72, which in one embodiment may be I-shaped. The attachment device 100 may be described as a hook and loop attachment device 100 and also as a selectively attachable and detachable attachment device 100 that provides a selectively attachable and detachable attachment of the cover layer 16 to the core member 12. The use of selectively attachable and detachable attachment device 100 allows for the easy removal and replacement of a worn cover layer 16 with a new replacement cover layer by peeling the first sheet 101 and second sheet apart 103 as the cover layer becomes worn during use on a sloped roof 36 or roofs. This also enables the lightweight composite roofing support system 10 to include kitting of a plurality of replacement cover layers 16 as described below that include the second sheet 108 attached thereto with a core member 12 that has the first sheet attached thereto to extend the service life of the lightweight composite roofing support system 10 by selectively removing cover layers 16 as they become worn in use and replacing the worn cover layers with new cover layers 16 from the kit. Alternately, it allows the kitting of a plurality of cover layers 16 as described below that include the second sheet 108 attached thereto as a replacement pack of cover layers 16 to also extend the service life of the lightweight composite roofing support system 10 indefinitely by buying additional kits of the cover layers 16 and replacing the cover layers as they become worn during use.

The first sheet 102 comprises the loop material 102 comprising the plurality of hooks or the hook material 103 comprising the plurality of loops and is disposed within and attached to the first side recess 72. The first sheet 101 has an adhesive side 105 that is configured to receive an adhesive 106, which may be applied directly to the adhesive side 105 or to the recess surface 107 of the first side recess 72. The adhesive 106 attaches the first sheet 101 to the recess surface 107 within the first side recess 72. The first sheet 101 has an opposed side 108 that comprises the loop material 102 comprising the plurality of hooks or the hook material 103 comprising the plurality of loops. Any adhesive 106 suitable to permanently adhere the first sheet 101 to the recess surface 107 may be used, including the adhesives 70 described herein.

The second sheet 104 comprising, respectively with regard to the selection first sheet 101 and whether it includes a hook material or loop material to be the opposite or mating material, the hook material 103 comprising a plurality of loops or the loop material 102 comprising the plurality of loops is disposed on and attached to the cover layer 16. The second sheet 103 has an adhesive side 109 that is configured to receive an adhesive 110, which may be applied directly to the adhesive side 109 or to the attachment surface 111 of the cover layer 16 in the shape of the second sheet. The adhesive 110 attaches the second sheet 103 to the attachment surface 111 of the cover layer 16, generally by pressing the second sheet 103 against the cover layer 16. The second sheet 103 has an opposed side 112 that comprises, respectively, the hook material 103 comprising the plurality of loops or the loop material 102 comprising the plurality of hooks. Any adhesive 110 suitable to permanently adhere the second sheet 103 to the attachment surface 111 may be used, including the adhesive 106 or adhesive 70 described herein.

In the embodiment of FIGS. 25-31, the longitudinally-extending first roof contact side 28 comprises a peripherally-extending rim 112 that encloses and defines a sidewall 113 of the first side recess 72. The peripherally-extending rim may have any suitable rim thickness ($t_R$). The thickness will be selected to maximize the area of the first side recess while also reducing the potential for chipping or breakout of the rim 112 and sidewall 113 during use of the lightweight composite roofing support system 10. In one embodiment, rim thickness ($t_R$) comprises a range of 0.25 to 1.0 inches, more particularly 0.25 to 0.75 inches, and even more particularly 0.375 to 0.5 inches.

Referring to FIGS. 32-38, in one embodiment, the lightweight composite roofing support system 10 comprises a longitudinally-extending core member 12 as described herein, which further comprises an integral longitudinally-extending shelf 114 that also extends outwardly and laterally away from at least one of the second side 30 or the third side 34 and comprises a lower surface 115 that is coplanar with and by virtue of being integral with forms a part of the first roof contact side 28 and that, respectively, subsumes at least one of the second edge 24 or third edge 26. The longitudinally-extending core member 12 comprising the integral longitudinally-extending shelf 114 may be formed from the same core materials 14 described herein and may have the same sizes and same lateral cross-section 22 shapes of the core members described herein apart from the integration of the lateral cross-section 122 shape of the shelf 114. The lateral cross-section shape 122 of the shelf 114 may be understood from the left and right end views (FIGS. 35 and 36) to be substantially rectangular in embodiments without the integral upwardly-protruding longitudinally-extending rim 117 (as demarcated by the vertical phantom lines), and generally L-shaped with the integral upwardly-protruding longitudinally-extending rim 117. The longitudinally-extending core member 12 comprising the integral longitudinally-extending shelf 114 may have the same ranges of lengths described herein. The integral longitudinally-extending shelf 114 may have any suitable width ($w_S$), which in one embodiment ranges from 6 to 20 inches, more particularly 8 to 18 inches, and more particularly 10 to 18 inches, and yet more particularly (12 to 16 inches). The integral longitudinally-extending shelf 114 may have any suitable shelf thickness ($t_S$), which in one embodiment ranges from 0.5 to 2.0 inches, more particularly 0.75 to 1.75 inches, and more particularly 0.75 to 1.50 inches. It is desirable to make the shelf 114 as thin and strong as possible while maintaining flexural and tensile strength sufficient to support the desired shelf loads 98 and avoid failure of the shelf in bending due to application of these loads. In this regard, in one embodiment, the longitudinally-extending core member 12 comprising the integral longitudinally-extending shelf 114 may be molded with a variable density which is a lower density in the upper portions ($d_U$) of core member away from the shelf and higher density ($d_L$) in the integral longitudinally-extending shelf 114 and portions of the longitudinally-extending core member 12 proximate the shelf as illustrated schematically in FIGS. 35 and 36 as demarcated by optional interface 116. Variable density of the core material 14 within the core member 12 may be employed in any of the embodiments of core member 12 described herein, and the density may be infinitely variable or discretely variable throughout all or any portion of the core member 16 cross-section 22, and be lower in the upper portions and higher in the lower portions, or vice versa, and may also be varied longitudinally, laterally, or both, within core member 12. The shelf 114 is configured to hold roofing material 8 as described herein, including various tools and equipment, particularly roofing tools and equipment, and particularly a bundle or bundles of shingles 99 for use by a roofing working 6 that is disposed on and using the lightweight composite roofing support system 10 that includes the integral shelf 114. The integral shelf 114 may be very advantageously used to provide a portable platform that may be used to store the roofing materials 8 as described herein, such as a bundle or bundles of shingles 99, in a plurality of locations on the sloped roof 36 as the roofing materials are being installed and may be easily moved upslope or downslope or side-to-side from the eaves to the peak 39 of a sloped roof 36 to facilitate installation. This is a very desirable and advantageous location for storage of roofing materials 8 as they can also be easily distributed upslope or downslope or side-to-side to roofing workers 6 that are also installing materials on the sloped roof 36. In one embodiment, the integral longitudinally-extending shelf 114 further comprises an integral upwardly-protruding longitudinally-extending rim 117 on a distal edge or end 118 of the shelf to assist in retaining items that are placed on the shelf.

Referring again to FIGS. 32-38, the lightweight composite roofing support system 10 comprises a longitudinally-extending core member 12 as described herein and the longitudinally-extending cover layer 16 comprising cover material 18 will be sized to also cover all or substantially all of the first roof contact surface, including the portion associated with the lower surface 115 of the shelf 114. Representative ranges of the width ($w_1'$) of the first roof contact side 28 comprising the shelf 114 and associated cover layer 16 may be obtained by adding their representative ranges as described herein without the shelf ($w_1$) to the representative ranges of the width ($w_S$) of the shelf described herein, for example, (18 to 48 inches)+(6 to 20) inches=$w_1'$=(24 to 68 inches), more particularly (20 to 40) inches+(8 to 18) inches=$w_1'$=(28 to 58 inches), even more particularly (20 to 30 inches)+(10 to 18 inches)=$w_1$'=(30 to 48 inches), and yet more particularly (22 to 28 inches)+(12 to 16 inches)=$w_1$'=(32 to 44 inches).

In the embodiment of FIGS. 32-38, the cover layer 16 and cover material 18 may comprise those described in any of the embodiments of lightweight composite roofing support system 10 described herein. The cover layer 16 may be disposed on the first roof contact side in any suitable manner using any suitable attachment, including using any cover layer attachment and associated features in the first roof contact side 28 required for implementation of any of the embodiments of the lightweight composite roofing support systems 10 described herein, including the embodiments of FIGS. 1-31.

Referring to FIGS. 1-46, and particularly FIGS. 1-14 and 39-46, the lightweight composite roofing support system 10 and roof support 32 may comprise a lightweight composite roofing support system connector 120. The lightweight composite roofing support system connector 120 is configured to connect the first end 46 of one roofing support 32 to the second end of another roofing support 32. Using a plurality of roofing connectors 120 and roofing supports 32, the length of lightweight composite roofing support system 10 may be extended to any desired length, including a length that extends entirely from side-to-side across the length of any sloped roof. Thus, the connectors 120 and roof supports 32 can provide an extended roof platform 123 that extends entirely from side-to-side across any sloped roof 36, allowing roofing workers to freely move, walk, stand, crouch, kneel, sit, or lie on, or otherwise use the extended roof platform and to distribute or store roofing tools or roofing materials across all or any portion of the length of any sloped roof, as well as to store or stage roofing materials across all or any portion of the length of any sloped roof. The extended roof platform 123 also allows very advantageous and easier distribution of roofing materials 8 from a central peak platform 68 across the sloped roof 36 near the roof peak 39 where they can be distributed downslope to areas where the materials are being applied to the roof deck.

Figure 46:
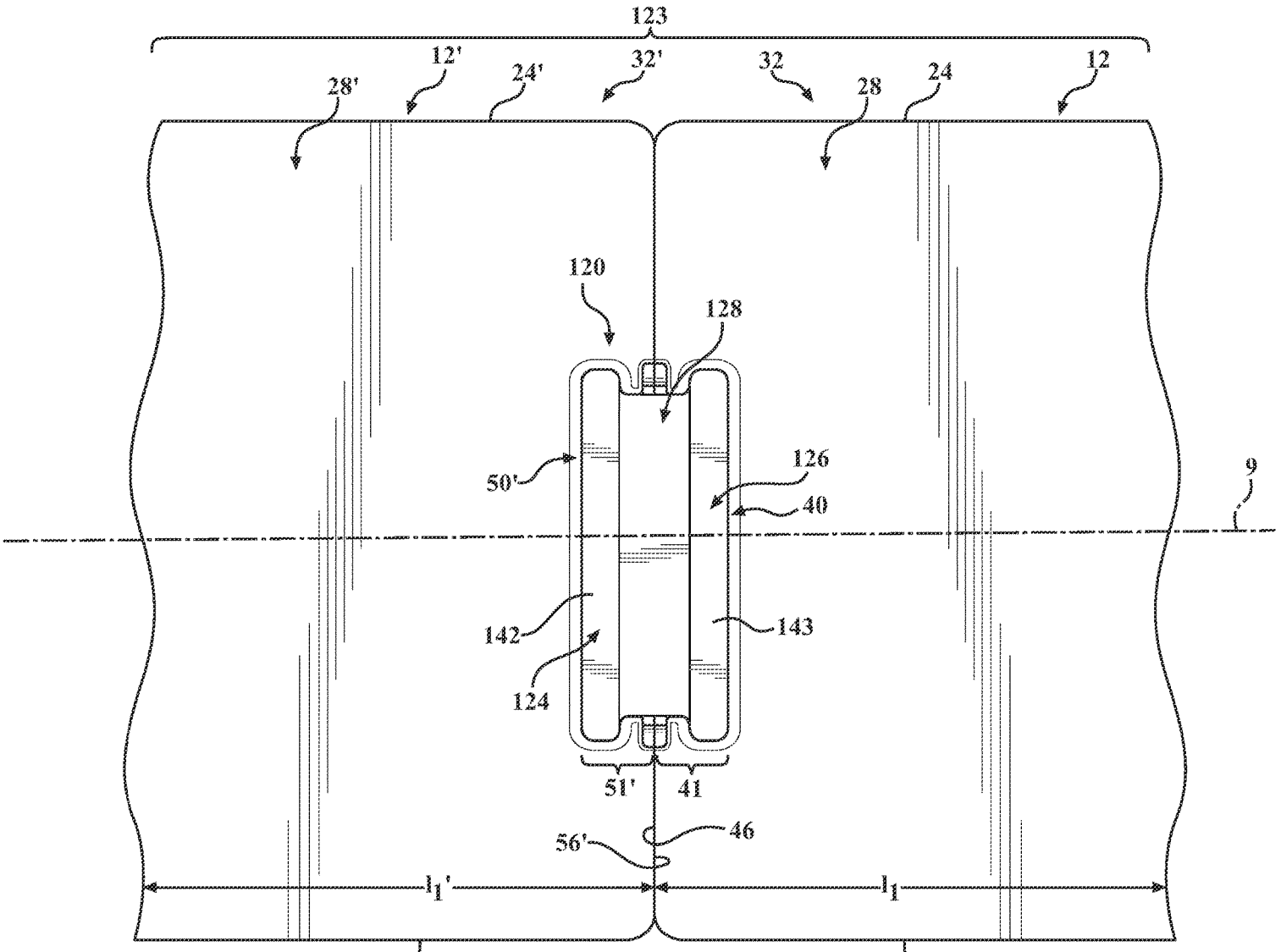
FIG. 46 is a bottom view of an embodiment of a roofing support system connector of FIGS. 39-45 connecting two roof supports to form an extended or extendable roofing support system and roof support as described herein.

Referring to FIGS. 1-14 and FIGS. 39-46, the longitudinally-extending connector 120 comprises a laterally-extending first connector end 124 and an opposed laterally-extending second connector end 126 joined together by a longitudinally-extending intermediate portion 128. The first connector end 124 is configured for selective engagement/disengagement or insertion/removal within the second slot 51' of the second core member 12' and second roof support 32' and the second connector end 126 is configured for selective engagement/disengagement or insertion/removal within the first slot 41 of the first core member 12 and first roof support 32, wherein upon engagement, the connector 120 is configured to connect the first roof support 32 and the second roof support 32'. FIG. 46 illustrates the first core member 12 and the second core member 12' with their compressible cover layers 16, 16' removed for purpose of illustrating the connection or joint formed by the connector 120. In normal use, the portions of the compressible cover layers 16, 16' that extend over first slot opening 40 and second slot opening 50' would be longitudinally and/or laterally manually compressed to reveal the first slot opening 40 and second slot opening 50' and enable insertion of the connector 120 with the second connector end 126 inserted into the first slot 41 and the first connector end 124 inserted into the second slot 51'. Upon insertion of the connector 120, the portions of the compressible cover layers 16, 16' that would extend over first slot opening 40 and second slot opening 50' would be released and spring back over and cover the first slot opening 40 and second slot opening 50'. The portions of the compressible cover layers 16, 16' that extend over first slot opening 40 and second slot opening 50' act as a retainer and prevent the connector from coming back out of the first slot 41 through the first slot opening 40 and/or the second slot 51' through second slot opening 50' during use.

The laterally-extending first connector end 124 and an opposed laterally-extending second connector end 126 may have any suitable lateral cross-section shapes or sizes. In one embodiment, the first end lateral cross-section 130 shape of the first connector end 124 comprises an irregular hexagon and the shape of the second slot 51' also comprises a mating irregular hexagon cross-section shape, and second end lateral cross-section 132 shape of the second connector end 126 comprises an irregular hexagon that is a mirror image of the first connector end 124 and the shape of the first slot 40 also comprises a mating irregular hexagon cross-section shape that is a mirror image of the second slot 51'. The size, particularly the first end width ($w_{E1}$), of the first connector end 124 should be the same as, or slightly greater than, the width ($d_2$) of the second slot 51' to provide, respectively, touching contact or an interference fit between them in order to promote retention of the first connector end 124 within the second slot 51'. The size, particularly the second end width ($w_{E2}$), of the second connector end 126 should be the same as, or slightly greater than, the width ($d_1$) of the first slot 40 to provide, respectively, touching contact or an interference fit between them in order to promote retention of the second connector end 126 within the first slot 40. In one embodiment, the first connector end 124 has the same first end lateral cross-section 130 shape as the opening shape of first recess 45, namely, an irregular hexagon cross-section shape comprising a lateral edge 134 having a second side edge end 135 and an opposed third side edge end 136, a second side vertical edge 137 extending from the second side edge end 135 upwardly toward second side 30, a third side vertical edge 138 extending from the third side edge end 136 upwardly toward third side 34, a tapered second side edge 139 configured to extend upwardly parallel to second side 30, a tapered third side edge 140 configured to extend upwardly parallel to the third side 34, a tapered fourth side edge 141 configured to extend parallel to fourth side 35 between second side edge 139 and third side edge 140.

The second connector end 126 may comprise any suitable second end lateral cross-section 132 shape configured for disposition and engagement as described. In one embodiment, the second connector end 126 has the same second end lateral cross-section 132 shape as the opening of the second recess 55, namely, an irregular hexagon shape and comprises a mirror image of the first end lateral cross-section 130 shape of the first connector end 124, and may be described as having the same elements as the first connector end 124.

The first connector end 124 also comprises a first base 142. In one embodiment, the first base 142 comprises a flat planar base and is configured in the inserted or installed condition and position to be coplanar with the first roof contact side 28'. The second connector end 126 also comprises a second base 143. In one embodiment, the second base 143 comprises a flat planar base and is configured in the engaged, inserted or installed condition and position to be coplanar with the first roof contact side 28.

The lightweight composite roofing support system connector 120 also comprises the longitudinally-extending intermediate portion 128. The intermediate portion 128 may have any suitable intermediate portion cross-section shape, which in one embodiment is the same as first end lateral cross-section 130 shape and second end lateral cross-section 132 shape with a reduced size as shown in FIGS. 39-46.

The lightweight composite roofing support system connector 120 is formed from and comprises connector material 144. Connector material 144 may comprise any of the core materials 14 described herein, and may be selected to be the same material as core material 14 or different than core material 14. Since the cross-section area or size of the intermediate portion 128 is less than the lateral cross-section 22 of the core members 12, 12', in one embodiment the connector 120 will comprise connector material 144 that has one or more of a higher density, compressive strength, compression set, tensile strength, or flexural strength as the core material 14 to ensure consistent strength of the extended platform 123 along its length, and more particularly that the strength is at least as high in the connector 120 at the interface between roof supports 32 and 32' at first end and second end 51' as it is in the intermediate portions of the supports.

Referring to FIGS. 8-14, and 46, in one embodiment, the lightweight composite roofing support system connector 120 is configured for use with a first roof support 32 and the second roof support 32' (the first and second roof supports 32, 32' being identical or having the same essential feature and differing, if at all, only in length (e.g., ($l_1$, $l_1$') with the (') used only to differentiate between them), each comprising: a longitudinally-extending core member 12, 12' comprising a longitudinally-extending first roof contact side 28, 28' comprising a longitudinally-extending first edge 24, 24' and an opposed longitudinally-extending second edge 26, 26', a longitudinally-extending second side 30, 30' comprising a second side working surface 31, 31' having a second width ($w_2$ $w_2$') and a second length ($l_2$,$l_2$') that is greater than the second width, the second side 30, 30' tapering toward the first edge 24, 24' at a first predetermined acute angle ($\alpha$) from the first roof contact side 28, 28', and a longitudinally-extending third side 34, 34' comprising a third side working surface 33, 33' having a third width and a third length that is greater than the third width, the third side 34, 34' tapering toward the second edge 26, 26' at a second predetermined acute angle ($\beta$, $\beta$') from the first contact side 28, 28' that is different than the first predetermined acute angle ($\alpha$, a'), a laterally-extending first end 46, 46' comprising an integral first recess 45, 45' defining a first handle or grip 48, 48', and an opposed laterally-extending second end 56, 56' comprising an integral second recess 55, 55' defining a second handle or grip 58, 58', the core member 12, 12' comprising a core material 14, 14' and a wedge-shaped lateral cross-section 22, 22' shape. The first roof support 32 and the second roof support 32' also each comprise a cover layer 16, 16' comprising a compressible cover material 18, 18', the cover layer 16, 16' disposed on and covering the first roof contact side 28, 28', wherein the first recess 45, 45' defines a first slot 41, 41' that opens into the longitudinally-extending first roof contact side 28, 28' proximate the first end 46, 46' and the second recess 55, 55' defines a second slot 51, 51' that opens into the first roof contact side 28, 28' proximate the second end 56, 56', the first connector end 124 is configured for mating engagement within the second slot 51' of the second roof support 12', the second connector end 126 configured for mating engagement within the first slot 41, respectively, of the first roof support 32. FIG. 46 illustrates an installed or inserted position and condition of the connector 120 within the first roof support 32 and the second roof support 32'. In one embodiment, the first connector end 124 comprises an irregular hexagonal first end lateral cross-section 130 shape and second connector end 126 comprises an irregular hexagonal second end lateral cross-section 132 shape, and the first slot 41 comprises an irregular hexagonal lateral first slot cross-section 130 shape illustrated by the shape of recess 45 opening and the second slot 51' comprises an irregular hexagonal lateral second slot cross-section shape illustrated by the shape of recess 55' opening. In one embodiment, irregular hexagonal first end lateral cross-section 130 shape and irregular hexagonal second end lateral cross-section 132 shape are mirror images of one another.

In other embodiments, the connector 120 may have another first end lateral cross-section 130 shape and another second end lateral cross-section 132 shape. For example, referring to the embodiment of a core member 12 comprising a triangular lateral cross-section 22, more particularly a rounded or blunted scalene triangular lateral cross-section, as described herein and illustrated in FIG. 49, a suitable connector 120 would have the irregular pentagon cross-section shape of the periphery of the handle or grip 58, and could be described using the same elements as set for herein for connector 120, except that there would be no tapered fourth side edge 141 configured to extend parallel to fourth side 35 between second side edge 139 and third side edge 140, rather second side edge 139 and third side edge 139 would taper to and intersect one another. This lightweight composite roofing support system connector 120 also comprises the longitudinally-extending intermediate portion 128. The intermediate portion 128 may have any suitable intermediate portion cross-section shape, which in one embodiment is the same as first end lateral cross-section 130 shape and second end lateral cross-section 132 shape, namely, an irregular pentagon with a size or cross-sectional area smaller than the first end lateral cross-section 130 and the second end lateral cross-section 132.

The terms "a" and "an" herein do not denote a limitation of quantity, but rather denote the presence of at least one of the referenced items, and may include a plurality of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of items is applied to all of the listed items, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the components or elements described herein specifically discloses and includes the embodiments that "consist essentially of" the named components (i.e., contain the named components and no other components that significantly adversely affect the basic and novel features disclosed), and embodiments that "consist of" the named components (i.e., contain only the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A lightweight composite roofing support system, consisting of:

a longitudinally-extending core member having a wedge-shaped lateral cross-section, a longitudinally-extending first roof contact side, a longitudinally-extending second side comprising a second side working surface having a second width and a longitudinally-extending second length that is greater than the second width, the first roof contact side and the second side tapering toward one another at a first acute angle ($\alpha$), and a longitudinally-extending third side comprising a third side working surface having a third width and a longitudinally-extending third length that is greater than the third width, the first roof contact side and the third side tapering toward one another at a second acute angle ($\beta$) that is different than the first acute angle ($\alpha$), a laterally-extending first end comprising an integral first recess defining a first handle or grip, and an opposed laterally-extending second end comprising an integral second recess defining a second handle or grip, the core member comprising a core material; and a resiliently compressible cover layer comprising a resiliently compressible cover material, the cover layer disposed on and covering the first roof contact side, the core member and cover layer comprising a first roofing support.

2. The roofing support system of claim 1, wherein the core material comprises a rigid or substantially rigid engineering thermoset or thermoplastic polymer and the cover material comprises a resiliently compressible polymer.

3. The roofing support system of claim 1, wherein the core material comprises a rigid or substantially rigid expanded foam comprising polystyrene (EPS), polyethylene (EPE), polypropylene (EPP), polyurethane (EPU), or ethylene-vinyl acetate (EEVA), or a combination thereof, and the cover material comprises polyurethane (PU), polystyrene (PS), polyisocyanurate (PIR), polyethylene (PE), polypropylene (PP), poly (ethylene-vinyl acetate) (EVA), poly (vinyl chloride) (PVC), or a natural or synthetic rubber, or a combination thereof.

4. The roofing support system of claim 1, wherein the wedge-shaped lateral cross-section shape comprises a triangular, scalene trapezoidal, irregular quadrilateral, or truncated triangular shape.

5. The roofing support system of claim 1, wherein the second side working surface and third side working surface each comprise a non-skid surface that is integrally formed in the core material of the respective working surface.

6. The roofing support system of claim 1, wherein the second side working surface and the third side working surface each comprise a continuous surface.

7. The roofing support system of claim 6, wherein the continuous surfaces comprise a roofing worker platform configured for movement, walking, standing, crouching, kneeling, sitting, or lying down of a roofing worker.

8. The roofing support system of claim 1, wherein the longitudinally-extending core member further comprises a longitudinally-extending fourth side that extends between and tapers downwardly from the second side to the third side.

9. The roofing support system of claim 8, wherein the wedge-shaped lateral cross-section comprises a truncated triangular or irregular quadrilateral shape.

10. The roofing support system of claim 1, wherein the core material comprises rigid or substantially rigid expanded polypropylene (EPP) or expanded ethylene-vinyl acetate (EEVA).

11. The roofing support system of claim 10, wherein the expanded polypropylene (EPP) or expanded ethylene-vinyl acetate (EEVA) has a density of 1.25-12 lb./ft$^3$.

12. The roofing support system of claim 1, wherein the resiliently compressible cover layer comprises a polyurethane foam.

13. The roofing support system of claim 1, wherein the resiliently compressible cover layer has a thickness in the range of 0.020 to 2.5 inches.

14. The roofing support system of claim 1, wherein the core material comprises rigid or substantially rigid expanded polypropylene (EPP) or expanded ethylene-vinyl acetate (EEVA) and the resiliently compressible cover layer comprises polyurethane foam.

15. The roofing support system of claim 1, wherein the cover layer is disposed on and covering the first roof contact side by an attachment comprising a hot-melt adhesive.

16. The roofing support system of claim 14, wherein the cover layer is disposed on and covering the first roof contact side by an adhesive joint.

17. The roofing support system of claim 14, wherein the cover layer is disposed on and covering the first roof contact side by a hot-melt adhesive.

18. The roofing support system of claim 5, wherein the second side working surface comprises a plurality of second side traction elements and the third side working surface comprises a plurality of third side traction elements.

19. The roofing support system of claim 1, wherein the integral first recess comprises a first recess opening in the first end and a first slot that extends inwardly from the first roof contact side and upwardly toward both the second side and the third side and defines a first inner slot wall that bounds the first recess and the integral second recess comprises a second recess opening in the second end and a second slot that extends inwardly from the first roof contact side and upwardly toward both the second side and the third side and defines a second inner slot wall that bounds the second recess.

20. The roofing support system of claim 1, wherein the integral first recess and the integral second recess are each configured to selectively engage with/disengage from a respective roofing support system connector.

21. A lightweight composite roofing support system, consisting of:

a single longitudinally-extending core member having a wedge-shaped lateral cross-section, a longitudinally-extending first roof contact side, a longitudinally-extending second side having a second width and a longitudinally-extending second length that is greater than the second width that define a continuous, longitudinally-extending second side working surface, the longitudinally-extending first roof contact side and the longitudinally-extending second side tapering toward one another at a first acute angle (α), and a longitudinally-extending third side having a third width and a longitudinally-extending third length that is greater than the third width that define a continuous, longitudinally-extending third side working surface, the longitudinally-extending first roof contact side and the longitudinally-extending third side tapering toward one another at a second acute angle (β) that is different than the first acute angle (α), a laterally-extending first end comprising an integral first recess defining a first handle or grip, and an opposed laterally-extending second end comprising an integral second recess defining a second handle or grip, the core member comprising a core material; and a resiliently compressible cover layer comprising a resiliently compressible cover material, the cover layer disposed on and covering the longitudinally-extending first roof contact side, the core member and cover layer comprising a first roofing support.

* * * * *